US011890515B2

(12) United States Patent
Parsons et al.

(10) Patent No.: US 11,890,515 B2
(45) Date of Patent: Feb. 6, 2024

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US); Caleb S. Kroloff, Phoenix, AZ (US); Daniel C. Kirtley, Scottsdale, AZ (US); William N. Knopka, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 127 days.

(21) Appl. No.: 17/750,053

(22) Filed: May 20, 2022

(65) Prior Publication Data

US 2022/0273993 A1 Sep. 1, 2022

Related U.S. Application Data

(63) Continuation of application No. 17/545,708, filed on Dec. 8, 2021, now Pat. No. 11,369,847, which is a (Continued)

(51) Int. Cl.
*A63B 53/04* (2015.01)
*A63B 60/02* (2015.01)

(Continued)

(52) U.S. Cl.
CPC ..... *A63B 53/0466* (2013.01); *A63B 1/00* (2013.01); *A63B 53/04* (2013.01); *A63B 60/02* (2015.10);

(Continued)

(58) Field of Classification Search
CPC . A63B 60/02; A63B 53/0412; A63B 53/0475; A63B 2053/0491; A63B 53/047
See application file for complete search history.

(56) References Cited

U.S. PATENT DOCUMENTS 723,258 A 3/1903 Felton
1,133,129 A 3/1915 Govan (Continued)

FOREIGN PATENT DOCUMENTS

CN 107106894 B 12/2018
CN 107530575 B 4/2019

(Continued)

OTHER PUBLICATIONS

Chinese Office Action for corresponding CN Application No. 202210013015.6, dated Feb. 2, 2023 (includes machine translation).

(Continued)

*Primary Examiner* — William M Pierce

(57) ABSTRACT

Embodiments of golf club heads, golf clubs, and methods to manufacture golf club heads and golf clubs are described herein. In one example, a golf club head includes a body portion having an interior cavity, a back opening portion, a back cover portion covering the back opening portion, a filler material at least partially filling the interior cavity, a first mass portion coupled to the back cover portion, and a second mass portion coupled to the back cover portion. The body portion may be made from a first material having a first density, and the back cover portion may be made from second material having a second density different from the first density. The diameter of the second mass portion may be greater than a diameter of the first mass portion. Other examples and embodiments may be described and claimed.

20 Claims, 24 Drawing Sheets

Related U.S. Application Data continuation-in-part of application No. 17/099,362, filed on Nov. 16, 2020, now Pat. No. 11,291,890, which is a continuation of application No. 16/820,136, filed on Mar. 16, 2020, now Pat. No. 10,874,919, which is a continuation of application No. 16/590,105, filed on Oct. 1, 2019, now Pat. No. 10,632,349.

(60) Provisional application No. 63/171,481, filed on Apr. 6, 2021, provisional application No. 63/135,426, filed on Jan. 8, 2021, provisional application No. 62/908,467, filed on Sep. 30, 2019, provisional application No. 62/903,467, filed on Sep. 20, 2019, provisional application No. 62/877,934, filed on Jul. 24, 2019, provisional application No. 62/877,915, filed on Jul. 24, 2019, provisional application No. 62/865,532, filed on Jun. 24, 2019, provisional application No. 62/826,310, filed on Mar. 29, 2019, provisional application No. 62/814,959, filed on Mar. 7, 2019.

(51) Int. Cl.
*A63B 1/00* (2006.01)
*A63B 60/54* (2015.01)
*A63B 60/00* (2015.01)

(52) U.S. Cl.
CPC ..... *A63B 53/045* (2020.08); *A63B 53/0408* (2020.08); *A63B 53/0412* (2020.08); *A63B 53/0433* (2020.08); *A63B 53/0475* (2013.01); *A63B 60/002* (2020.08); *A63B 60/54* (2015.10); *A63B 2053/0491* (2013.01); *A63B 2209/00* (2013.01)

(56) References Cited

U.S. PATENT DOCUMENTS 1,534,600 A 4/1925 Mattern
1,538,312 A 5/1925 Neish
D138,438 S 8/1944 Link
3,020,048 A 2/1962 Carroll
3,266,805 A 8/1966 Bulla
D215,101 S 9/1969 Sabat
D229,431 S 11/1973 Baker
3,843,122 A 10/1974 Florian
D234,609 S 3/1975 Raymont
D239,550 S 4/1976 Timbrook
D240,748 S 7/1976 Bock et al.
4,085,934 A 4/1978 Churchward
D253,778 S 12/1979 Madison
4,355,808 A * 10/1982 Jernigan ..... A63B 53/047 264/129
4,502,687 A 3/1985 Kochevar
4,523,759 A 6/1985 Igarashi
4,545,580 A 10/1985 Tomita et al.
4,591,160 A 5/1986 Piragino
D294,617 S 3/1988 Perkins
4,754,977 A 7/1988 Sahm
4,803,023 A 2/1989 Enomoto et al.
4,824,116 A 4/1989 Nagamoto et al.
4,928,972 A 5/1990 Nakanishi et al.
4,988,104 A 1/1991 Shiotani et al.
5,028,049 A 7/1991 McKeighen
5,090,702 A 2/1992 Viste
5,106,094 A 4/1992 Desbiolles et al.
5,158,296 A 10/1992 Lee
5,176,384 A 1/1993 Sata et al.
5,184,823 A 2/1993 Desboilles et al.
5,213,328 A 5/1993 Long et al.
D336,672 S 6/1993 Gorman
5,219,408 A * 6/1993 Sun ..... B22C 9/12 164/76.1
5,244,211 A 9/1993 Lukasiewicz
5,290,036 A 3/1994 Fenton et al.
5,306,450 A 4/1994 Okumoto et al.
5,348,302 A 9/1994 Sasamoto et al.
D351,883 S 10/1994 Solheim et al.
5,351,958 A 10/1994 Helmstetter
5,419,559 A 5/1995 Melanson et al.
5,419,560 A 5/1995 Bamber
5,421,577 A 6/1995 Kobayashi
5,425,535 A 6/1995 Gee
D361,358 S 8/1995 Simmons
5,447,311 A 9/1995 Viollaz et al.
5,451,056 A 9/1995 Manning
D362,885 S 10/1995 Blough et al.
5,485,998 A 1/1996 Kobayashi
5,518,243 A 5/1996 Redman
5,540,437 A 7/1996 Bamber
5,595,548 A 1/1997 Beck
D378,111 S 2/1997 Parente et al.
5,637,045 A 6/1997 Igarashi
5,647,808 A 7/1997 Hosokawa
5,649,873 A 7/1997 Fuller
5,669,830 A 9/1997 Bamber
5,766,091 A 6/1998 Humphrey et al.
5,766,092 A * 6/1998 Mimeur ..... A63B 60/00 473/332
5,769,735 A 6/1998 Hosokawa
5,772,527 A 6/1998 Liu
5,788,584 A 8/1998 Parente et al.
5,797,807 A 8/1998 Moore
5,827,132 A 10/1998 Bamber
5,899,821 A * 5/1999 Hsu ..... A63B 53/047 473/332
5,935,016 A 8/1999 Antonious
6,012,990 A 1/2000 Nishizawa
D421,080 S 2/2000 Chen
6,030,293 A 2/2000 Takeda
6,064,568 A 5/2000 Schmitt
D426,276 S 6/2000 Besnard et al.
6,077,171 A 6/2000 Yoneyama
6,162,133 A 12/2000 Peterson
6,165,081 A 12/2000 Chou
D442,659 S 5/2001 Kubica et al.
6,231,458 B1 5/2001 Cameron et al.
6,238,302 B1 5/2001 Helmstetter et al.
D445,862 S 7/2001 Ford
6,290,609 B1 9/2001 Takeda
6,386,990 B1 5/2002 Reyes et al.
D469,833 S 2/2003 Roberts et al.
D475,107 S 5/2003 Madore
D478,140 S 8/2003 Burrows
6,607,451 B2 8/2003 Kosmatka et al.
6,638,182 B2 10/2003 Kosmatka
6,695,714 B1 2/2004 Bliss et al.
6,702,693 B2 3/2004 Bamber
6,780,123 B2 8/2004 Hasebe
6,811,496 B2 11/2004 Wahl et al.
6,830,519 B2 12/2004 Reed et al.
6,855,067 B2 2/2005 Solheim et al.
D502,975 S 3/2005 Schweigert et al.
D503,204 S 3/2005 Nicolette et al.
D508,545 S 8/2005 Roberts et al.
D508,969 S 8/2005 Hasebe
6,923,733 B2 8/2005 Chen
D514,183 S 1/2006 Schweigert et al.
6,984,180 B2 1/2006 Hasebe
7,022,029 B2 4/2006 Caldwell
D523,501 S 6/2006 Nicolette et al.
7,121,956 B2 10/2006 Lo
7,128,663 B2 10/2006 Bamber
7,153,222 B2 12/2006 Gilbert et al.
D534,595 S 1/2007 Hasebe
7,156,751 B2 1/2007 Wahl et al.
7,169,057 B2 1/2007 Wood et al.
7,182,698 B2 2/2007 Tseng
7,207,900 B2 4/2007 Nicolette et al.
D543,601 S 5/2007 Kawami
7,281,991 B2 10/2007 Gilbert et al.
D555,219 S 11/2007 Lin

(56) References Cited

U.S. PATENT DOCUMENTS 7,303,486 B2 12/2007 Imamoto
7,351,164 B2 4/2008 Schweigert et al.
7,396,299 B2 7/2008 Nicolette et al.
7,553,241 B2 6/2009 Park et al.
7,582,024 B2 9/2009 Shear
7,588,502 B2 9/2009 Nishino
7,594,862 B2 9/2009 Gilbert
7,611,424 B2 11/2009 Nagai et al.
7,658,686 B2 2/2010 Soracco
D618,293 S 6/2010 Foster et al.
7,744,484 B1 6/2010 Chao
7,744,486 B2 6/2010 Hou et al.
7,744,487 B2 6/2010 Tavares et al.
7,749,100 B2 7/2010 Tavares et al.
7,785,212 B2 8/2010 Lukasiewicz et al.
7,794,333 B2 9/2010 Wallans et al.
7,798,917 B2 9/2010 Nguyen et al.
7,803,068 B2 9/2010 Clausen et al.
7,815,521 B2 10/2010 Ban et al.
7,846,040 B2 12/2010 Ban
7,938,738 B2 5/2011 Roach
8,012,040 B2 9/2011 Takechi
8,062,150 B2 11/2011 Gilbert et al.
8,088,025 B2 1/2012 Wahl et al.
8,092,319 B1 1/2012 Cackett et al.
8,105,180 B1 1/2012 Cackett et al.
8,221,262 B1 7/2012 Cackett et al.
8,246,487 B1 8/2012 Cackett et al.
8,257,196 B1 9/2012 Abbott et al.
8,262,506 B2 9/2012 Watson et al.
8,277,337 B2 10/2012 Shimazaki
8,328,662 B2 12/2012 Nakamura et al.
8,376,878 B2 2/2013 Bennett et al.
8,393,976 B2 3/2013 Soracco et al.
D681,142 S 4/2013 Fossum et al.
8,414,422 B2 4/2013 Peralta et al.
8,449,406 B1 5/2013 Frame et al.
8,475,293 B2 7/2013 Morin et al.
8,506,420 B2 8/2013 Hocknell et al.
8,535,176 B2 9/2013 Bazzel et al.
8,545,343 B2 10/2013 Boyd et al.
8,574,094 B2 11/2013 Nicolette et al.
8,657,700 B2 2/2014 Nicolette et al.
8,663,026 B2 3/2014 Blowers et al.
8,690,710 B2 4/2014 Nicolette et al.
8,753,230 B2 6/2014 Stokke et al.
8,790,196 B2 7/2014 Solheim et al.
8,827,832 B2 9/2014 Breier et al.
8,827,833 B2 9/2014 Amano et al.
8,845,455 B2 9/2014 Ban et al.
8,858,362 B1 10/2014 Leposky et al.
8,936,518 B2 1/2015 Takechi
D722,351 S 2/2015 Parsons et al.
D722,352 S 2/2015 Nicolette et al.
D723,120 S 2/2015 Nicolette
8,961,336 B1 2/2015 Parsons et al.
D724,164 S 3/2015 Schweigert et al.
D725,208 S 3/2015 Schweigert
D726,265 S 4/2015 Nicolette
D726,846 S 4/2015 Schweigert
9,005,056 B2 4/2015 Pegnatori
D729,892 S 5/2015 Nicolette et al.
D733,234 S 6/2015 Nicolette
9,044,653 B2 6/2015 Wahl et al.
D738,449 S 9/2015 Schweigert
D739,487 S 9/2015 Schweigert
9,192,830 B2 11/2015 Parsons et al.
9,192,832 B2 11/2015 Parsons et al.
9,199,143 B1 12/2015 Parsons et al.
D746,927 S 1/2016 Parsons et al.
D748,214 S 1/2016 Nicolette et al.
D748,215 S 1/2016 Parsons et al.
D748,749 S 2/2016 Nicolette et al.
D753,251 S 4/2016 Schweigert et al.
D753,252 S 4/2016 Schweigert
D755,319 S 5/2016 Nicolette et al.
D756,471 S 5/2016 Nicolette et al.
9,345,938 B2 5/2016 Parsons et al.
9,346,203 B2 5/2016 Parsons et al.
9,352,197 B2 5/2016 Parsons et al.
D759,178 S 6/2016 Nicolette
D760,334 S 6/2016 Schweigert et al.
9,364,727 B2 6/2016 Parsons et al.
9,399,158 B2 7/2016 Parsons et al.
9,421,437 B2 8/2016 Parsons et al.
9,427,634 B2 8/2016 Parsons et al.
9,440,124 B2 9/2016 Parsons et al.
9,468,821 B2 10/2016 Parsons et al.
9,517,393 B2 12/2016 Cardani et al.
9,533,201 B2 1/2017 Parsons et al.
9,550,096 B2 1/2017 Parsons et al.
9,610,481 B2 4/2017 Parsons et al.
9,630,070 B2 4/2017 Parsons et al.
9,636,554 B2 5/2017 Parsons et al.
9,649,540 B2 5/2017 Parsons et al.
9,649,542 B2 5/2017 Nicolette
9,662,547 B2 5/2017 Parsons et al.
9,675,853 B2 6/2017 Parsons et al.
9,750,993 B2 9/2017 Ritchie et al.
9,764,194 B2 9/2017 Parsons et al.
9,782,643 B2 10/2017 Parsons et al.
9,795,842 B1 10/2017 Parsons et al.
9,795,843 B2 10/2017 Parsons et al.
9,814,952 B2 11/2017 Parsons et al.
10,427,018 B2 10/2019 Taylor et al.
10,449,428 B2 10/2019 Parsons et al.
10,471,319 B1 11/2019 Mata
10,478,684 B2 11/2019 Parsons et al.
10,512,829 B2 12/2019 Parsons et al.
10,596,425 B2 * 3/2020 Parsons ..... A63B 53/0475
10,632,349 B2 4/2020 Parsons et al.
10,806,977 B2 10/2020 Spackman et al.
10,874,919 B2 * 12/2020 Parsons ..... A63B 53/04
11,110,325 B2 9/2021 Spackman et al.
11,117,030 B2 9/2021 Parsons et al.
11,192,003 B2 * 12/2021 Parsons ..... A63B 53/04
11,235,212 B2 2/2022 Clarke et al.
11,369,847 B2 * 6/2022 Parsons ..... A63B 53/047
11,497,972 B2 * 11/2022 Hill ..... A63B 60/02
11,707,655 B2 * 7/2023 Parsons ..... A63B 60/02 473/345
11,745,067 B2 * 9/2023 Parsons ..... A63B 53/0412 473/345
11,794,081 B2 * 10/2023 Parsons ..... A63B 60/50
2001/0055996 A1 12/2001 Iwata et al.
2002/0004427 A1 1/2002 Cheng et al.
2002/0037775 A1 3/2002 Keelan
2002/0094884 A1 7/2002 Hocknell et al.
2002/0107087 A1 8/2002 Fagot
2003/0139226 A1 7/2003 Cheng et al.
2003/0176231 A1 9/2003 Hasebe
2003/0194548 A1 10/2003 McLeod et al.
2004/0082401 A1 4/2004 Takeda
2004/0092331 A1 5/2004 Best
2004/0204263 A1 10/2004 Fagot et al.
2004/0266550 A1 12/2004 Gilbert et al.
2005/0009632 A1 1/2005 Schweigert et al.
2005/0014573 A1 1/2005 Lee
2005/0043117 A1 2/2005 Gilbert et al.
2005/0054462 A1 3/2005 Breier et al.
2005/0119066 A1 6/2005 Stites et al.
2005/0192116 A1 9/2005 Imamoto
2005/0209023 A1 9/2005 Tseng
2005/0239569 A1 10/2005 Best et al.
2005/0255936 A1 11/2005 Huang
2005/0266931 A1 12/2005 Hou et al.
2005/0277485 A1 12/2005 Hou et al.
2005/0278931 A1 12/2005 Deshmukh et al.
2006/0111200 A1 5/2006 Poynor
2006/0229141 A1 10/2006 Galloway
2006/0240909 A1 10/2006 Breier et al.
2007/0032308 A1 2/2007 Fagot et al.
2007/0129166 A1 6/2007 Shimazaki et al.
2007/0225084 A1 9/2007 Schweigert et al.

(56) References Cited

U.S. PATENT DOCUMENTS

| | | | | |
|---|---|---|---|---|
| 2008/0022502 | A1 | 1/2008 | Tseng | |
| 2008/0058113 | A1 | 3/2008 | Nicolette et al. | |
| 2008/0188322 | A1 | 8/2008 | Anderson et al. | |
| 2008/0300065 | A1 | 12/2008 | Schweigert | |
| 2008/0318705 | A1 | 12/2008 | Clausen et al. | |
| 2008/0318706 | A1 | 12/2008 | Larson | |
| 2009/0011858 | A1 | 1/2009 | Binette et al. | |
| 2009/0029790 | A1 | 1/2009 | Nicolette et al. | |
| 2009/0280923 | A1 | 11/2009 | Park et al. | |
| 2010/0130306 | A1 | 5/2010 | Schweigert | |
| 2010/0178999 | A1 | 7/2010 | Nicolette et al. | |
| 2010/0323812 | A1 | 12/2010 | Boyd et al. | |
| 2011/0021285 | A1 | 1/2011 | Shimazaki | |
| 2011/0028240 | A1 | 2/2011 | Wahl et al. | |
| 2011/0111883 | A1 | 5/2011 | Cackett | |
| 2011/0165963 | A1 | 7/2011 | Cackett et al. | |
| 2011/0269567 | A1 | 11/2011 | Ban et al. | |
| 2011/0294596 | A1 | 12/2011 | Ban | |
| 2012/0064991 | A1 | 3/2012 | Evans | |
| 2012/0196702 | A1 | 8/2012 | Shimazaki | |
| 2013/0137532 | A1 | 5/2013 | Deshmukh et al. | |
| 2013/0165257 | A1 | 6/2013 | Dipert et al. | |
| 2013/0225319 | A1 | 8/2013 | Kato | |
| 2013/0281226 | A1 | 10/2013 | Ban | |
| 2013/0288823 | A1 | 10/2013 | Hebreo | |
| 2013/0303303 | A1 | 11/2013 | Ban | |
| 2013/0310192 | A1 | 11/2013 | Wahl et al. | |
| 2013/0316842 | A1* | 11/2013 | Demkowski ..... | A63B 53/047 473/291 |
| 2014/0045605 | A1 | 2/2014 | Fujiwara et al. | |
| 2014/0080621 | A1 | 3/2014 | Nicolette et al. | |
| 2014/0128175 | A1 | 5/2014 | Jertson et al. | |
| 2014/0274441 | A1 | 9/2014 | Greer | |
| 2014/0274442 | A1 | 9/2014 | Honea et al. | |
| 2014/0274451 | A1 | 9/2014 | Knight et al. | |
| 2014/0364248 | A1 | 12/2014 | Wahl et al. | |
| 2015/0192116 | A1 | 7/2015 | Haug et al. | |
| 2015/0231454 | A1 | 8/2015 | Parsons et al. | |
| 2015/0231806 | A1* | 8/2015 | Parsons ..... | A63B 53/0475 264/261 |
| 2016/0045793 | A1 | 2/2016 | Cardani et al. | |
| 2016/0296804 | A1 | 10/2016 | Parsons et al. | |
| 2016/0317883 | A1 | 11/2016 | Parsons et al. | |
| 2017/0157474 | A1 | 6/2017 | Sander | |
| 2017/0239533 | A1 | 8/2017 | Cole et al. | |
| 2017/0340928 | A1 | 11/2017 | Parsons et al. | |
| 2018/0028882 | A1 | 2/2018 | Hebreo et al. | |
| 2018/0028883 | A1 | 2/2018 | Morin et al. | |
| 2018/0050243 | A1 | 2/2018 | Parsons et al. | |
| 2018/0140910 | A1 | 5/2018 | Parsons et al. | |
| 2018/0318673 | A1 | 11/2018 | Parsons et al. | |
| 2020/0171362 | A1 | 6/2020 | Wang et al. | |

FOREIGN PATENT DOCUMENTS

| | | | |
|---|---|---|---|
| DE | 29715997 | U1 | 2/1998 |
| GB | 2249031 | A | 4/1992 |
| JP | H0284972 | U | 7/1990 |
| JP | H08257181 | A | 10/1996 |
| JP | 3047811 | U | 4/1998 |
| JP | H10127832 | A | 5/1998 |
| JP | H10277187 | A | 10/1998 |
| JP | 2001346924 | A | 12/2001 |
| JP | 2002143356 | A | 5/2002 |
| JP | 2004313777 | A | 11/2004 |
| JP | 2005218510 | A | 8/2005 |
| JP | 2013043091 | A | 3/2013 |
| JP | 2019501693 | A | 1/2019 |
| WO | 9215374 | A1 | 9/1992 |

OTHER PUBLICATIONS

Japanese Office Action for corresponding JP Application No. 2022-001292, dated Dec. 27, 2022 (includes machine translation).

Kozuchowski, Zak, "Callaway Mack Daddy 2 PM Grind Wedges" (http://www.golfwrx.com/276203/callaway-mack-daddy-2-pm-grind-wedges/), www.golfwrx.com, GolfWRX Holdings, LLC, published Jan. 21, 2015.

PCT/US16/42075: International Search Report and Written Opinion dated Sep. 22, 2016 (13 Pages).

PCT/US19/17464: International Search Report and Written Opinion dated Apr. 29, 2019 (9 Pages).

PCT/US19/54104: International Search Report and Written Opinion dated Dec. 30, 2019 (10 Pages).

PCT/US2015/016666: International Search Report and Written Opinion dated May 14, 2015 (8 Pages).

PCT/US2018/023617: International Search Report and Written Opinion dated May 31, 2018 (10 Pages).

Rocketbladez Press Release, "Golfballed", http://golfballed.com/index.php?option=com_content&view=article&id=724:taylormade- . . . Oct. 13, 2017, Published Jan. 3, 2013.

Taylor Made Golf Company, Inc., https://taylormadegolf.com/on/demandware.static/-/Sites-TMaG-Library/default//1459859109590/docs/productspecs/TM-S2013-Catalog18.pdf., published Jan. 2013.

U.S. Appl. No. 29/512,313, Nicolette, "Golf Club Head," filed Dec. 18, 2014.

Wall, Jonathan, "Details: Phil's Prototype Mack Daddy PM-GRIND Wedge," (http://www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation of application Ser. No. 17/545,708, filed Dec. 8, 2021, which claims the benefits of U.S. Provisional Application No. 63/171,481, filed Apr. 6, 2021, and U.S. Provisional Application No. 63/135,426, filed Jan. 8, 2021.

U.S. application Ser. No. 17/545,708 is a continuation-in-part of application Ser. No. 17/099,362, filed Nov. 16, 2020, now U.S. Pat. No. 11,291,890, which is a continuation of application Ser. No. 16/820,136, filed Mar. 16, 2020, now U.S. Pat. No. 10,874,919, which is a continuation of application Ser. No. 16/590,105, filed Oct. 1, 2019, now U.S. Pat. No. 10,632,349, which claims the benefit of U.S. Provisional Application No. 62/908,467, filed Sep. 30, 2019, U.S. Provisional Application No. 62/903,467, filed Sep. 20, 2019, U.S. Provisional Application No. 62/877,934, filed Jul. 24, 2019, U.S. Provisional Application No. 62/877,915, filed Jul. 24, 2019, U.S. Provisional Application No. 62/865,532, filed Jun. 24, 2019, U.S. Provisional Application No. 62/826,310, filed Mar. 29, 2019, and U.S. Provisional Application No. 62/814,959, filed Mar. 7, 2019.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

The disclosures of the above-referenced applications are incorporated by reference herein in their entirety.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOT) of the golf club heads may be optimized to produce certain trajectory and spin rate of a golf ball.

Figure 1:
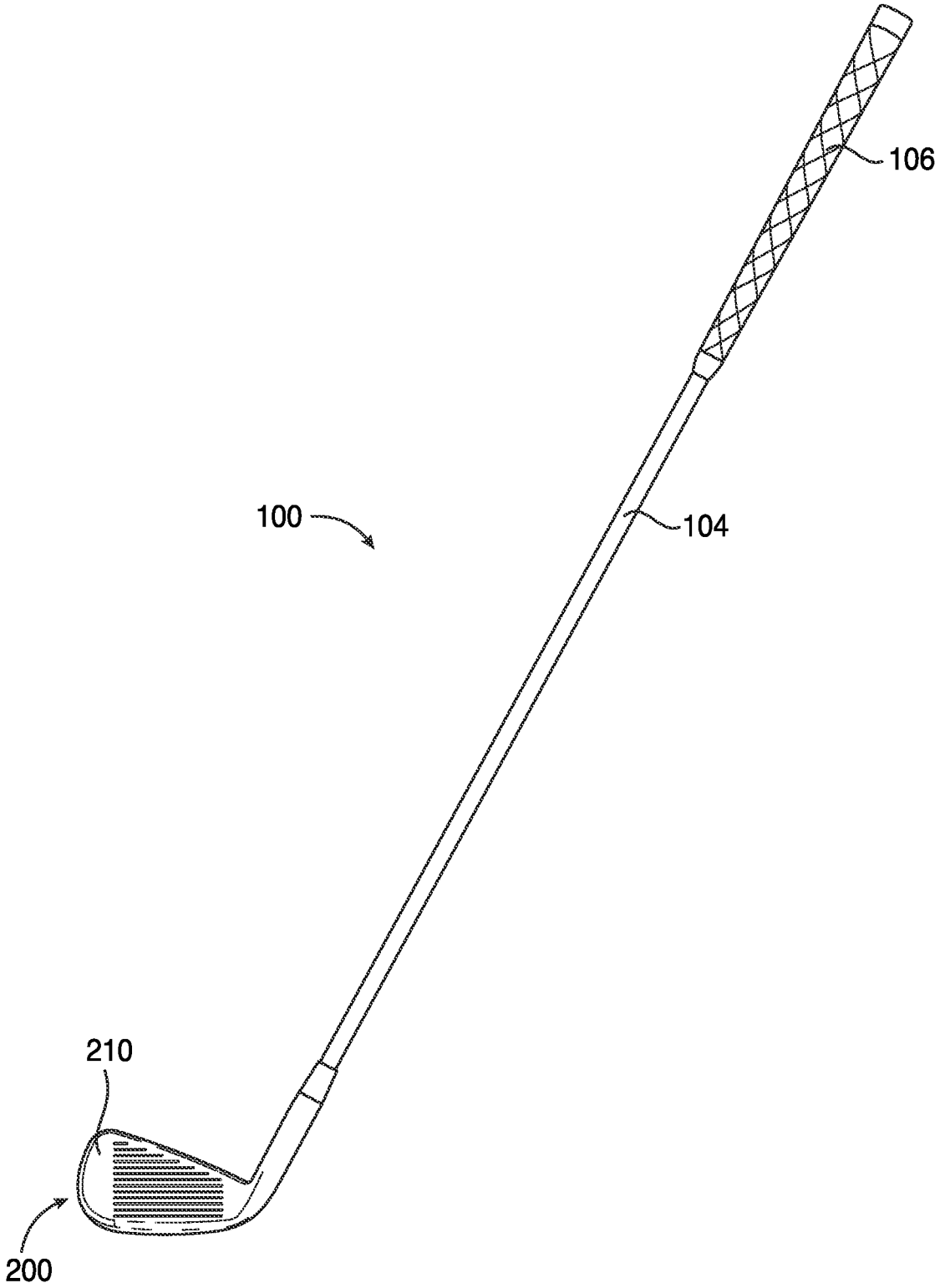
FIG. 1 depicts a golf club head having a golf club according to any embodiment of the apparatus, methods, and articles of manufacture described herein.
Figure 2:
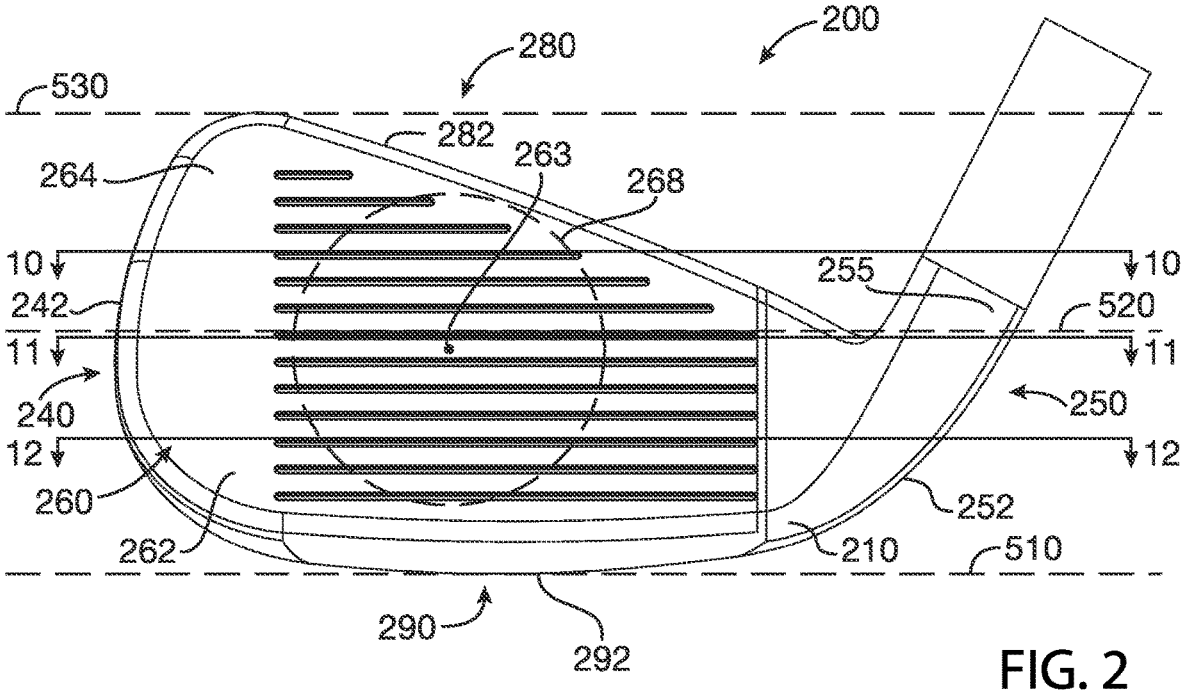
FIGS. 2, 3, 4, 5, 6, 7, 8, 9, 10, 11, and 12 depict a perspective front view, a perspective back view, a perspective cross-sectional view (along line 4-4 of FIG. 3), a perspective cross-sectional view (along line 5-5 of FIG. 3), a perspective cross-sectional view (along line 6-6 of FIG. 3), a perspective front view illustrated without a face portion, another perspective front view illustrated without a face portion, another perspective front view illustrated without a face portion, a perspective cross-sectional view (along line 10-10 of FIG. 2), a perspective cross-sectional view (along line 11-11 of FIG. 2), and a perspective cross-sectional view (along line 12-12 of FIG. 2), respectively, of a golf club head according to an embodiment of the apparatus, methods, and articles of manufacture described herein.
Figure 3:
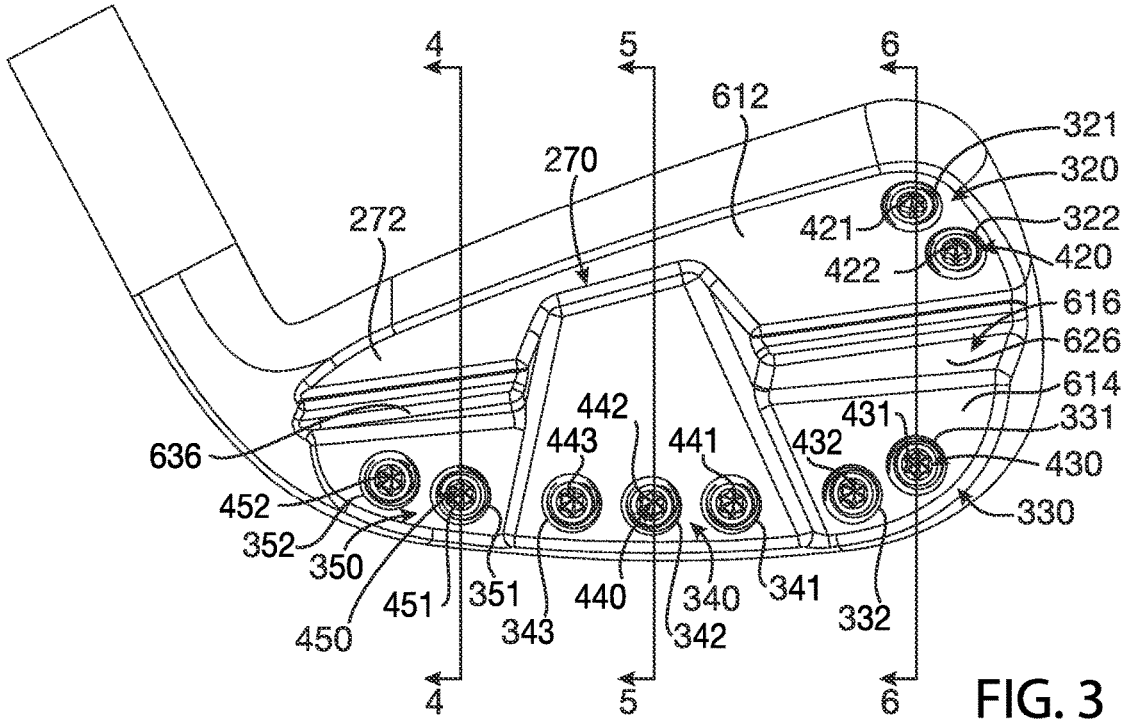
Figure 4:
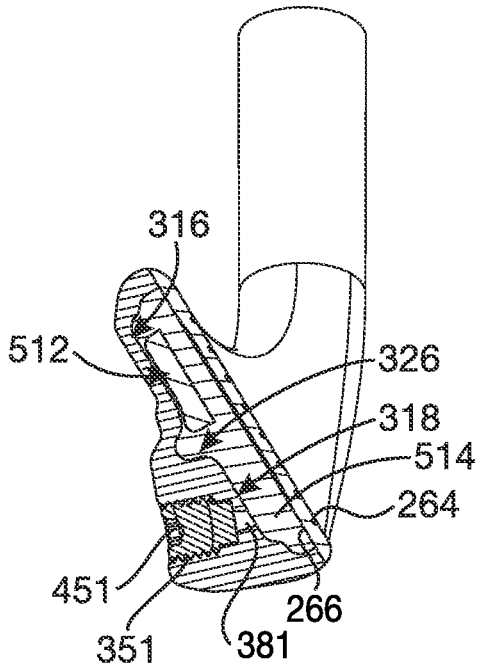
Figure 5:
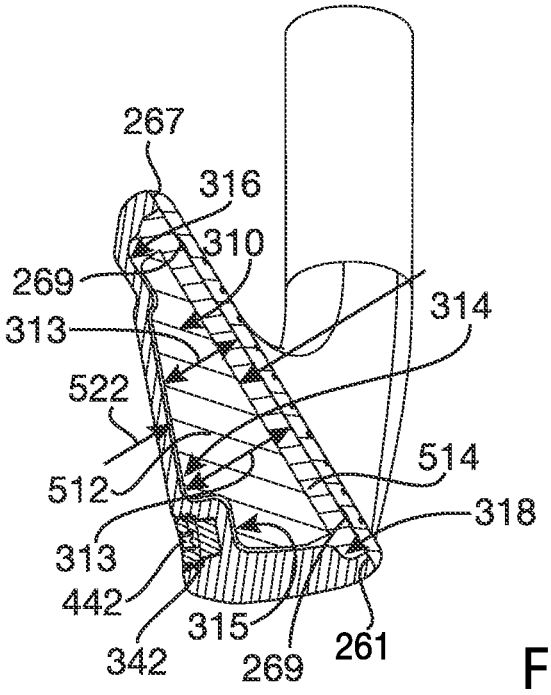
Figure 6:
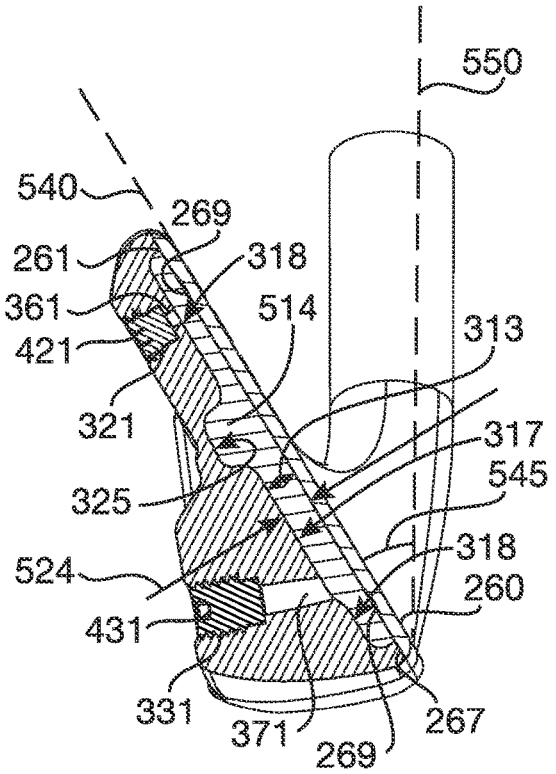
Figure 7:
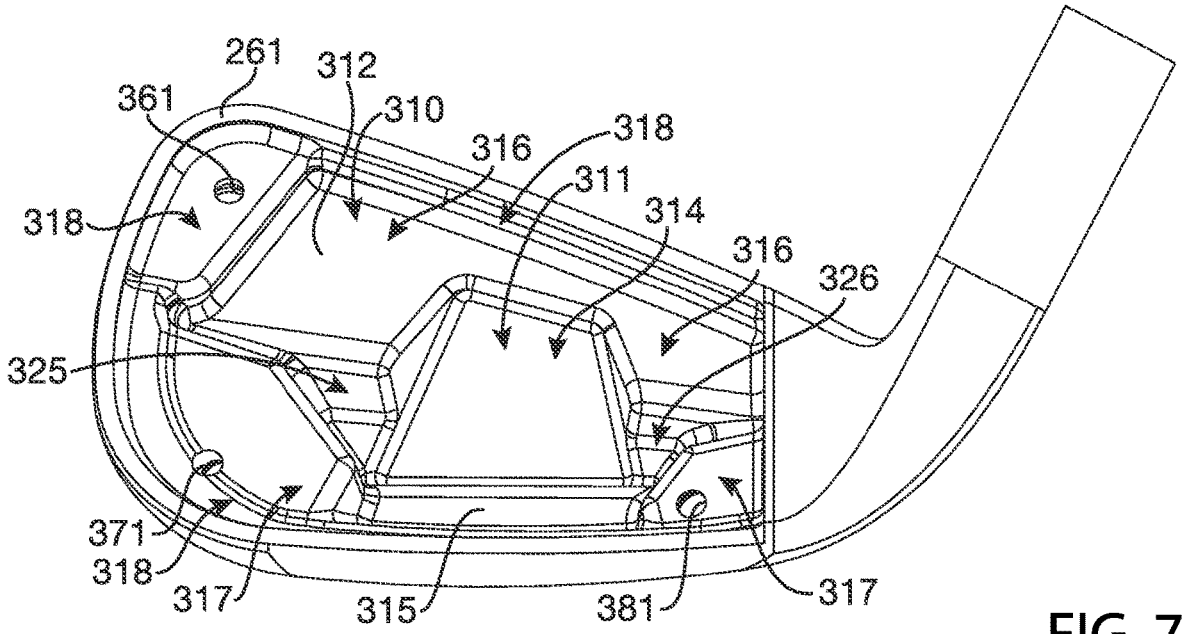
Figure 8:
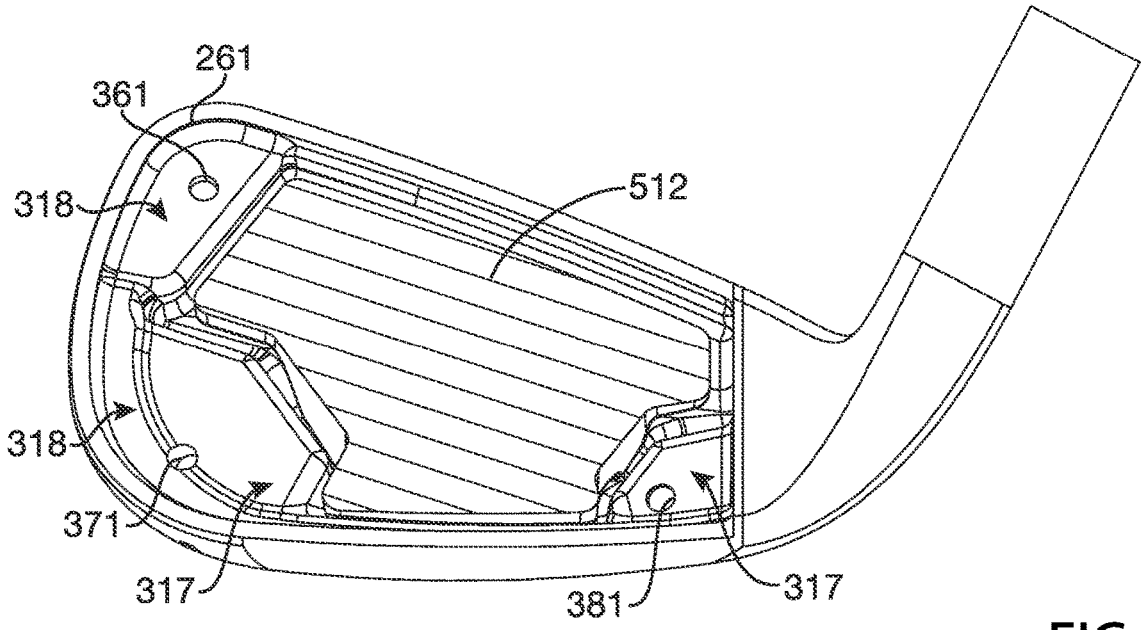
Figure 9:
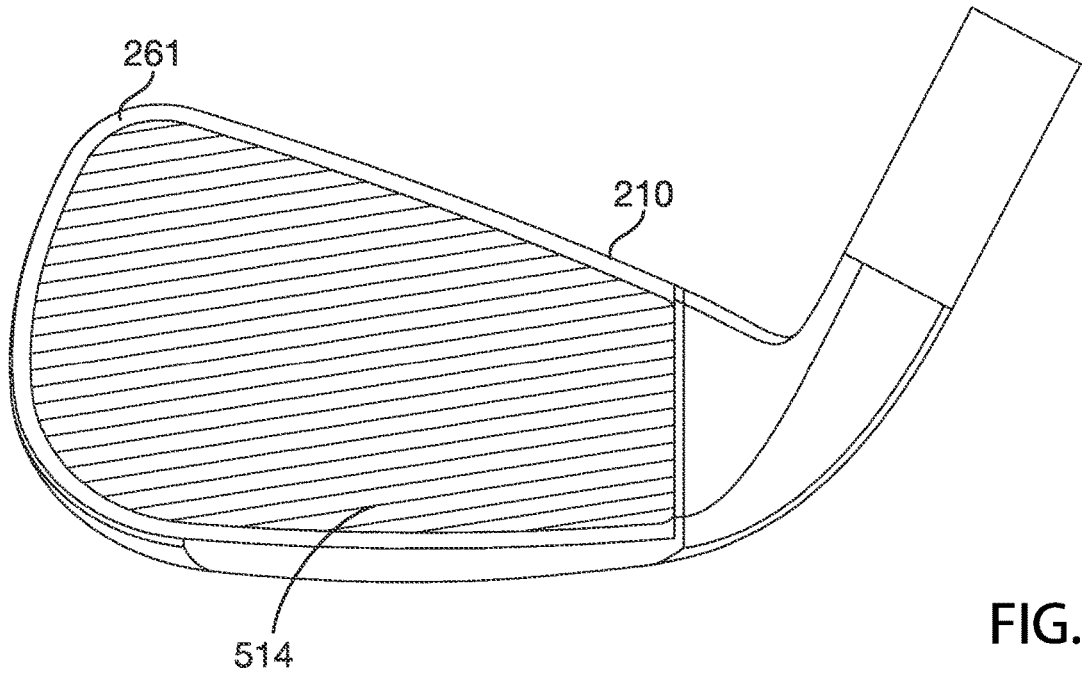
Figure 10:
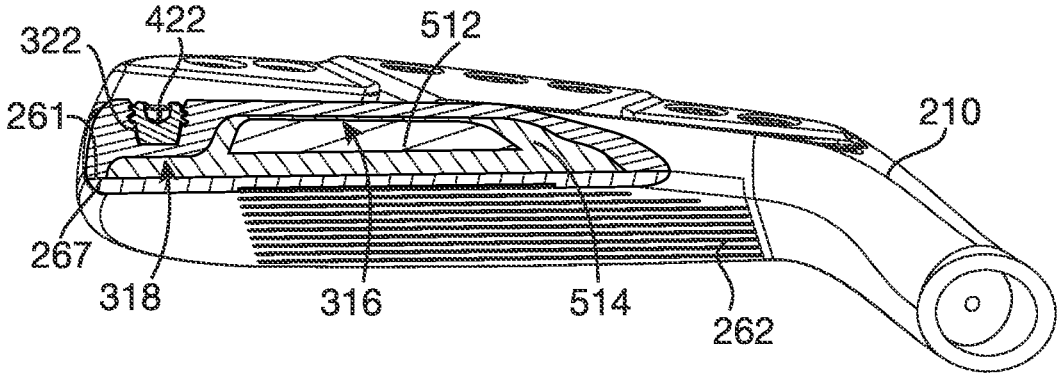
Figure 11:
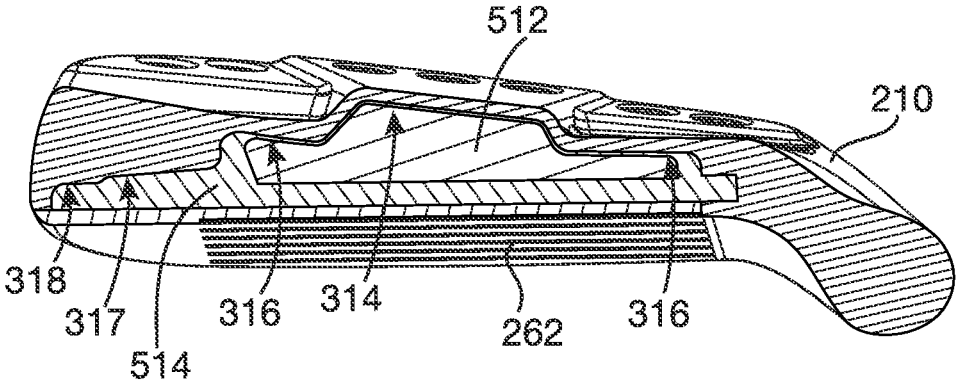
Figure 12:
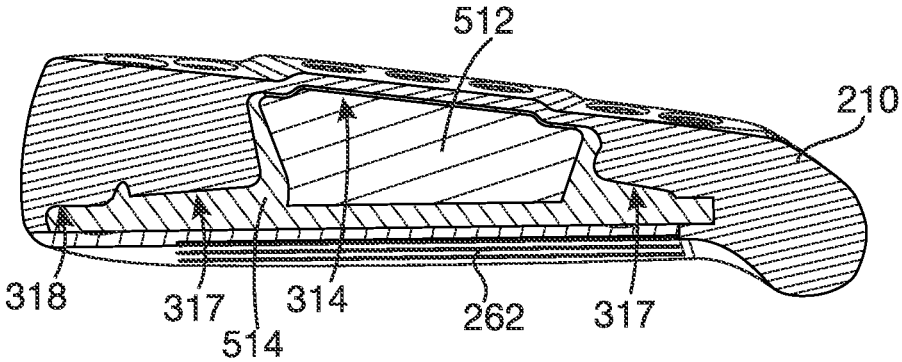

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. Patents and Patent Applications, which are collectively referred to herein as "the incorporated by reference publications," are incorporated by reference herein in their entirety: U.S. Pat. Nos. 8,961,336; 9,199,143; 9,421,437; 9,427,634; 9,468,821; 9,533,201; 9,610,481; 9,649,542; 9,675,853; 9,814,952; 9,878,220; 10,029,158; 10,029,159; 10,159,876; 10,232,235; 10,265,590; 10,279,233; 10,286,267; 10,293,229; 10,449,428; 10,478,684; 10,512,829; 10,596,424; 10,596,425; 10,632,349; 10,716,978; 10,729,948; 10,729,949; 10,814,193; 10,821,339; 10,821,340; 10,828,538; 10,864,414; 10,874,919; 10,874,921; 10,905,920; 10,933,286; 10,940,375; 11,058,932; 11,097,168; 11,117,030; 11,141,633; 11,154,755; and 11,173,359; and U.S. Patent Publication Nos. 20170282026; 20170282027; 20170368429; 20180050243; 20180050244; 20180133567; 20180140910; 20180140910; 20180169488; 20180169488; 20180221727; 20180236325; 20190232125; 20190232126; 20190240549; 20190247727; 20190247727; 20200171363; 20210023422; 20210086044; 20210197037; and 20210197037.

In the example of FIGS. 1-14, a golf club 100 may include a golf club head 200, a shaft 104, and a grip 106. The golf club head 200 may be attached to one end of the shaft 104 and the grip 106 may be attached to the opposite end of the shaft 104. An individual can hold the grip 106 and swing the golf club head 200 with the shaft 104 to strike a golf ball (not illustrated). The golf club head 200 may include a body portion 210 having a toe portion 240 with a toe portion edge 242, a heel portion 250 with a heel portion edge 252 that may include a hosel portion 255 configured to receive a shaft (an example shaft 104 is illustrated in FIG. 1) with a grip (an example grip 106 is illustrated in FIG. 1) on one end and the golf club head 200 on the opposite end of the shaft to form a golf club (an example golf club 100 is illustrated in FIG. 1), a front portion 260 with a perimeter edge portion 261, a back portion 270 with a back wall portion 272, a top portion 280 with a top portion edge 282, and a sole portion 290 with a sole portion edge 292. The toe portion edge 242, the heel portion edge 252, the top portion edge 282, and the sole portion edge 292 may define a periphery of the body portion 210. The toe portion 240, the heel portion 250, the front portion 260, the back portion 270, the top portion 280, and/or the sole portion 290 may partially overlap each other. For example, a portion of the toe portion 240 may overlap portion(s) of the front portion 260, the back portion 270, the top portion 280, and/or the sole portion 290. In a similar manner, a portion of the heel portion 250 may overlap portion(s) of the front portion 260, the back portion 270, the top portion 280, and/or the sole portion 290. In another example, a portion of the back portion 270 may overlap portion(s) of the toe portion 240, the heel portion 250, the top portion 280, and/or the sole portion 290. The apparatus, methods, and articles of manufacture described herein are not limited in this regard.

The golf club head 200 may include a face portion 262 (i.e., the strike face), which may be integrally formed with the body portion 210 (e.g., a single unitary piece). In one example, as illustrated in FIGS. 2-13, the face portion 262 may be a separate piece coupled (e.g., adhesively, mechanically, by welding, and/or by soldering) to the front portion 260. The face portion 262 may include a front surface 264 and a back surface 266. In one example (not illustrated), the front portion 260 may include one or a plurality of recessed shoulders configured to receive the face portion 262 for attachment of the face portion 262 to the body portion 210. In another example, as illustrated in FIGS. 2-13, the back surface 266 may include a perimeter portion 267 that may be attached to a perimeter edge portion 261 of the body portion 210. The perimeter portion 267 of the face portion 262 may be attached to the perimeter edge portion 261 of the body portion 210 by one or more fasteners, one or more adhesive or bonding agents, and/or welding or soldering. In one example, as illustrated in FIGS. 2-13, the perimeter portion 267 of the face portion 262 may be welded to the perimeter edge portion 261 of the body portion 210 at one or more locations. Alternatively, the entire perimeter portion 267 of the face portion 262 may be welded to the entire perimeter edge portion 261 of the body portion 210 (i.e., a continuous weld). The face portion 262 may include a ball strike region 268 to strike a golf ball. In one example, the center of the ball strike region 268 may be a geometric center 263 of the face portion 262. In another example, the geometric center 263 of the face portion 262 may be offset from a center of the ball strike region 268. In one example, the geometric center 263 and one or more regions near and/or surrounding the geometric center within the ball strike region 268 may provide a generally optimum location (i.e., optimum ball distance, ball speed, ball spin characteristics, etc.) on the face portion 262 for striking a golf ball. In yet another example, any location at or near the geometric center 263 and within the ball strike region 268 may provide a generally optimum location on the face portion 262 for striking a golf ball. However, a ball may be struck with any portion of the face portion 262 within the ball strike region 268 or outside the ball strike region 268 for any of the golf club heads described herein resulting in certain ball flight characteristics different from an on-center hit that may be preferred by an individual. The configuration of the face portion 262 and the attachment of the face portion 262 (e.g., welding) to the body portion 210 may be similar in many respects to any of the golf club heads described herein and/or described in any of the incorporated by reference publications. The apparatus, methods, and articles of manufacture described herein are not limited in this regard.

The golf club head 200 may be associated with a ground plane 510, a horizontal midplane 520, and a top plane 530. In particular, the ground plane 510 may be a plane that is parallel or substantially parallel to the ground and is tangent to the lowest portion of the sole portion edge 292 when the golf club head 200 is at an address position (e.g., the golf club head 200 aligned to strike a golf ball). A top plane 530 may be a plane that is tangent to the upper most portion of top portion edge 282 when the golf club head 200 is at the address position. The ground and top planes 510 and 530, respectively, may be parallel or substantially parallel to each other. The horizontal midplane 520 may be vertically halfway between the ground and top planes 510 and 530, respectively. Further, the golf club head 200 may be associated with a loft plane 540 defining a loft angle 545 (α) of the golf club head 200. The loft plane 540 may be a plane that is tangent to the face portion 262. The loft angle 545 may be defined by an angle between the loft plane 540 and a vertical plane 550 normal to the ground plane 510.

The body portion 210 may be a hollow body including an interior cavity 310 having inner walls 312. The interior cavity 310 may extend between the front portion 260, the back portion 270, the top portion 280, and the sole portion 290. In the example of FIGS. 2-13, the interior cavity 310 of the body portion 210 may be enclosed with and partially defined with the face portion 262. The configuration of the interior cavity 310 (e.g., height, width, volume, shape, etc.), the configuration of the interior cavity 310 relative to the body portion 210 (e.g., volume of the interior cavity 310 relative to the volume of body portion 210), the width and height variation of the interior cavity 310, and access to the interior cavity 310 from one or more ports on the body portion 210 may be similar to any of the golf club heads described herein and/or described in any of the incorporated by reference publications. The apparatus, methods, and articles of manufacture described herein are not limited in this regard.

The back wall portion 272 of the back portion 270 may include an upper back wall portion 612 and a lower back wall portion 614. The back wall portion 272 may include a ledge portion 616 that may extend between the toe portion edge 242 and the heel portion edge 252 in a continuous or discontinuous manner. The lower back wall portion 614 may be located farther back on the body portion 210 than the upper back wall portion 612, with the ledge portion 616 defining a transition portion between the upper back wall portion 612 and the lower back wall portion 614. Accordingly, the ledge portion 616 may extend transverse to the upper back wall portion 612 and the lower back wall portion 614. In one example, as illustrated in FIG. 2-13, the ledge portion 616 may include a first ledge portion 626 and a second ledge portion 636. The first ledge portion 626 may extend on the back wall portion from the toe portion edge 242 to a center portion of the back wall back wall portion 272. The second ledge portion 636 may extend from the center portion of the back wall portion 272 to the heel portion edge 252. As illustrated in FIGS. 2-13, the ledge portion 616 may provide for a relatively greater mass of the body portion 210 below the horizontal midplane 520, and the mass of the body portion 210 below the horizontal midplane 520 to be moved farther back on the body portion 210. The width of the ledge portion 616 may be greater than, equal to, or less than the width of the interior cavity at certain locations of the body portion 210. The configuration of the ledge portion 616 (e.g., width, segments, tapering, shape, etc.) and the properties of the ledge portion 616 relative to the width of the interior cavity may be similar to any ledge portion or similar structure of any of the golf club heads described herein and/or described in any of the incorporated by reference publications. The apparatus, methods, and articles of manufacture described herein are not limited in this regard.

The body portion 210 may include one or more ports, which may be exterior ports and/or interior ports (e.g., located inside the body portion 210). The inner walls 312 of the interior cavity 310 may include one or more ports (not illustrated). In one example, as illustrated in FIGS. 2-13, the back portion 270 may include one or more ports along or proximate to the periphery of the body portion 210. For example, the body portion 210 may include a first set of ports 320 (e.g., illustrated as ports 321 and 322) above the horizontal midplane 520, a second set of ports 330 (e.g., illustrated as ports 331 and 332) below the horizontal midplane 520, a third set of ports 340 (e.g., illustrated as ports 341, 342, and 343) below the horizontal midplane 520, and a fourth set of ports 350 (e.g., illustrated as ports 351 and 352) below the horizontal midplane 520. The locations, spacing relative to other ports, and any other configuration of each port of the first set of ports 320, the second set of ports 330, the third set of ports 340, and/or the fourth set of ports 350 may be similar in many respects to any of the ports described herein or described in any of the incorporated by reference publications. Further, any one or more of the ports of the first set of ports 320, the second set of ports 330, the third set of ports 340, and/or the fourth set of ports 350 may be connected to interior cavity 310 through which one or more filler materials may be injected into the interior cavity 310. In the example of FIGS. 2-13, the ports 321, 331, and 351 may be connected to the interior cavity 310 via openings 361, 371, and 381, respectively. The apparatus, methods, and articles of manufacture described herein are not limited in this regard.

The body portion 210 may include one or more mass portions (e.g., weight portion(s)), which may be integral mass portion(s) or separate mass portion(s) that may be coupled to the body portion 210. In the illustrated example as illustrated in FIGS. 2-13, the body portion 210 may include a first set of mass portions 420 (e.g., illustrated as mass portions 421 and 422), a second set of mass portions 430 (e.g., illustrated as mass portions 431 and 432), a third set of mass portions 440 (e.g., illustrated as mass portions 441, 442, and 443), and a fourth set of mass portions 450 (e.g., illustrated as mass portions 451 and 452). While the above example may describe a particular number or portions of mass portions, a set of mass portions may include a single mass portion, or a plurality of mass portions as described herein and in any of the incorporated by reference publications. For example, any one or a combination of adjacent sets of mass portions of the first set of mass portions 420 may be a single mass portion, the second set of mass portions 430 may be a single mass portion, the third set of mass portions 440 may be a single mass portion, and/or the fourth set of mass portions 450 may be a single mass portion. Further, the first set of mass portions 420, the second set of mass portions 430, the third set of mass portions 440, and/or the fourth set of mass portions 450 may be a portion of the physical structure of the body portion 210. The mass portions of the first set of mass portions 420, the second set of mass portions 430, the third set of mass portions 440, and/or the fourth set of mass portions 450 may be similar to any of the mass portions described in any of the incorporated by reference publications. The apparatus, methods, and articles of manufacture described herein are not limited in this regard.

The interior cavity 310 may be partially or entirely filled with one or more filler materials (i.e., a cavity filling material), which may include one or more similar or different types of materials. In one example, as illustrated in FIGS. 2-13, the interior cavity 310 may be filled with a first filler material 512 and a second filler material 514. In one example, the first filler material 512 may be a rubber or rubber compound, and the second filler material 514 may be an epoxy-type of material. In another example, the first filler material 512 and/or the second filler material 514 may be different polymer materials. The first filler material 512 and the second filler material 514 may be similar to any of the filler materials described herein or described in any of the incorporated by reference publications. The first filler material 512 and/or the second filler material 514 may be coupled to all or portions of the inner walls 312 of the interior cavity 310. In one example, the first filler material 512 and/or the second filler material 514 may have inherent adhesive or bonding properties to attach to all or portions of the inner walls 312. In another example, the first filler material 512 and/or the second filler material may be attached to all or portions of the inner walls 312 with one or more bonding agents or adhesives that may be mixed with the first filler material 512 and/or the second filler material 514, respectively. In another example, the first filler material 512 and/or the second filler material 514 may be attached to all or portions of the inner walls 312 with one or more bonding agents or adhesives that may be separate from the first filler material 512 and/or the second filler material 514, respectively. The amount (i.e., volume and/or mass) of the first filler material 512 and/or the second filler material 514 may be determined for each golf club head (i.e., having a certain loft angle) to (i) provide vibration dampening or sound dampening (e.g., consistent and/or pleasing sound and feel when the golf club head 200 strikes a golf ball as perceived by an individual using the golf club head 200), (ii) provide structural support for the face portion 262, and/or (iii) optimize ball travel distance, ball speed, ball launch angle, ball spin rate, ball peak height, ball landing angle and/or ball dispersion. Details regarding the filler materials 512 and 514, coupling of the filler materials 512 and 514 to the body portion 210 and each other, material compositions and/or physical properties of the filler materials 512 and 514, the mass and/or volume of each of the filler materials 512 and 514 in the interior cavity 310 may be provided in detail in any of the incorporated by reference publications, and in particular, in U.S. Pat. No. 10,632,349, which is incorporated by reference herein. The apparatus, methods, and articles of manufacture described herein are not limited in this regard.

In the example of FIGS. 2-13, a portion of the interior cavity 310 including a central portion 311 of the interior cavity 310, which may be a portion of the interior cavity 310 that may generally correspond to the ball strike region 268, may be include the first filler material 512 and the second filler material 514. The width 313 of the interior cavity 310 at the central portion 311 of the interior cavity 310 may be generally greater than the width 313 of the interior cavity 310 at other portions of the interior cavity 310. Accordingly, the region of the interior cavity 310 behind the ball strike region 268, i.e., the central portion 311, may include a relatively large volume of the first filler material 512 and/or the second filler material 514. Further, the configuration of the central portion 311 (i.e., size, shape, contour, volume, etc.) may depend on the loft angle 545. For example, a golf club head 200 with a relatively small loft angle may have a larger central portion 311 (i.e., larger volume, depth, height, etc.) than a golf club head 200 with a relatively large loft angle. Accordingly, as described herein, the amount of first filler material 512 and/or the second filler material 514 inside the interior cavity 310, and more specifically, in the central portion 311 may be determined based on the loft angle 545 to provide (i) provide vibration dampening or sound dampening (e.g., consistent and/or pleasing sound and feel when the golf club head 200 strikes a golf ball as perceived by an individual using the golf club head 200), (ii) provide structural support for the face portion 262, and/or (iii) optimize ball travel distance, ball speed, ball launch angle, ball spin rate, ball peak height, ball landing angle and/or ball dispersion. The apparatus, methods, and articles of manufacture described herein are not limited in this regard.

The contour of the interior cavity 310 or the shape of the inner walls 312 may be defined by a plurality of recessed portions that may be recessed relative to the perimeter edge portion 261. In the example of FIGS. 2-13, the interior cavity 310 may include a first recessed portion 314, a second recessed portion 315 that may have a generally smaller depth (i.e., defined by the interior cavity width 313 as viewed in cross section in FIGS. 5-40) relative to the first recessed portion 314, a third recessed portion 316 that may have a generally smaller depth than the second recessed portion 315, a fourth recessed portion 317 that may have a generally smaller depth than the third recessed portion 316, and a fifth recessed portion 318 that may have a generally smaller depth than the fourth recessed portion 317. The interior cavity 310 may have more or less recessed portions. The interior cavity 310 may include a first internal channel 325 that may extend from a location at the toe portion 240 to the central portion 311, and a second internal channel 326 that may extend from a location at the heel portion 250 to the central portion 311. The first recessed portion 314, the second recessed portion 315, the third recessed portion 316, the fourth recessed portion 317, the fifth recessed portion 318, the first internal channel 325, the second internal channel 326, and/or any transition regions therebetween may be described in detail in one or more of the incorporated by reference publications, and in particular, in U.S. Pat. No. 10,632,349, which is incorporated by reference herein. The apparatus, methods, and articles of manufacture described herein are not limited in this regard.

In one example, as illustrated in FIGS. 2-13, the first recessed portion 314, the second recessed portion 315, the third recessed portion 316, and the internal channels 325 and 326 may be filled with the first filler material 512, whereas the remaining portions of the interior cavity 310 may be filled with the second filler material 514. In another example, the first recessed portion 314, the second recessed portion 315, and the internal channels 325 and 326 may be filled with the first filler material 512, whereas the remaining portions of the interior cavity 310 may be filled with the second filler material 514. In another example, the first recessed portion 314, the second recessed portion 315, the internal channels 325 and 326, the third recessed portion 316 and the fifth recessed portion 318 may be filled with the first filler material 512, whereas the remaining portions of the interior cavity 310 may be filled with the second filler material 514. In yet another example, the entire interior cavity 310 may be filled with the first filler material 512 or the first filler material. The apparatus, methods, and articles of manufacture described herein are not limited in this regard.

A width 522 ($W_{F1}$) of the first filler material 512 and the width 524 ($W_{F2}$) of the second filler material 514 may vary from the toe portion 240 to the heel portion 250 and/or from the top portion 280 to the sole portion 290 and/or according to the shapes of the first recessed portion 314, the second recessed portion 315, the third recessed portion 316, the fourth recessed portion 317, and/or the fifth recessed portion 318 depending on the location inside the interior cavity 310. The width 522 of the first filler material 512 and the width 524 of the second filler material 514 as related to the physical properties, ball strike and trajectory characteristics, and configuration of the golf club head 200 (e.g., loft angle) may be provided in detail in any of the incorporated by reference publications, and in particular, in U.S. Pat. No.

10,632,349, which is incorporated by reference herein. The apparatus, methods, and articles of manufacture described herein are not limited in this regard.

Figure 13:
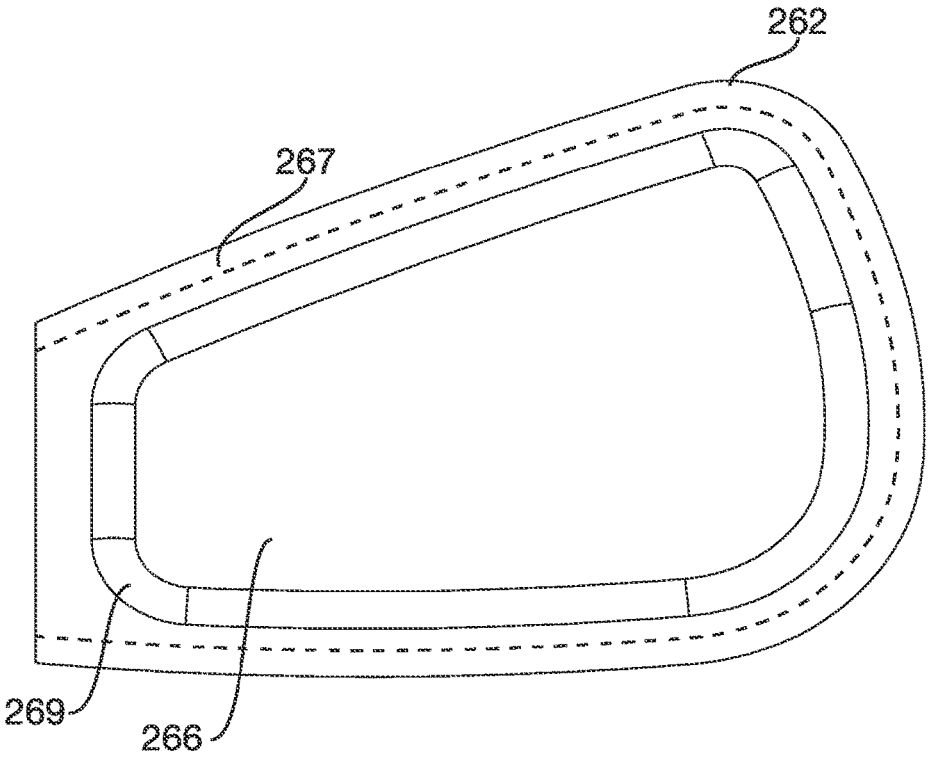
FIG. 13 depicts a back view of a face portion of a golf club head according to any embodiment of the apparatus, methods, and articles of manufacture described herein.

In one example, as illustrated in FIG. 13, the back surface 266 of the face portion 262 may include one or more grooves proximate to the perimeter portion 267 of the face portion 262. In one example, as illustrated in FIG. 13, a groove 269 may be a continuous groove (i.e., defining a loop) extending in a path similar to the path of the perimeter portion 267 proximate to the perimeter portion 267. The groove 269 may include a relatively thinner portion of the face portion 262. Accordingly, the groove 269 may increase the flexibility of the face portion 262 so that when a golf ball strikes the face portion 262, the face portion 262 provides a greater rebound (i.e., a greater trampoline effect), and hence may provide a greater velocity for the golf ball. All or portions of the groove 269 may be filled with the first filler material 512 and/or second filler material 514. In the example of the golf club head 200, all of the groove 269 may be filled with the second filler material 514. Accordingly, the second filler material 514 may structurally support the relatively thinner portions of the face portion 262 defined by the groove 269. In another example, a plurality of separate grooves (not illustrated) may be provided on the back surface 266 of the face portion 262 at certain locations proximate to the perimeter portion 267 to provide a certain rebound effect for the face portion 262. In yet another example, a continuous groove similar to the groove 269 and/or a plurality of separate grooves (not illustrated) may be provided at certain locations between the perimeter portion 267 and the geometric center 263 on the back surface 266 of the face portion 262 to provide a certain rebound effect for the face portion 262. The face portion of any of the golf club heads described herein may include the groove 269. The apparatus, methods, and articles of manufacture described herein are not limited in this regard.

As described herein, the face portion 262 may be relatively thin to provide increased bending and deflection of the face portion 262 during a golf ball strike. Further, the face portion 262 may include one or more grooves such as the groove 269 on the back surface 266 of the face portion 262 as described herein to further increase the flexibility of the face portion 262. The second filler material 514 may be a polymer material with a relatively high strength and stiffness to provide structural support and stability for the face portion 262 to prevent failure of the face portion 262 during a golf ball strike or repeated golf ball strikes (i.e., face portion fatigue). As described herein, the second filler material 514 may be an epoxy-type of material. The second filler material 514 may also have a relatively high COR as described herein to provide a rebound effect for the face portion 262 after a golf ball strike. As further described herein, the first filler material 512 may be a rubber-type of compound with a lower strength and stiffness (i.e., softer or less rigid) than the second filler material 514 and a higher COR than the second filler material 514. Accordingly, the first filler material 512 may provide additional structural support for the face portion 262. Further, the relatively higher COR of the first filler material 512 may allow the first filler material 512 to store the energy from a golf ball strike and to release a substantial amount of the energy back to the golf ball (i.e., without losing much impact energy) by providing a relatively large rebound effect for the face portion 262. Additionally, the different material properties of the first filler material 512 and the second filler material 514 as described herein may provide sound and vibration dampening at different frequency ranges to provide a pleasant sound and feel for an individual. The apparatus, methods, and articles of manufacture described herein are not limited in this regard.

Figure 14:
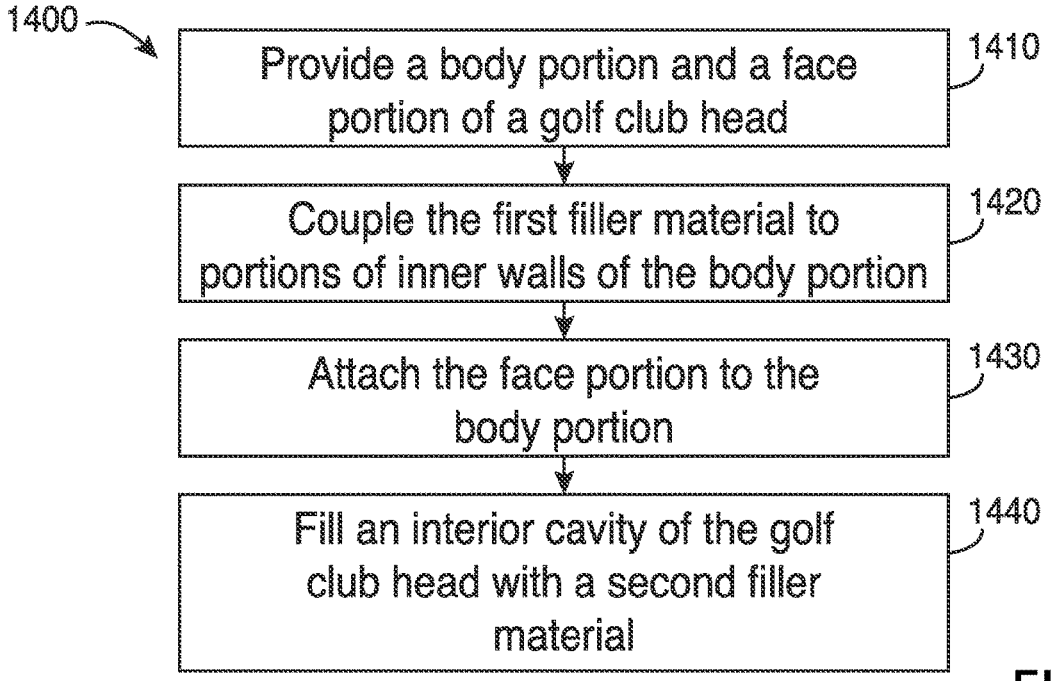
FIG. 14 depicts a manner in which an example golf club head described herein may be manufactured.

FIG. 14 depicts one manner by which the golf club head 200 or any of the golf club heads described herein may be manufactured. In the example of FIG. 14, the process 1400 may begin with providing a body portion 210 and a face portion 262 of a golf club head 200 (block 1410). The first filler material 512 may be coupled to the interior cavity 310 (block 1420). In one example, the first filler material 512 may be formed in one or more recessed portions as described herein (i.e., any of the recessed portions described herein) of the interior cavity 310 by injection molding. The first filler material 512 may then cure at ambient temperature or by one or more heating/cooling cycles depending on the material used for the first filler material 512. In another example, the first filler material 512 may be molded into the shape of one or more recessed portions as described herein and then coupled to the one or more recessed portions with a bonding agent as described herein. The face portion 262 may then be attached to the body portion 210 as described herein to enclose the interior cavity 310 (block 1430). The second filler material 514 may then be injected into the interior cavity 310 through one or more of the ports of the first set of ports 320, the second set of ports 330, the third set of ports 340, and/or the fourth set of ports 350 that may be connected to the interior cavity 310 as described herein (block 1440). The second filler material 514 may then cure at ambient temperature or by one or more heating/cooling cycles depending on the material used for the second filler material 514. The apparatus, methods, and articles of manufacture described herein are not limited in this regard.

Figure 15:
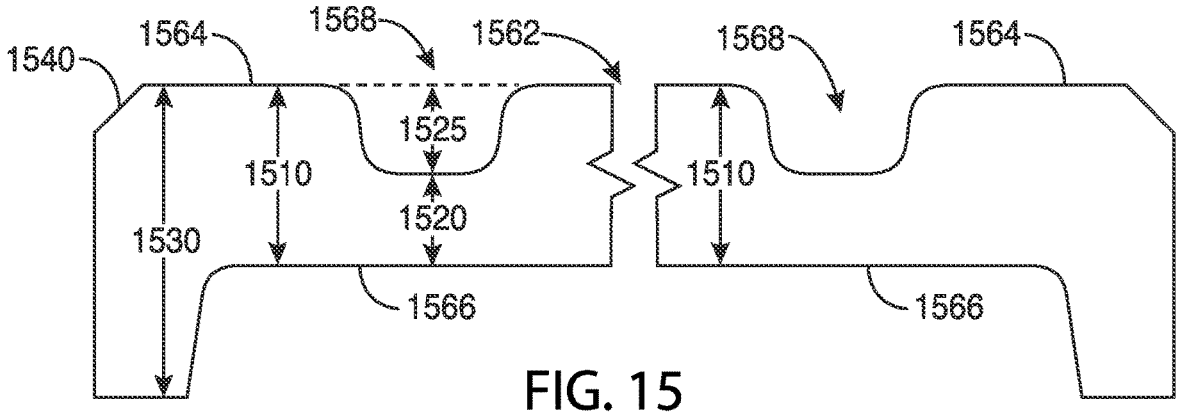
FIGS. 15 and 16 depict schematic cross-sectional views of two example face portions of a golf club head according to embodiments of the apparatus, methods, and articles of manufacture described herein.

In one example, as illustrated in FIG. 15, a face portion 1562, which may be any of the face portions described herein, may have a first thickness 1510 (T1) or a second thickness 1520 (T2). The first thickness 1510 may be a thickness of a section of the face portion 1562 adjacent to a groove 1568 whereas the second thickness 1520 may be a thickness of a section of the face portion 1562 below the groove 1568. For example, the first thickness 1510 may be a maximum distance between the front surface 1564 and the back surface 1566. The second thickness 1520 may be based on the groove 1568. In particular, the groove 1568 may have a groove depth 1525 (Dgroove). The second thickness 1520 may be a maximum distance between the bottom of the groove 1568 and the back surface 1566. The sum of the second thickness 1520 and the groove depth 1525 may be substantially equal to the first thickness 1510 (e.g., T2+Dgroove=T1). Accordingly, the second thickness 1520 may be less than the first thickness 1510 (e.g., T2<T1).

To lower and/or move the CG of a golf club head further back, such as the CG of any of the golf club heads described herein, mass from the front portion of a golf club head may be removed by using a relatively thinner face portion 1562. For example, the first thickness 1510 or the second thickness 1520 may be less than or equal to 0.1 inch (2.54 millimeters). In another example, the first thickness 1510 or the second thickness 1520 may be about 0.075 inch (1.875 millimeters) (e.g., T1=0.075 inch). With the support of the back wall portion of a golf club head to form an interior cavity and filling at least a portion of the interior cavity with one or more filler materials as described herein, the face portion 1562 may be relatively thinner (e.g., T1<0.075 inch) without degrading the structural integrity, sound, and/or feel of a golf club head. In one example, the first thickness 1510 may be less than or equal to 0.060 inch (1.524 millimeters) (e.g., T1<0.060 inch). In another example, the first thickness 1510 may be less than or equal to 0.040 inch (1.016 millimeters) (e.g., T1<0.040 inch). Based on the type of material(s) used to form the face portion 1562 and/or the body portion 210, the face portion 1562 may be even thinner with the first thickness 1510 being less than or equal to 0.030 inch (0.762 millimeters) (e.g., T1≤0.030 inch). The groove depth 1525 may be greater than or equal to the second thickness 1520 (e.g., Dgroove≥T2). In one example, the groove depth 1525 may be about 0.020 inch (0.508 millimeters) (e.g., Dgroov=0.020 inch). Accordingly, the second thickness 1520 may be about 0.010 inch (0.254 millimeters) (e.g., T2=0.010 inch). In another example, the groove depth 1525 may be about 0.015 inch (0.381 millimeters), and the second thickness 1520 may be about 0.015 inch (e.g., Dgroove=T2=0.015 inch). Alternatively, the groove depth 1525 may be less than the second thickness 1520 (e.g., Dgroove<T2). Without the support of the back wall portion of a golf club head and one or more filler materials used to fill in the interior cavity, the golf club head may not be able to withstand multiple impacts by a golf ball on a face portion. In contrast, a golf club head with a relatively thin face portion but without the support of the back wall portion and the one or more filler materials as described herein (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form a golf club head such as any of the golf club heads described herein, the face portion 1562 may include additional material at or proximate to a periphery of the face portion 1562. Accordingly, the face portion 1562 may also include a third thickness 1530, and a chamfer portion 1540. The third thickness 1530 may be greater than either the first thickness 1510 or the second thickness 1520 (e.g., T3>T1>T2). In particular, the face portion 1562 may be coupled to the body portion of a golf club head by a welding process. For example, the first thickness 1510 may be about 0.030 inch (0.762 millimeters), the second thickness 1520 may be about 0.015 inch (0.381 millimeters), and the third thickness 1530 may be about 0.050 inch (1.27 millimeters). Accordingly, the chamfer portion 1540 may accommodate some of the additional material when the face portion 1562 is welded to the body portion of the golf club head.

Figure 16:
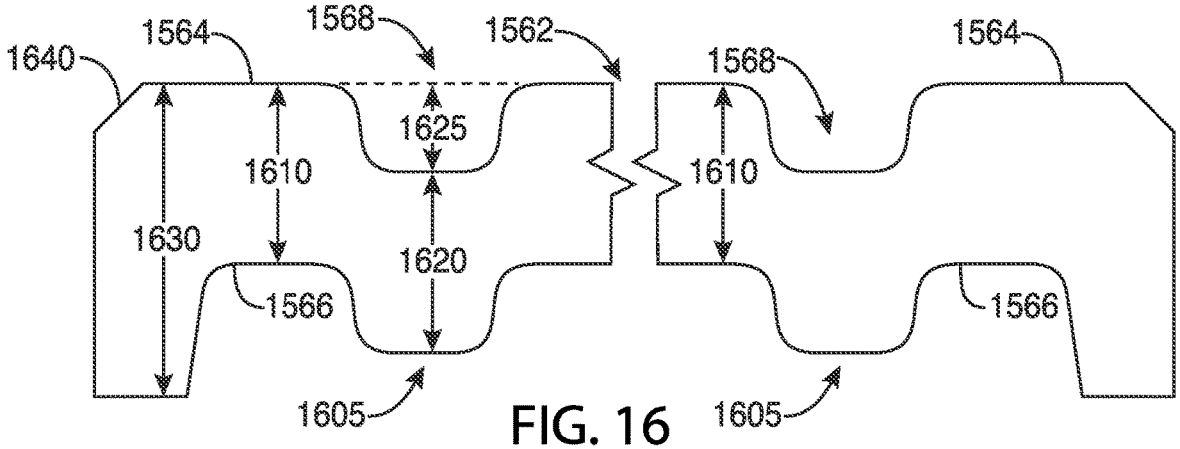

As illustrated in FIG. 16, for example, the face portion 1562 may include a reinforcement section, which is generally illustrated as reinforcement section 1605, below one or more grooves 1568. In one example, the face portion 1562 may include a reinforcement section 1605 below each groove. Alternatively, face portion 1562 may include the reinforcement section 1605 below some grooves (e.g., every other groove) or below only one groove. The face portion 1562 may include a first thickness 1610, a second thickness 1620, a third thickness 1630, and a chamfer portion 1640. The groove 1568 may have a groove depth 1625. The reinforcement section 1605 may define the second thickness 1620. The first and second thicknesses 1610 and 1620, respectively, may be substantially equal to each other (e.g., T1=T2). In one example, the first and second thicknesses 1610 and 1620, respectively, may be about 0.030 inch (0.762 millimeters) (e.g., T1=T2=0.030 inch). The groove depth 1625 may be about 0.015 inch (0.381 millimeters), and the third thickness 1630 may be about 0.050 inch (1.27 millimeters). The groove 1568 may also have a groove width. The width of the reinforcement section 1605 may be greater than or equal to the groove width. The apparatus, methods, and articles of manufacture described herein are not limited in this regard.

Alternatively, the face portion 1562 may vary in thickness at and/or between the top portion and the sole portion of a golf club head. In one example, the face portion 1562 may be relatively thicker at or proximate to the top portion than at or proximate to the sole portion (e.g., thickness of the face portion 1562 may taper from the top portion towards the sole portion). In another example, the face portion 1562 may be relatively thicker at or proximate to the sole portion than at or proximate to the top portion (e.g., thickness of the face portion 1562 may taper from the sole portion towards the top portion). In yet another example, the face portion 1562 may be relatively thicker between the top portion and the sole portion than at or proximate to the top portion and the sole portion (e.g., thickness of the face portion 1562 may have a bell-shaped contour). The face portion 1562 may be similar to any of the face portions described in any of the incorporated by reference publications. The apparatus, methods, and articles of manufacture described herein are not limited in this regard.

Figure 17:
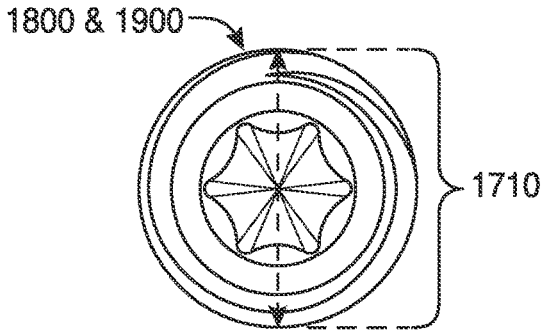
FIG. 17 depicts a top view of a mass portion of a golf club head according to an embodiment of the apparatus, methods, and articles of manufacture described herein.

One or more mass portions of any of the sets of mass portions described herein may have similar or different physical properties (e.g., color, marking, shape, size, density, mass, volume, external surface texture, materials of construction, etc.). In the illustrated example as illustrated in FIG. 17, one or more mass portions of any of the sets of mass portions described herein may have a cylindrical shape (e.g., a circular cross section). Alternatively, one or more mass portions of any of the sets of mass portions described herein may have similar or different shapes relative to one or more other mass portions of the set of mass portions. In another example, one or more mass portions of any of the sets of mass portions described herein may have a different color(s), marking(s), shape(s), density or densities, mass(es), volume(s), material(s) of construction, external surface texture(s), and/or any other physical property as compared to one or more mass portions of another one of the sets of mass portions as described herein. The properties of any of the mass portions and sets of mass portions described herein may be similar to any of the mass portions and sets of mass portions described in any of the incorporated by reference publications. The apparatus, methods, and articles of manufacture described herein are not limited in this regard.

Figure 18:
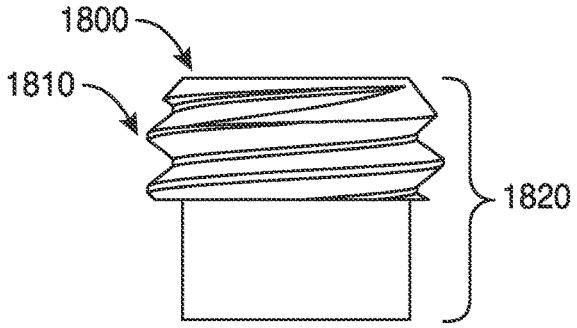
FIGS. 18 and 19 depict side views of two example mass portions of a golf club head according to embodiments of the apparatus, methods, and articles of manufacture described herein.
Figure 19:
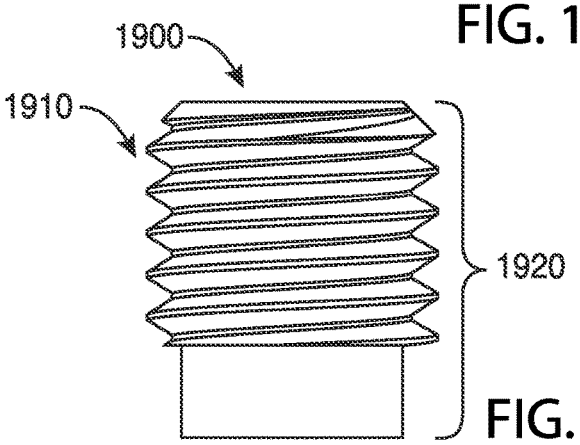
Figure 20:
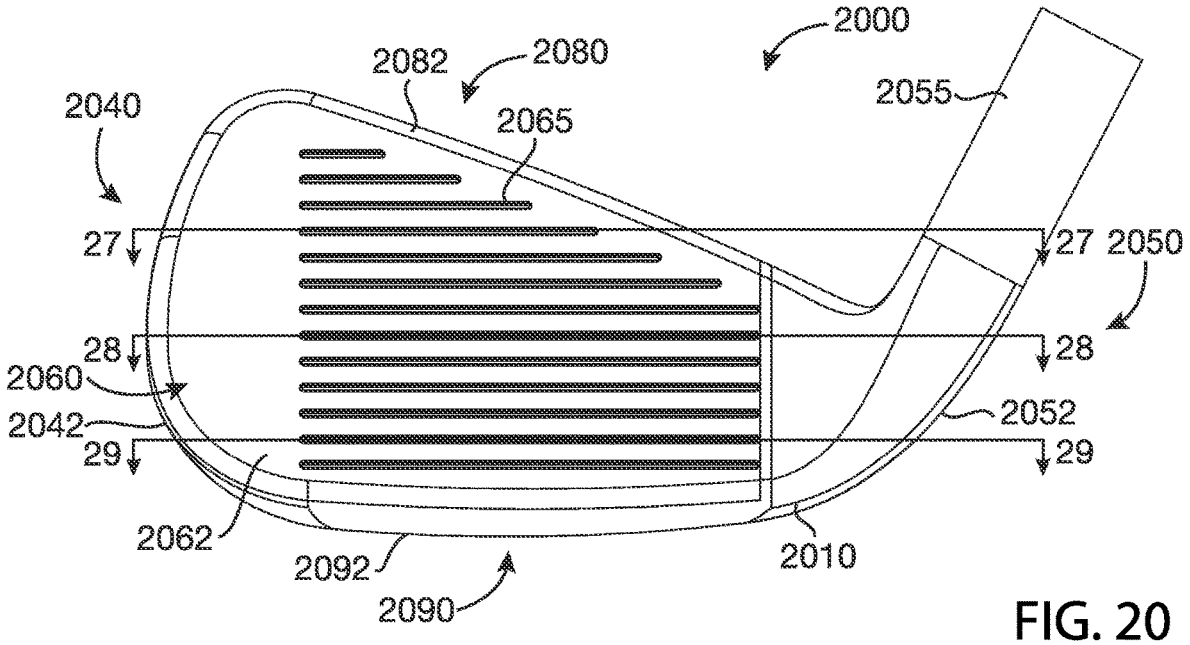
FIGS. 20, 21, 22, 23, 24, 25, 26, 27, 28, 29, 30, 31, 32, and 33 depict a front view, a back view, a heel side view, a toe side view, a cross-sectional view taken at line 24-24 of FIG. 21, a cross-sectional view taken at line 25-25 of FIG. 21, a cross-sectional view taken at line 26-26 of FIG. 21, a cross-sectional view taken at line 27-27 of FIG. 20, a cross-sectional view taken at line 28-28 of FIG. 20, a cross-sectional view taken at line 29-29 of FIG. 20, a front view without a face portion, a view of an inner side of a back cover portion, a back view without the back cover portion, and a view of an outer side of the back cover portion, respectively, of a golf club head according to any embodiment of the apparatus, methods, and articles of manufacture described herein.

Referring to FIGS. 18 and 19, for example, a first mass portion 1800 and a second mass portion 1900 may include threads, generally illustrated as threads 1810 and threads 1910, respectively, to engage with correspondingly configured threads in ports on the to secure in the ports as described herein. Accordingly, one or more mass portions as described herein may be shaped similar to and function as a screw or threaded fastener for engaging threads in a port. For example, one or more mass portions of any of the sets of mass portions described herein may be a screw. One or more mass portions of any of the mass portions described herein may not be readily removable from the body portion of a golf club head with or without a tool. Alternatively, one or more mass portions of any of the sets of mass portions described herein may be readily removable (e.g., with a tool) so that a relatively heavier or lighter mass portion may replace one or more mass portions of any of the sets of mass portions described herein. In another example, one or more mass portions of any of the sets of mass portions described herein may be secured in the ports with epoxy or adhesive so that the mass portions may not be readily removable. In yet another example, one or more mass portions of any of the sets of mass portions described herein may be secured in the ports with both threads and thread sealant (e.g., acrylic adhesive, cyanoacrylate adhesive, epoxy, thermoplastic adhesive, silicone sealant, or urethane adhesive) so that the mass portions may not be readily removable. In yet another example, one or more mass portions of any of the sets of mass portions described herein may be press fit in a port. In yet another example, one or more mass portions of any of the sets of mass portions described herein may be formed inside a port by injection molding. For example, a liquid metallic material (i.e., molten metal) or a plastic material (e.g., rubber, foam, or any polymer material) may be injected or otherwise introduced into a port. After the liquid material is cooled and/or cured inside the port, the resulting solid material (e.g., a metal material, a plastic material, or a combination thereof) may form a mass portion. The apparatus, methods, and articles of manufacture described herein are not limited in this regard.

As mentioned above, one or more mass portions of any of the sets of mass portions described herein may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. In yet another example, as illustrated in FIGS. 17-19, one or more mass portions of any of the sets of mass portions described herein may have a diameter 1710 of about 0.25 inch (6.35 millimeters) but one or more mass portions of another one or more sets of mass portions described herein may be different in height. In particular, one or more mass portions of any of the sets of mass portions described herein may be associated with a first height 1820, and one or more mass portions of another one or more sets of mass portions described herein may be associated with a second height 1920. The first height 1820 may be relatively shorter than the second height 1920. In one example, the first height 1820 may be about 0.125 inch (3.175 millimeters) whereas the second height 1920 may be about 0.3 inch (7.62 millimeters). In another example, the first height 1820 may be about 0.16 inch (4.064 millimeters) whereas the second height 1920 may be about 0.4 inch (10.16 millimeters). Alternatively, the first height 1820 may be equal to or greater than the second height 1920. Although the above examples may describe particular dimensions, one or more mass portions described herein may have different dimensions. In one example, any of the mass portions described herein may be interchangeably used in any of the ports described herein. Any property of any of the mass portions described herein may be similar to the corresponding property of any of the mass portions described in any of the incorporated by reference publications. The apparatus, methods, and articles of manufacture described herein are not limited in this regard.

In the example of FIGS. 20-33, a golf club head 2000 may include a body portion 2010 having a toe portion 2040 with a toe portion edge 2042, a heel portion 2050 with a heel portion edge 2052 that may include a hosel portion 2055 configured to receive a shaft (an example shaft 104 is illustrated in FIG. 1) with a grip (an example grip 106 is illustrated in FIG. 1) on one end and the golf club head 2000 on the opposite end of the shaft to form a golf club (an example golf club 100 is illustrated in FIG. 1), a front portion 2060, a back portion 2070 with a back wall portion 2072, a top portion 2080 with a top portion edge 2082, and a sole portion 2090 with a sole portion edge 2092. The toe portion 2040, the heel portion 2050, the front portion 2060, the back portion 2070, the top portion 2080, and/or the sole portion 2090 may partially overlap each other. The toe portion edge 2042, the heel portion edge 2052, the top portion edge 2082, and the sole portion edge 2092 may define a periphery of the body portion 2010. The golf club head 2000 may be any type of golf club head described herein, such as, for example, an iron-type golf club head or a wedge-type golf club head. The physical properties of the golf club head 2000 and/or any components of the golf club head 2000 (e.g., volume, materials of construction, and mass portions) may be similar in many respects to any of the golf club heads described herein and/or described in any of the incorporated by reference publications. The apparatus, methods, and articles of manufacture described herein are not limited in this regard.

The golf club head 2000 may include a face portion 2062 (i.e., the strike face), which may be integrally formed with the body portion 2010 (e.g., a single unitary piece). In one example, as illustrated in FIGS. 20-33, the front portion 2060 may include a front opening 2063. The face portion 2062 may be a separate piece coupled (e.g., adhesively, mechanically, by welding, and/or by soldering) to the front portion 2060 to close the front opening 2063. The face portion 2062 may include a front surface 2064 with a plurality of grooves 2065 and a back surface 2066. The configuration of the face portion 2062 and the attachment of the face portion 2062 (e.g., welding) to the body portion 2010 may be similar in many respects to the configuration of the face portion 262 and the attachment of the face portion 262 to the body portion 210, respectively, of the golf club head 200, or the face portion and body portion configurations of any of the golf club heads described herein in or described in any of the incorporated by reference publications. The apparatus, methods, and articles of manufacture described herein are not limited in this regard.

The golf club head 2000 may be associated with a ground plane 2110, a horizontal midplane 2120, and a top plane 2130. In particular, the ground plane 2110 may be a plane that is parallel or substantially parallel to the ground and is tangent to the lowest portion of the sole portion edge 2092 when the golf club head 2000 is at an address position (e.g., the golf club head 2000 aligned to strike a golf ball). A top plane 2130 may be a plane that is tangent to the upper most portion of top portion edge 2082 when the golf club head 2000 is at the address position. The ground plane 2110 and the top plane 2130, respectively, may be parallel or substantially parallel to each other. The horizontal midplane 2120 may be vertically halfway between the ground plane 2110 and the top plane 2130, respectively. Further, the golf club head 2000 may be associated with a loft plane 2140 defining a loft angle 2145 ($\alpha$) of the golf club head 2000. The loft plane 2140 may be a plane that is tangent to the face portion 2062. The loft angle 2145 may be defined by an angle between the loft plane 2140 and a vertical plane 2150 normal to the ground plane 2110. The apparatus, methods, and articles of manufacture described herein are not limited in this regard.

The body portion 2010 may be a hollow body portion with the front opening 2063 and a back opening 2073 in the back wall portion 2072. Accordingly, the body portion 2010 may include an interior cavity 2020 having the front opening 2063 and the back opening 2073. As described herein, the face portion 2062 may be attached to the front portion 2060 to close the front opening 2063. The body portion 2010 may include a back cover portion 2272 that may be attached or coupled to the back wall portion 2072 to cover and close the back opening 2073, which along with the face portion 2062 closing the front opening 2063 enclose the interior cavity 2020. Alternatively, the body portion 2010 and the face portion 2062 may be manufactured together and be a single-piece integral part. Accordingly, the back cover portion 2272 may be attached to the back wall portion 2072 to enclose the interior cavity 2020. The interior cavity 2020 may extend between the face portion 2062, the back wall portion 2072 and the back cover portion 2272, the top portion 2080, and the sole portion 2090. The configuration of the interior cavity 2020 (e.g., height, width, volume, shape, etc.), the configuration of the interior cavity 2020 relative to the body portion 2010 (e.g., volume of the interior cavity 2020 relative to the volume of body portion 2010), the width and height variation of the interior cavity 2020, and access to the interior cavity 2020 from one or more ports on the body portion 2010 may be similar to any of the golf club heads described herein and/or described in any of the incorporated by reference publications. The apparatus, methods, and articles of manufacture described herein are not limited in this regard.

The back wall portion 2072 may include rim portions 2074 at the back opening 2073 that may surround all or portions of the back opening 2073. In one example, the rim portions 2074 may surround all of the back opening 2073. In another example, the rim portions 2074 may include one or more separate segments located around the back opening 2073. In another example, as illustrated in FIGS. 20-33, the rim portions 2074 may include one or more cutout portions, which are illustrated for example as a toe-side cutout portion 2620, a center cutout portion 2630, and a heel-side cutout portion 2640, all of which may be below the horizontal midplane 2120. The back cover portion 2272 may include a back cover perimeter portion 2274. The rim portions 2074 receive the back cover perimeter portion 2274 when the back cover portion 2272 is placed on the back opening 2073 to close the back opening 2073. The rim portions 2074 may be recessed having a certain recessed depth relative to portions of the back wall portion 2072 that surround the back opening 2073. The back cover portion 2272 may have a certain thickness that may be similar or substantially similar (considering manufacturing tolerances) to the recess depth of the rim portions 2074. Accordingly, when placed and seated in the rim portions 2074 and covering the back opening 2073, the back cover portion 2272 may be positioned flush or substantially flush with portions of the back wall portion 2072 that surround the back cover portion 2272. In another example, the back cover portion 2272 may be elevated relative to portions of the back wall portion 2072 adjacent the back cover portion 2272. In yet another example, the back cover portion 2272 may be recessed relative to the portions of the back wall portion 2072 adjacent the back cover portion 2272. The apparatus, methods, and articles of manufacture described herein are not limited in this regard.

The back cover portion 2272 may define a portion of the back wall portion 2072. Accordingly, the back cover portion 2272 and portions of the back wall portion 2072 surrounding the back cover portion 2272 may define the back wall portion 2072. In one example, the back cover portion 2272 may define all of the back wall portion 2072. In another example, the back cover portion 2272 may define greater than or equal to 90% of the back wall portion 2072. In another example, the back cover portion 2272 may define greater than or equal to 10% and less than or equal to 90% of the back wall portion 2072. In another example, the back cover portion 2272 may define greater than or equal to 30% and less than or equal to 80% of the back wall portion 2072. In another example, the back cover portion 2272 may define greater than or equal to 50% and less than or equal to 70% of the back wall portion 2072. The apparatus, methods, and articles of manufacture described herein are not limited in this regard.

Figure 21:
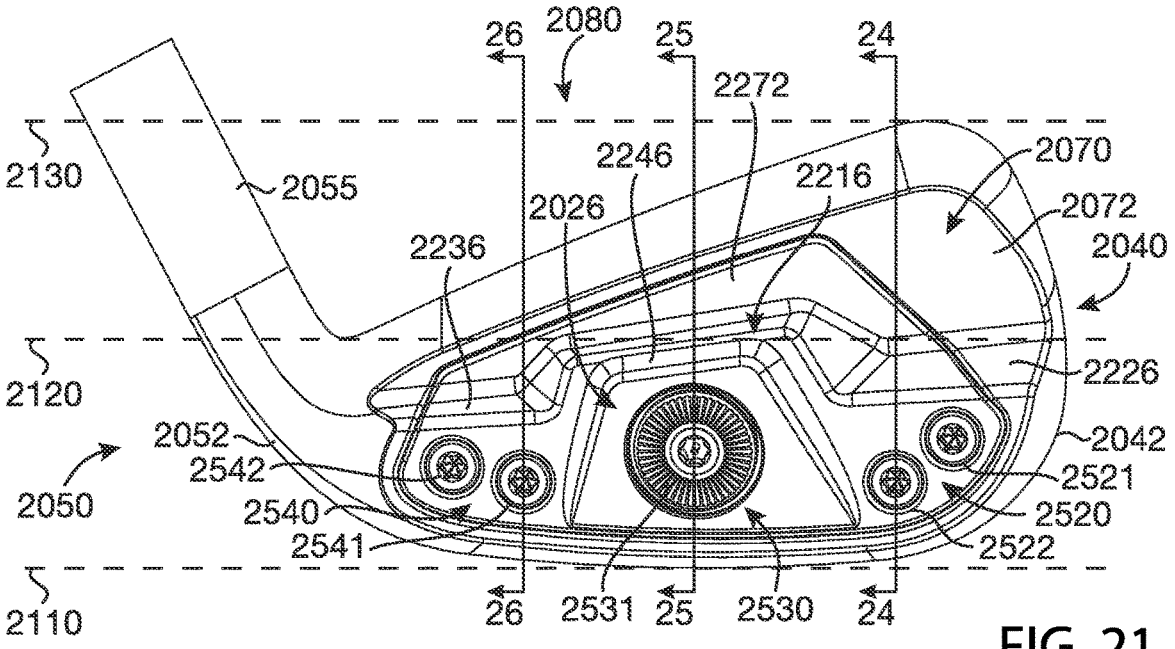
Figure 22:
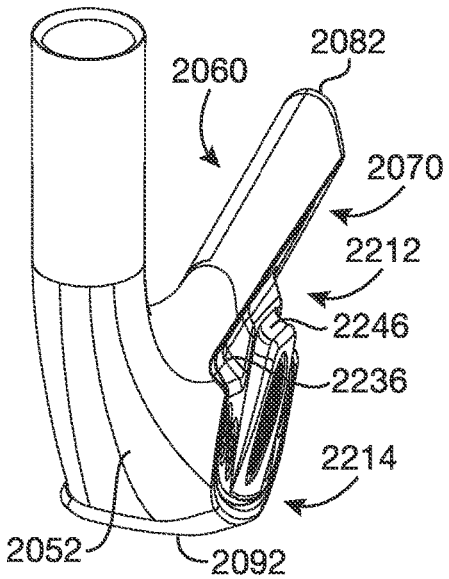
Figure 23:
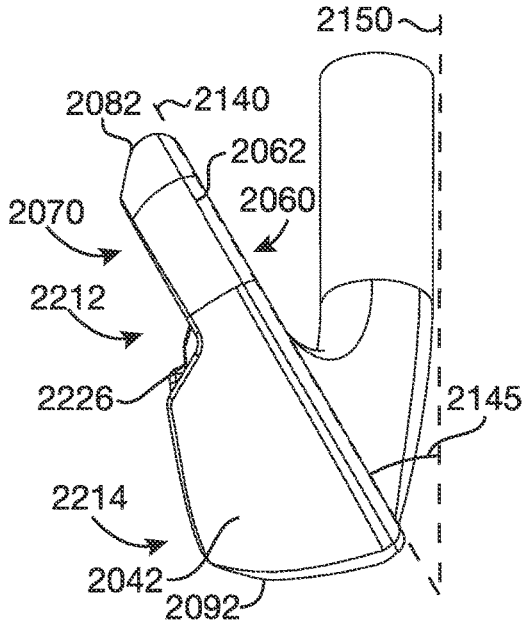
Figure 24:
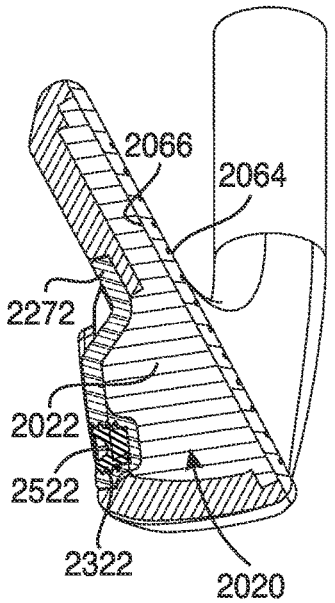
Figure 25:
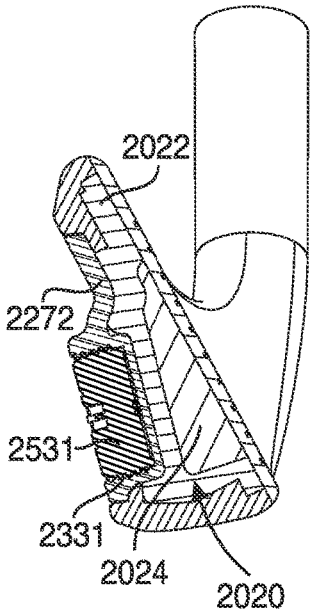
Figure 26:
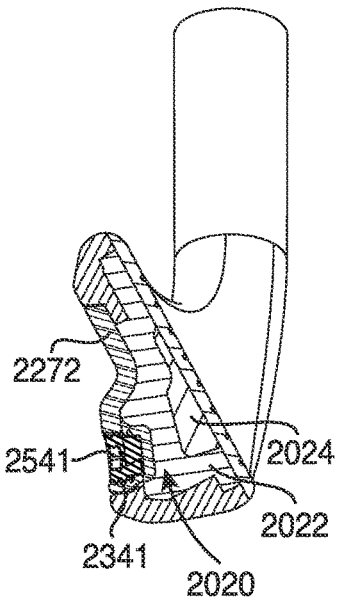
Figure 27:
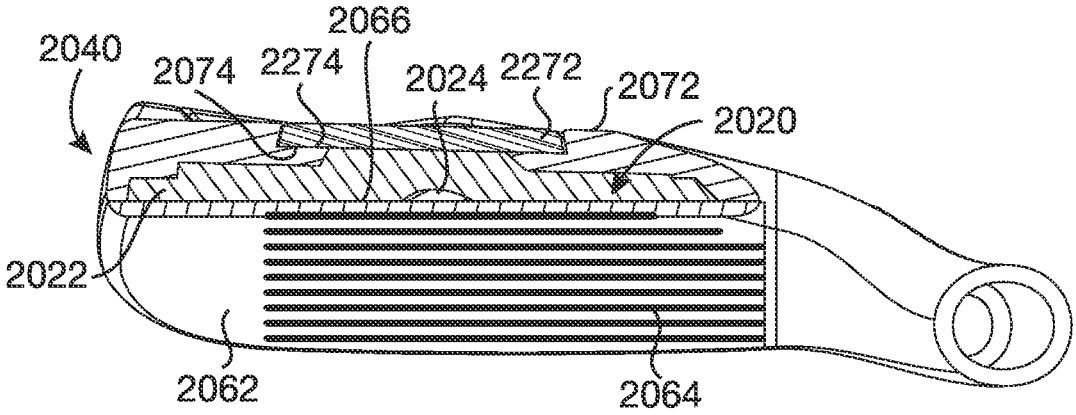
Figure 28:
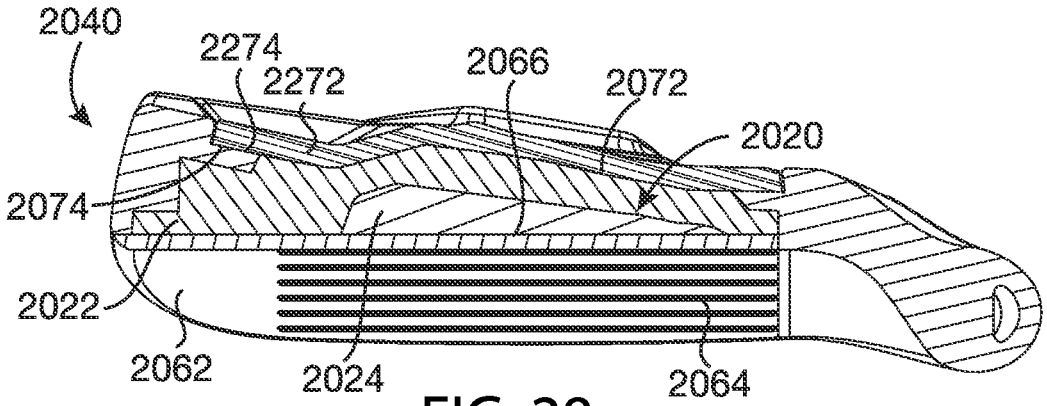
Figure 29:
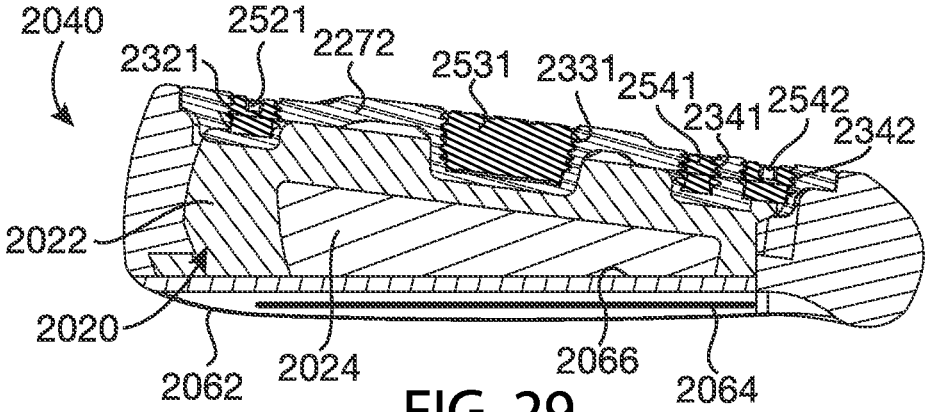
Figure 30:
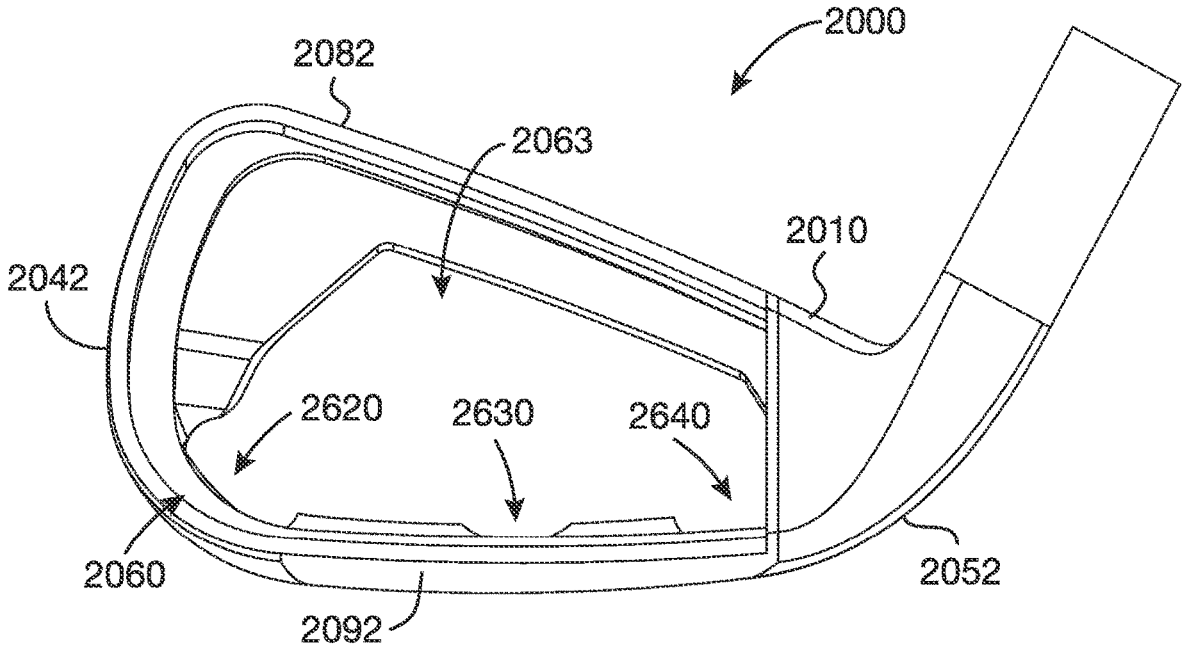
Figure 31:
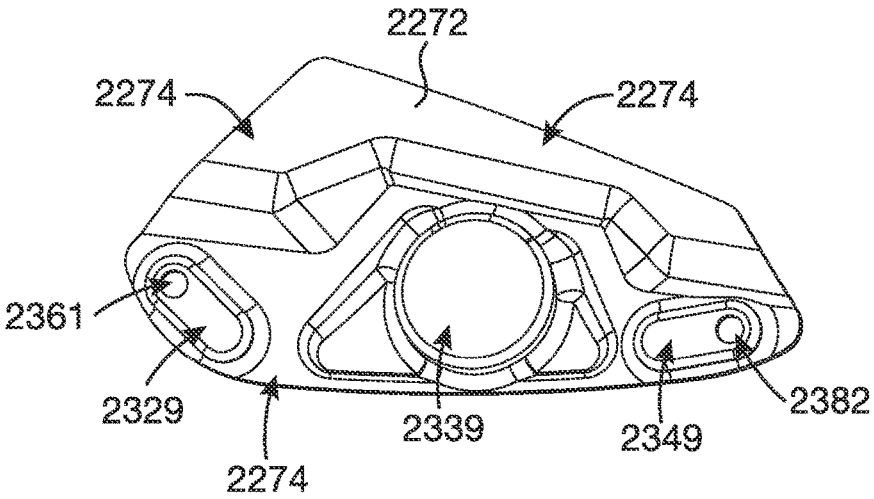
Figure 32:
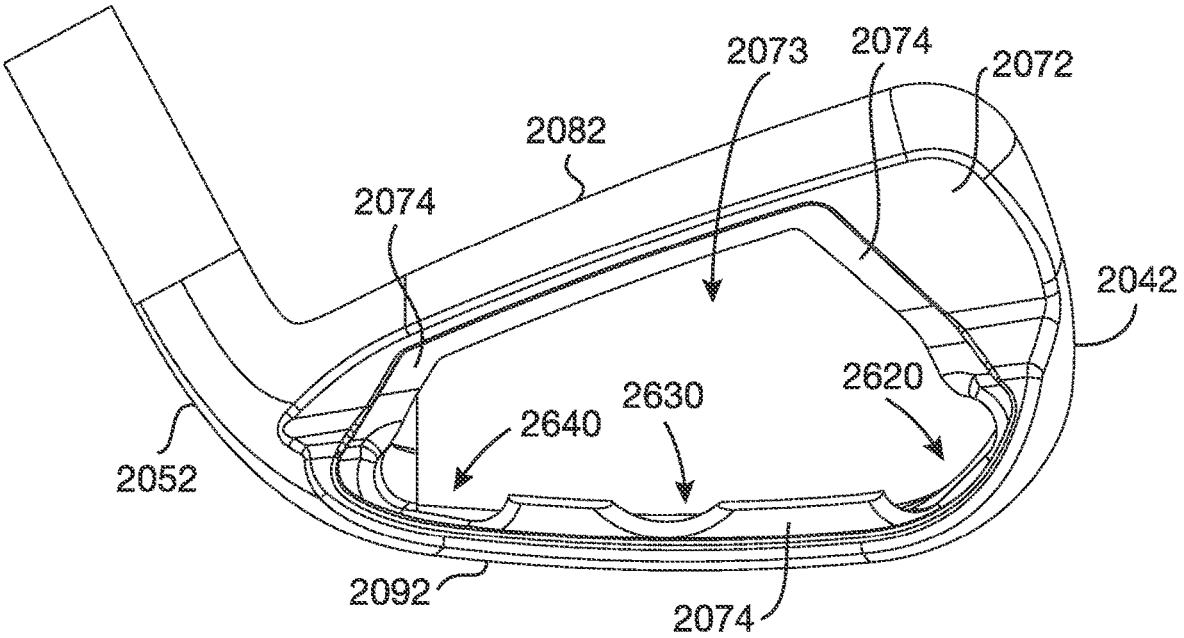
Figure 33:
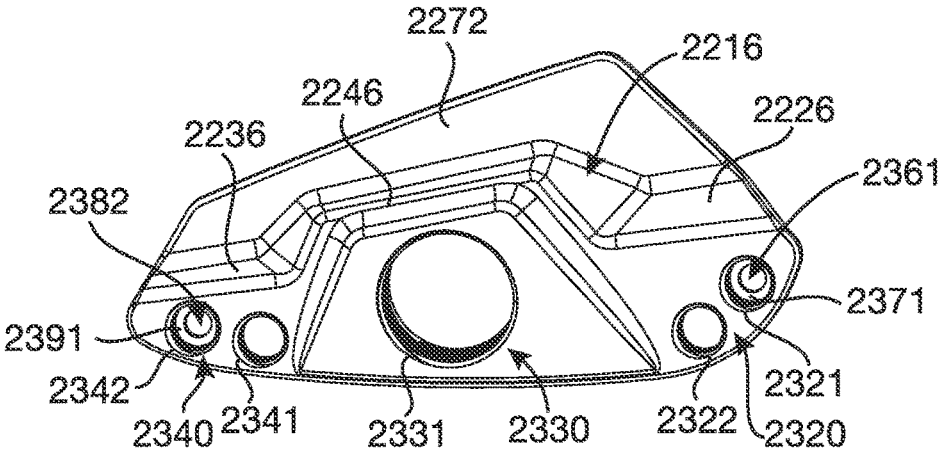
Figure 34:
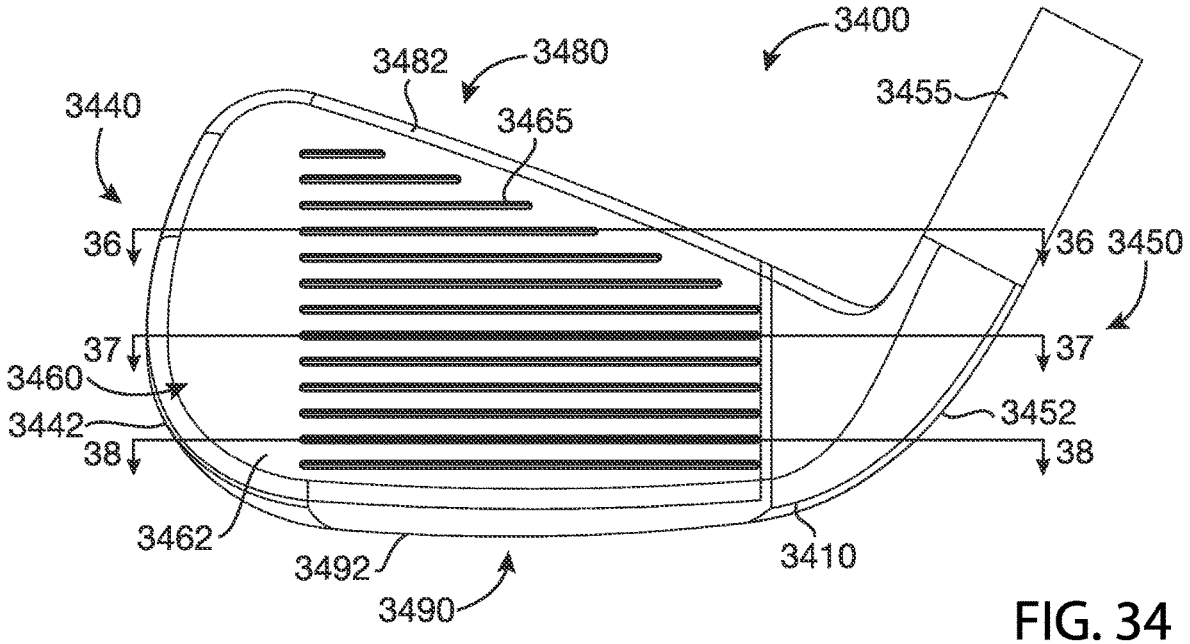
FIGS. 34, 35, 36, 37, 38, 39, 40, 41, 42, 43, 44, 45, 46, 47, 48, 49, and 50 depict a front view, a back view, a cross-sectional view taken at line 36-36 of FIG. 34, a cross-sectional view taken at line 37-37 of FIG. 34, a cross-sectional view taken at line 38-38 of FIG. 34, a cross-sectional view taken at line 39-39 of FIG. 35, a cross-sectional view taken at line 40-40 of FIG. 35, a cross-sectional view taken at line 41-41 of FIG. 35, a mass portion, another mass portion, yet another mass portion, a back view without a back cover portion, a view of an outer side of the back cover portion, a toe-side view of the back cover portion, a front view without a face portion, a view of an inner side of a back cover portion, and a heel-side view of the back cover portion, respectively, of a golf club head according to any embodiment of the apparatus, methods, and articles of manufacture described herein.
Figure 35:
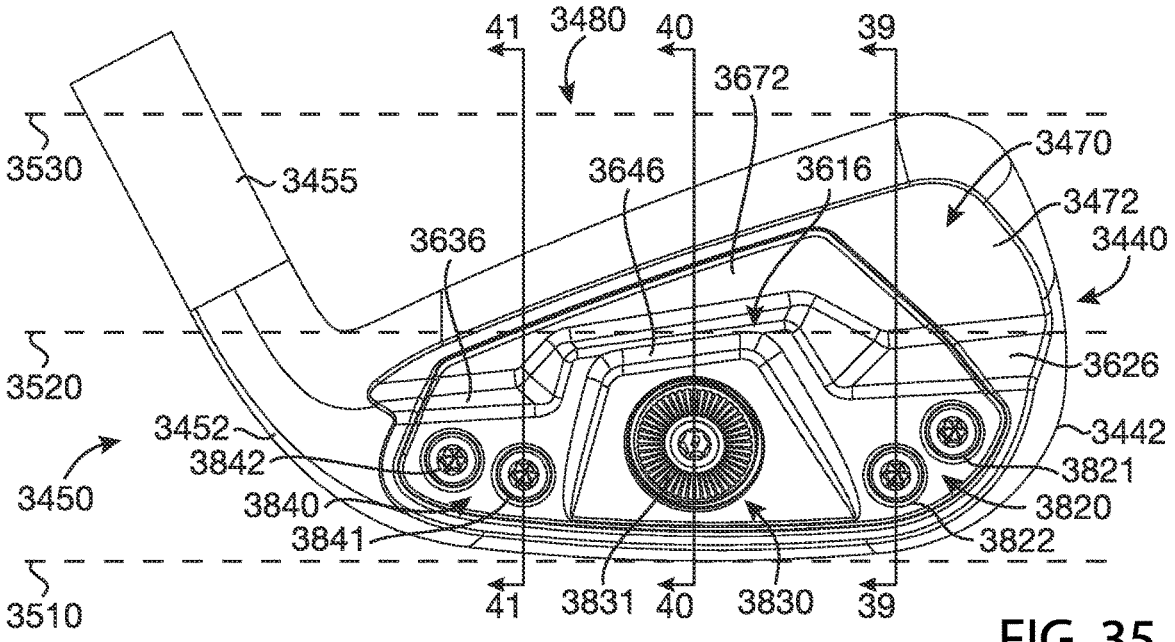
Figure 36:
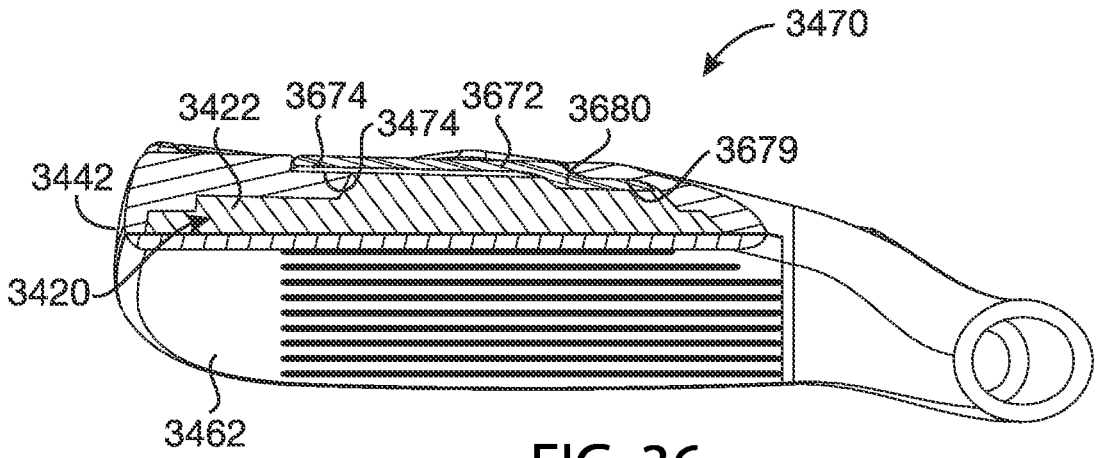
Figure 37:
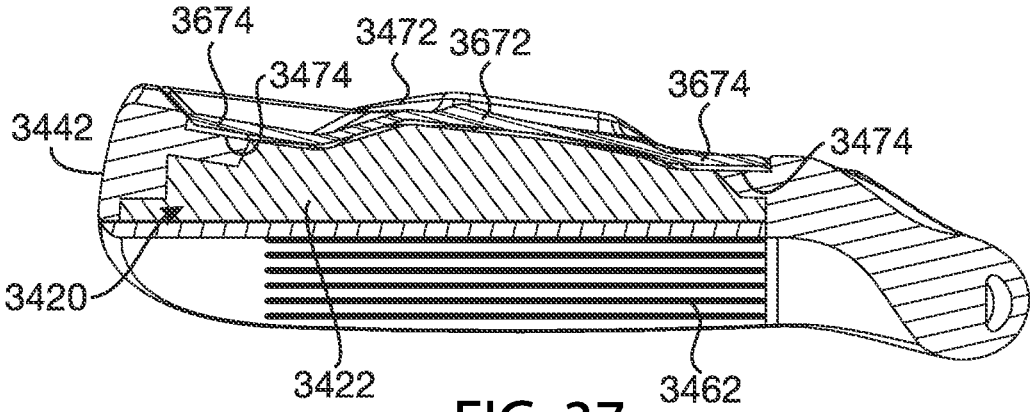
Figure 38:
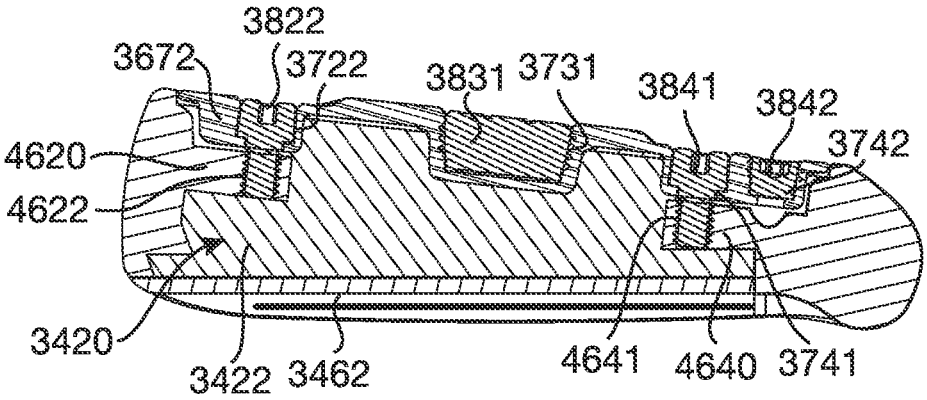
Figure 39:
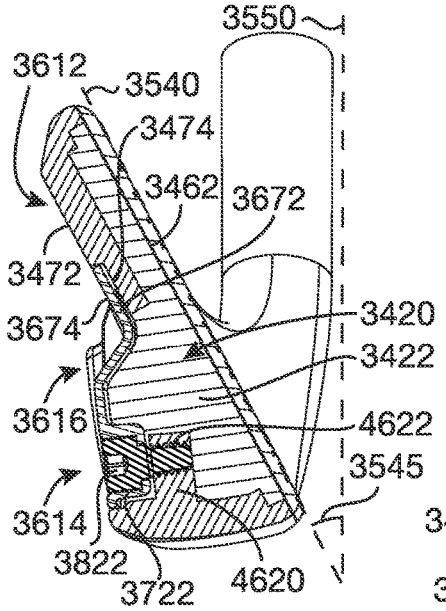
Figure 40:
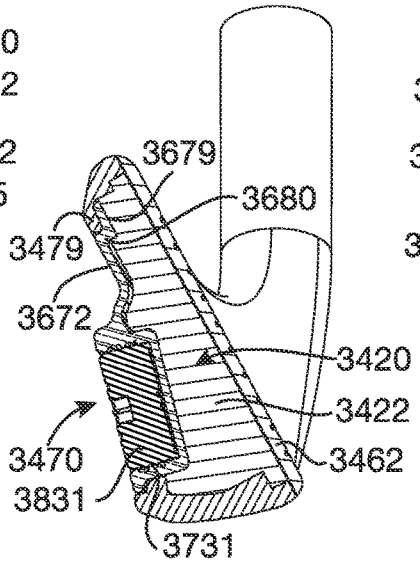
Figure 41:
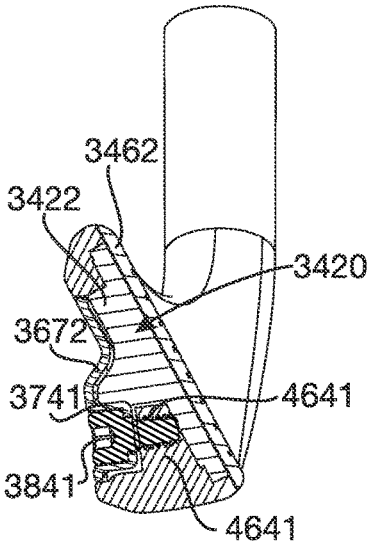
Figure 52:
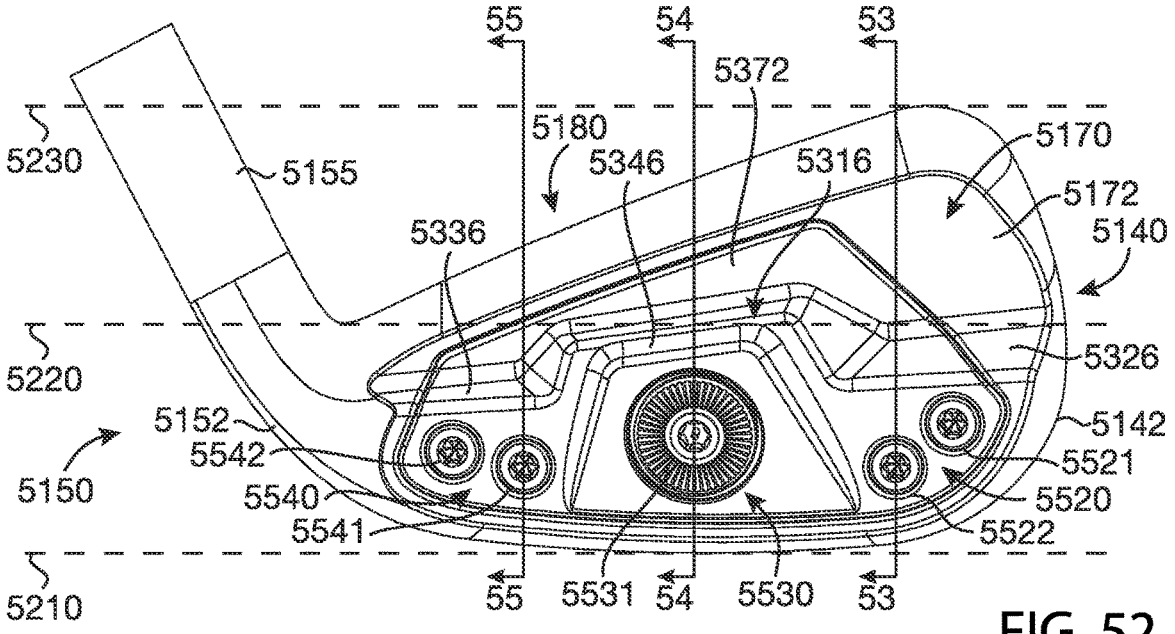
Figure 53:
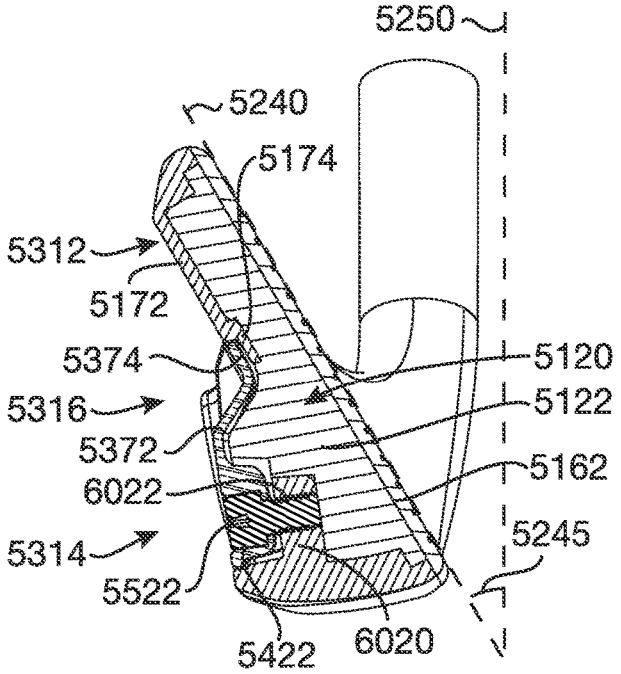
Figure 54:
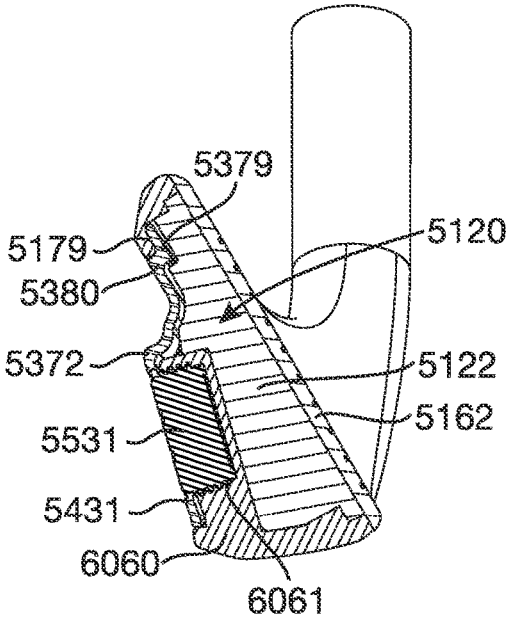
Figure 55:
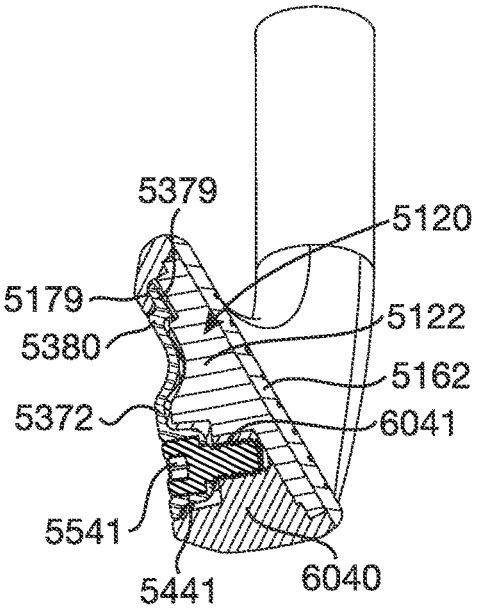
Figure 56:
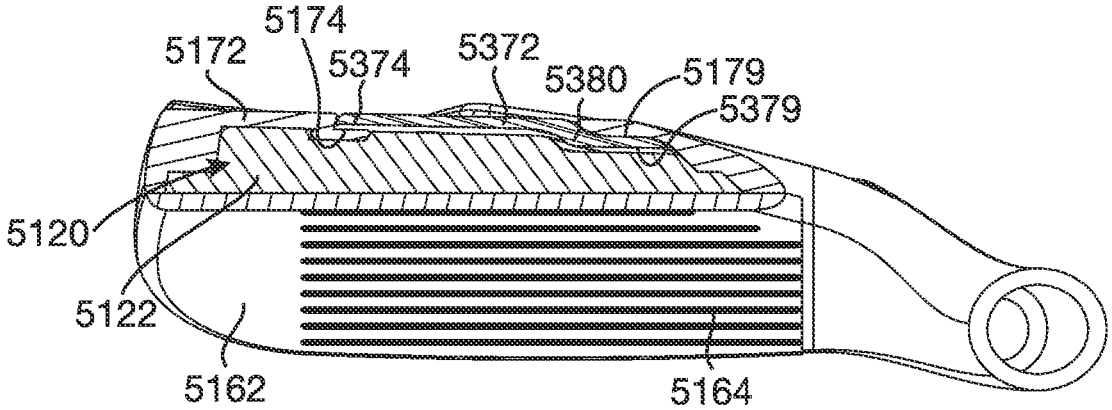
Figure 57:
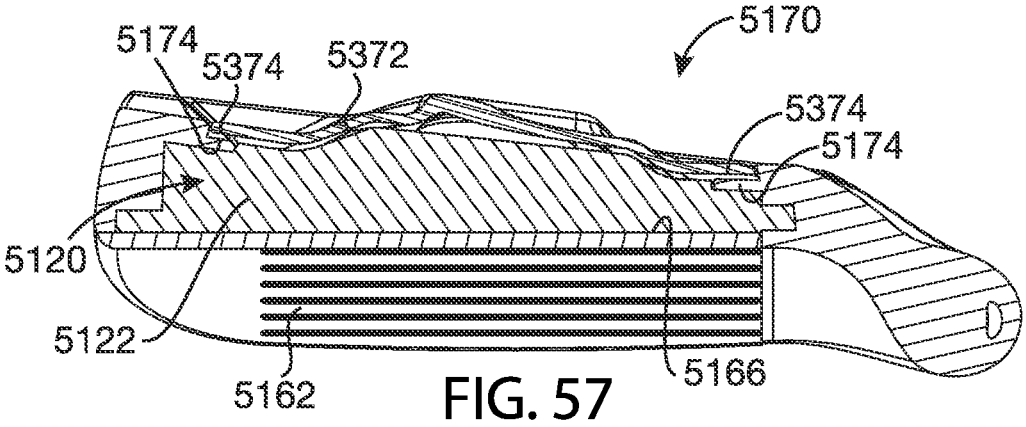
Figure 58:
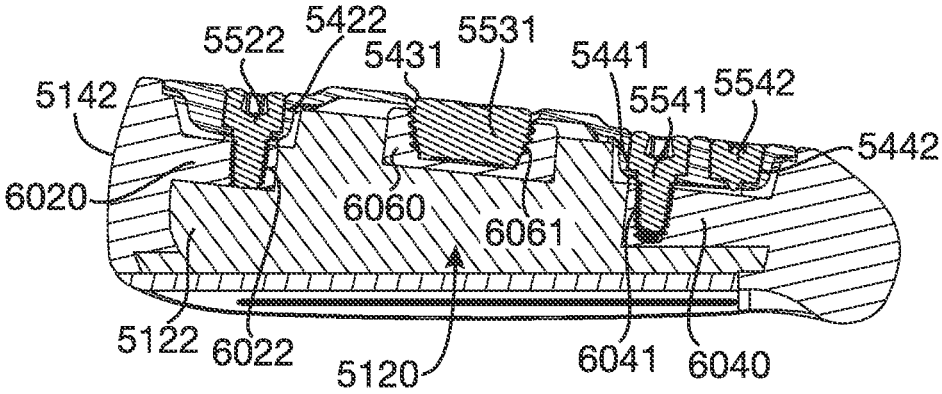
Figure 59:
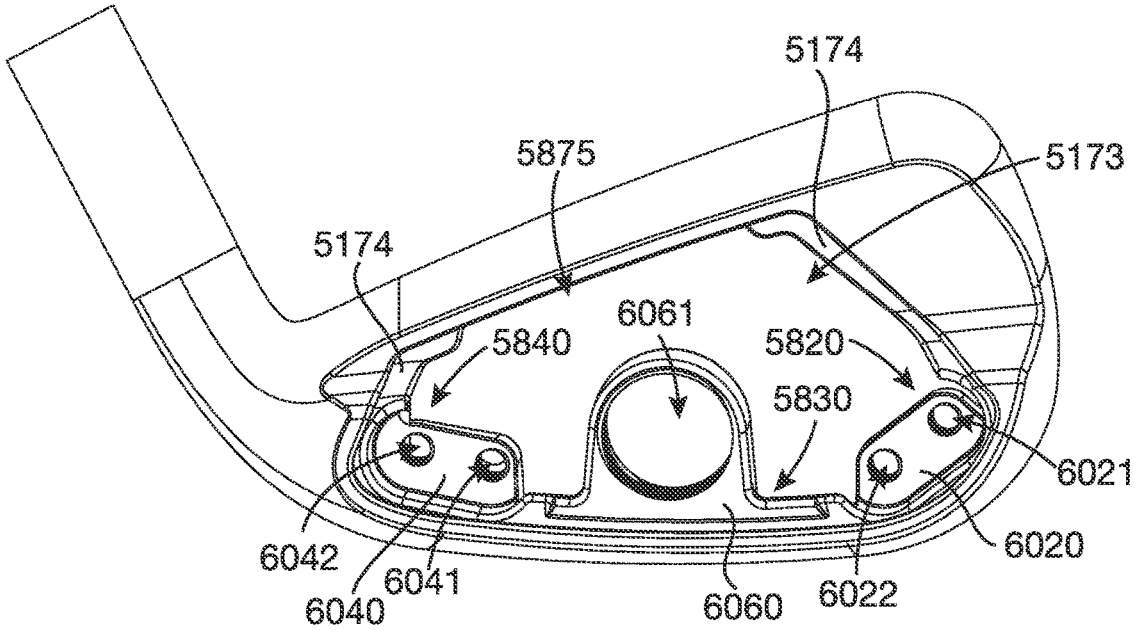
Figure 60:
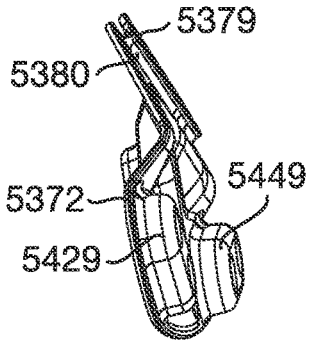
Figure 61:
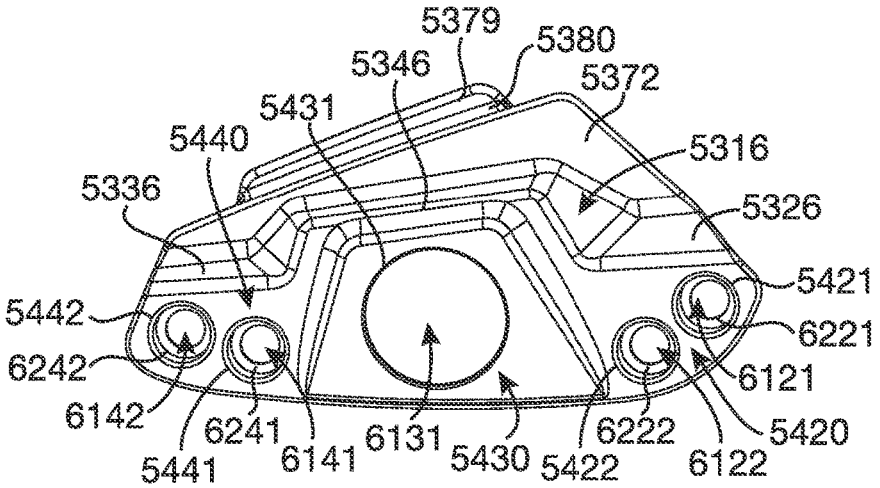
Figure 62:
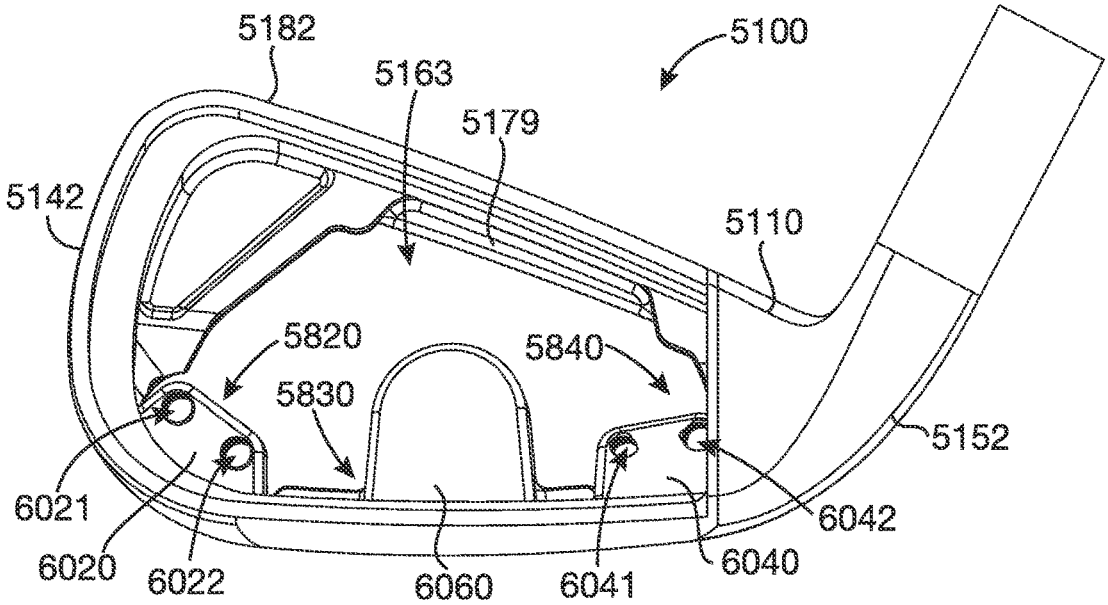
Figure 63:
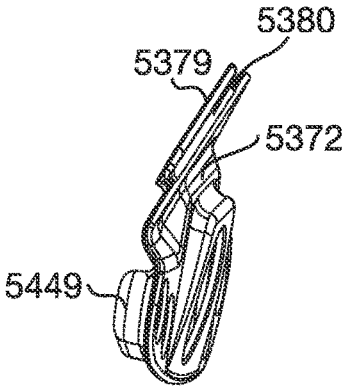

In one example, the body portion 2010 may include a plurality of back cover portions that may cover a single opening or a corresponding plurality of openings on the back wall portion 2072. In another example, a larger portion of the back cover portion 2272 may be closer to the toe portion edge 2042 than the heel portion edge 2052. In another example, a larger portion of the back cover portion 2272 may be closer to the heel portion edge 2052 than the toe portion edge 2042. In another example, a larger portion of the back cover portion 2272 may be closer to the top portion edge 2082 than the sole portion edge 2092. In another example, a larger portion of the back cover portion 2272 may be closer to the sole portion edge 2092 than the top portion edge 2082. In another example, as illustrated in FIG. 21 (also illustrated in FIGS. 35 and 52), a larger portion of the back cover portion 2272 may be below the horizontal midplane 2120. In another example, 50% or more than 50% (as illustrated in FIGS. 21, 35 and 52) of the back cover portion 2272 may be located below the horizontal midplane 2120. In another example, the entire back cover portion 2272 may be located below the horizontal midplane 2120. In another example, 50% or more than 50% of the back cover portion 2272 may be closer to the toe portion edge 2042 than the heel portion edge 2052. In another example, 50% or more than 50% of the back cover portion 2272 may be closer to the heel portion edge 2052 than the toe portion edge 2042. In yet another example, 50% or more than 50% of the back cover portion 2272 may be located above the horizontal midplane 2120. The apparatus, methods, and articles of manufacture described herein are not limited in this regard.

In one example, the back cover portion 2272 may have a generally uniform thickness. In another example, one or more portions of the back cover portion 2272 may have a different thicknesses than one or more other portions of the back cover portion 2272. The thickness or any variation in the thicknesses of the back cover portion 2272 may be associated with mass distribution of the back cover portion 2272. The thickness or any variation in the thicknesses of the back cover portion 2272 may also be associated with structural properties (e.g., stiffness, strength, etc.) of the back cover portion 2272. Accordingly, the thickness of the back cover portion 2272 may be varied at certain locations of the back cover portion 2272 to provide certain mass distribution and/or structural properties for the back cover portion 2272 and/or the golf club head 2000. In one example, 50% or more than 50% of the total mass of the back cover portion 2272 may be located below the horizontal midplane 2120. In another example, 50% or more than 50% of the total mass of the back cover portion 2272 may be closer to the toe portion edge 2042 than the heel portion edge 2052. In another example, 50% or more than 50% of the total mass of the back cover portion 2272 may be closer to the heel portion edge 2052 than the toe portion edge 2042. In yet another example, 50% or more than 50% of the total mass of the back cover portion 2272 may be located above the horizontal midplane 2120. The apparatus, methods, and articles of manufacture described herein are not limited in this regard.

In one example, the back cover portion 2272 may be constructed from one or more materials that may be similar to one or more materials of the body portion 2010 or different from one or more materials of the body portion 2010. In another example, the back cover portion 2272 may be constructed from a material having a higher density than the material of the body portion 2010. Accordingly, the back cover portion 2272 may provide for a greater portion of the mass of the body portion 2010 to be placed farther away from the face portion 2062 to move the center of gravity (CG) of the body portion 2010 farther aft. In yet another example, the back cover portion 2272 may be constructed from a material having a lower density than the material of the body portion 2010. Accordingly, as described in detail herein, one or more mass portions may be coupled to various locations on the body portion 2010 optimize the CG and MOI of the golf club head 2000 while maintaining the overall weight of the golf club head within a certain weight range. In one example, the material of construction of the back cover portion 2272 and the physical properties of the back cover portion 2272 (e.g., thickness of the back cover portion 2272) may be determined to impart certain performance characteristics on the golf club head 2000. In one example, the back cover portion 2272 may be constructed from any metal, metal alloy, or a combination of metals such as for example steel, aluminum or aluminum alloy, titanium or titanium alloy, tungsten or tungsten alloys, or magnesium or magnesium alloys. In another example, the back cover portion 2272 may be constructed from any type of composite material such as for example a carbon fiber based composite material. The back cover portion 2272 may be formed from one or more layers of carbon fiber reinforced with epoxy resin that may be piled in different fiber orientations for directional strength. Accordingly, the back cover portion 2272 may be lighter than a correspondingly configured back cover portion made from a metallic material such as steel while having similar or relatively greater strength. The weight that may be saved by using a back cover portion 2272 made form a composite material or a material having a relatively lower density than the material of the body portion 2010 may be strategically placed at one or more locations on the golf club head 2000 to optimize the location of the CG (e.g., lower the CG and move the CG farther aft) and/or optimize the moment of inertia (e.g., increase the moment of inertia) of the golf club head 2000. The back cover portion 2272 may be constructed from other types of materials such one or more polymer materials, wood, or other composite materials such as fiberglass. The materials of construction of the back cover portion 2272 may be determined to provide certain overall weight, weight distribution, swing properties, and/or structural properties to the golf club head 2000. The apparatus, methods, and articles of manufacture described herein are not limited in this regard.

In one example, as illustrated in FIGS. 20-33, the back wall portion 2072 may include an upper back wall portion 2212, a lower back wall portion 2214, and a ledge portion 2216 defining a transition portion between the upper back wall portion 2212 and the lower back wall portion 2214. The ledge portion 2216 may include a first ledge portion 2226 and a second ledge portion 2236. The first ledge portion 2226 may extend on the back wall portion from the toe portion edge 2042 to a third ledge portion 2246 of the back wall portion 2072 that may be located at or proximate to a center portion 2026 of the body portion 2010. The second ledge portion 2236 may extend from the third ledge portion 2246 to the heel portion edge 2052. The ledge portion 2216 may provide placement of the mass of the body portion 2010 farther aft and below the horizontal midplane 2120 to move farther aft and lower the position of the CG, respectively, of the golf club head 2000. The configuration of the ledge portion 2216 (e.g., width, segments, tapering, shape, etc.) and the properties of the ledge portion 2216 relative to the width of the interior cavity may be similar to any ledge portion or similar structures of any of the golf club heads described herein and/or described in any of the incorporated by reference publications. The apparatus, methods, and articles of manufacture described herein are not limited in this regard.

The body portion 2010 may include one or more ports, which may be exterior ports and/or interior ports (e.g., located inside the body portion 2010). The inner walls of the interior cavity 2020 may include one or more ports (not illustrated). In one example, as illustrated in FIGS. 20-33, the back cover portion 2272 may include a first set of ports 2320 (e.g., illustrated as port 2321 and port 2322), a second set of ports 2330 (e.g., illustrated as port 2331), and a third set of ports 2340 (e.g., illustrated as port 2341 and port 2342). The first set of ports 2320, the second set of ports 2330, and/or the third set of ports 2340 may include any number of ports. The locations, spacing relative to other ports, and any other configuration of each port of the first set of ports 2320, the second set of ports 2330, and/or the third set of ports 2340 may be similar in many respects to any of the ports described herein or described in any of the incorporated by reference publications. Further, any one or more of the ports of the first set of ports 2320, the second set of ports 2330, and/or the third set of ports 2340 may be connected to interior cavity 2020 through which one or more filler materials may be injected into the interior cavity 2020. In one example, as illustrated in FIGS. 20-33, the port 2321 and the port 2342 may be connected to the interior cavity 2020 via an opening 2361 and an opening 2382, respectively, through which one or more filler materials may be injected into the interior cavity 2020. Each of the openings 2361 and 2382 may have a smaller diameter than the diameters of the ports 2321 and 2342 to define internal port shoulders 2371 and 2391, respectively. The internal port shoulder 2371 and the internal port shoulder 2391 may prevent any plug or mass portion inserted into a corresponding port to extend beyond the internal port shoulder 2371 or the internal port shoulder 2391 and into the interior cavity 2020. The apparatus, methods, and articles of manufacture described herein are not limited in this regard.

Each port of the first set of ports 2320 may be located in a first port region 2329 of the back cover portion 2272. The distance from any of the ports of the first set of ports 2320 to the toe portion edge 2042 may be less than the distance from any of the ports of the first set of ports 2320 to the heel portion edge 2052 or the hosel portion 2055. Each port of the first set of ports 2320 may be separated by a distance less than the port diameter of any of the ports of the first set of ports 2320. Each port of the second set of ports 2330 may be located in a second port region 2339 of the back cover portion 2272. The second port region 2339 may be at or proximate to a center portion 2026 of the body portion 2010. Each port of the third set of ports 2340 may be located in a third port region 2349 of the back cover portion 2272. The distance from any of the ports of the third set of ports 2340 to the toe portion edge 2042 may be greater than the distance from any of the ports of the third set of ports 2340 to the heel portion edge 2052 or the hosel portion 2055. Each port of the third set of ports 2340 may be separated by a distance less than the port diameter of any of the ports of the third set of ports 2340. The port regions 2329, 2339, and 2349 may be thicker portions, projecting portions, and/or structurally enhanced portions of the back cover portion 2272 to accommodate the structures and/or functions of the ports of the sets of ports 2320, 2330, and 2340, respectively. The apparatus, methods, and articles of manufacture described herein are not limited in this regard.

In one example, as illustrated in FIGS. 20-33, the second set of ports 2330 may include a port 2331 that may be larger in diameter than any of the ports of the first set of ports 2320 and/or the third set of ports 2340. The port 2331 may be located at or proximate to a center portion 2026 of the body portion 2010 or proximate to the third ledge portion 2246 and be entirely or at least partially located below the horizontal midplane 2120. In one example, as illustrated in FIGS. 20-33, the port 2331 may be located below the horizontal midplane 2120 and below the third ledge portion 2246. In one example, the diameter of the port 2331 may be greater than or equal to 1.25 times the diameter of any of the ports of the first set of ports 2320 and the third set of ports 2340. In another example, the diameter of the port 2331 may be greater than or equal to twice the diameter of any of the ports of the first set of ports 2320 and the third set of ports 2340. In another example, the diameter of the port 2331 may be greater than or equal to 2.5 times the diameter of any of the ports of the first set of ports 2320 and the third set of ports 2340. In yet another example, the diameter of the port 2331 may be greater than or equal to 3.5 times the diameter of any of the ports of the first set of ports 2320 and the third set of ports 2340. In the example of FIGS. 20-33, the ports of the first set of ports 2320, the second set of ports 2330 and the third set of ports 2340 are illustrated to be cylindrical. In other examples (not illustrated), the ports may have any shape. Accordingly, the relative sizes of the ports may be compared by any dimension such as length, width, radius, diameter, distance between two boundaries, or any dimension corresponding to a particular geometric shape (e.g., major and minor axes for an elliptical shaped port). The apparatus, methods, and articles of manufacture described herein are not limited in this regard.

The back cover portion 2272 may be attached to the body portion 2010 by any method such as for example with an adhesive, with mechanical fastening or locking, by welding, and/or by soldering. To attach the back cover portion 2272 to the body portion 2010, the back cover portion 2272 may be placed on the back opening 2073 such that the back cover perimeter portion 2274 is positioned or seated on top of the corresponding portions of the rim portions 2074. The back cover perimeter portion 2274 may be in direct contact with the rim portions 2074 or coupled to the rim portions 2074 via one or more adhesives or bonding agents depending on the method by which the back cover portion 2272 is attached to the body portion 2010. In the seated position, the first port region 2329 may extend through the toe-side cutout portion 2620 and into the interior cavity 2020, the second port region 2339 may extend through the center cutout portion 2630 and into the interior cavity 2020, and the third port region 2349 may extend through the heel-side cutout portion 2640 and into the interior cavity 2020. In one example, one or more adhesives or bonding agents may be used to attach the back cover portion 2272 to the body portion 2010 regardless of the type of materials from which the back cover portion 2272 may be constructed. For example, a back cover portion 2272 that is constructed from a carbon composite material may be attached to the body portion 2010 with one or more adhesives or bonding agents. Accordingly, one or more adhesives may be applied on the back cover perimeter portion 2274, the rim portions 2074 or both. In another example, a back cover portion 2272 that is constructed from a metal, or a metal alloy may be attached to the body portion 2010 by welding. Accordingly, the back cover portion 2272 and the body portion 2010 may be welded together at one or more gaps between the back cover portion 2272 and portions of the back wall portion 2072 that surround the back cover portion 2272. The apparatus, methods, and articles of manufacture described herein are not limited in this regard.

The body portion 2010 may include one or more mass portions (e.g., weight portion(s)), which may be integral with the body portion 2010 or may be separate mass portion(s) that may be coupled to the body portion 2010. In the illustrated example of FIGS. 20-33, the body portion 2010 may include a first set of mass portions 2520 (e.g., illustrated as mass portions 2521 and 2522), a second set of mass portions 2530 (e.g., illustrated as mass portion 2531), and a third set of mass portions 2540 (e.g., illustrated as mass portions 2541 and 2542). The mass portions of the first set of mass portions 2520 and the third set of mass portions 2540 may be similar to any of the mass portions described herein or in any of the incorporated by reference publications. For example, the mass portions of the first set of mass portions 2520 and the third set of mass portions 2540 may be similar to the mass portions 1800 of FIG. 18, the mass portion 1900 of FIG. 19, or the mass portion 4200 of FIG. 42 as described herein. In the example of FIGS. 20-33, the second set of mass portions 2530 may include a mass portion 2531, which may have a greater mass than any of the mass portions of the first set of mass portions 2520 and the third set of mass portions 2540. The mass portion 2531 may be similar to the mass portion 4400 of FIG. 44 as described herein. The port 2331 may be configured to receive the mass portion 2531, which may be inserted and secured into the port 2331 by any of the methods described herein. In one example, as illustrated in FIGS. 20-33, the ports of the first set of ports 2320, the second set of ports 2330, and the third set of ports 2340 may have threaded inner walls to engage threaded outer walls of the corresponding mass portions of the first set of mass portions 2520, the second set of mass portions 2530, and the third set of mass portions 2540, respectively, to close the ports and close any opening in the ports that may be connected to the interior cavity 2020 similar to the coupling and/or engagement of any of the mass portions and ports described herein or described in any of the incorporated by reference publications. Accordingly, for example, the dimensions of each port of the first set of ports 2320, the second set of ports 2330, and the third set of ports 2340, and the dimensions of each mass portion of the first set of mass portions 2520, the second set of mass portions 2530, and the third set of mass portions 2540 may be determined so that the mass portions of the first set of mass portions 2520, the second set of mass portions 2530, and/or the third set of mass portions 2540 are in a flush (as illustrated in the examples of FIGS. 20-33), protruded, or recessed configuration relative to the outer surface of the back cover portion 2272. Accordingly, each mass portion may be secured in a corresponding port by being screwed in the port as illustrated in FIGS. 33-50, or alternatively press fitted, secured with an adhesive, welded, or a combination thereof. The apparatus, methods, and articles of manufacture described herein are not limited in this regard.

In one example, the total mass of the mass portion 2531 may be greater than the total mass of any single mass portion of the first set of mass portions 2520 or any single mass portion of the third set of mass portions 2540. In another example, the total mass of the mass portion 2531 may be greater than or equal to the total mass of the first set of mass portions 2520 and/or greater than or equal to total mass of the third set of mass portions 2540. In yet another example, the total mass of the mass portion 2531 may be greater than or equal to the total masses of the first set of mass portions 2520 and the third set of mass portions 2540. The total mass of the mass portion 2531 may be determined to provide certain performance characteristics for the golf club head 2000. In one example, the mass portion 2531 may have a total mass that is greater than or equal to 2 grams and less than or equal to 25 grams. In another example, the mass portion 2531 may have a total mass that is greater than or equal to 4 grams and less than or equal to 12 grams. In another example, the mass portion 2531 may have a total mass that is greater than or equal to 6 grams and less than or equal to 10 grams. In another example, the mass portion 2531 may have a total mass that is greater than or equal to 7 grams and less than or equal to 9 grams. The diameter of the mass portion 2531 may be determined based on one or more properties (e.g., material density) of the materials of construction of the mass portion 2531. In one example, the mass portion 2531 may have a diameter that is greater than or equal to 0.2 inch (5.08 mm) and less than or equal to 1.0 inch (25.4 mm). In another example, the mass portion 2531 may have a diameter that is greater than or equal to 0.4 inch (10.16 mm) and less than or equal to 0.8 inch (20.32 mm). In yet another example, the mass portion 2531 may have a diameter that is greater than or equal to 0.5 inch (12.7 mm) and less than or equal to 0.7 inch (17.78 mm). The apparatus, methods, and articles of manufacture described herein are not limited in this regard.

The interior cavity 2020 may be partially or entirely filled with one or more filler materials (i.e., a cavity filling material), which may include one or more similar or different types of materials. Any of the one or more filler materials may be injected (e.g., injection molding) into the interior cavity 2020 or pre-manufactured and inserted into the interior cavity 2020 as described herein with respect to the golf club head 200 or any of the golf club heads described in any of the incorporated by reference publications. In one example, as illustrated in FIGS. 20-33, the interior cavity 2020 may be filled with a first filler material 2022 and a second filler material 2024. In one example, the first filler material 2022 and the second filler material 2024 may be similar to first filler material 512 and the second filler material 514 of the golf club head 200, respectively. In another example, the first filler material 2022 and the second filler material 2024 may be similar to the second filler material 514 and the first filler material 512 of the golf club head 200, respectively. The amount (i.e., volume and/or mass) of the first filler material 2022 may be determined for each golf club head (i.e., having a certain loft angle) to (i) provide vibration dampening or sound dampening (e.g., consistent and/or pleasing sound and feel when the golf club head 2000 strikes a golf ball as perceived by an individual using the golf club head 2000), (ii) provide structural support for the face portion 2062, and/or (iii) optimize ball travel distance, ball speed, ball launch angle, ball spin rate, ball peak height, ball landing angle and/or ball dispersion. The apparatus, methods, and articles of manufacture described herein are not limited in this regard.

In one example, the first filler material 2022 and the second filler material 2024 may be injected into the interior cavity 2020 from any one or both of the ports 2321 and 2342 after the back cover portion 2272 is attached to the body portion 2010. In another example, the second filler material 2024 may be preformed and placed in the interior cavity 2020 prior to attachment of the back cover portion 2272 to the body portion 2010. The first filler material 2022 may then be injected into the interior cavity 2020 from any one or both of the ports 2321 and 2342 after the back cover portion 2272 is attached to the body portion 2010. In another example, the first filler material 2022 and the second filler material 2024 may be preformed and placed in the interior cavity 2020 prior to attachment of the back cover portion 2272 to the body portion 2010. In yet another example, the interior cavity 2020 may be filled with only one filler material (injection molded in the interior cavity 2020 or preformed and placed in the interior cavity 2020), which may be the first filler material 2022, the second filler material 2024, or another filler material. In one example, one or more adhesives or bonding agents may be used to attach the first filler material 2022 and/or the second filler material 2024 to the body portion 2010. In another example, the first filler material 2022 and/or the second filler material 2024 may be inherently adhesive such that a separate adhesive or bonding agent may not be needed. In yet another example, the first filler material 2022 and/or the second filler material 2024 may be in the interior cavity 2020 without the use of any adhesives or bonding agents. The apparatus, methods, and articles of manufacture described herein are not limited in this regard.

In the example of FIGS. 34-50, a golf club head 3400 may include a body portion 3410 having a toe portion 3440 with a toe portion edge 3442, a heel portion 3450 with a heel portion edge 3452 that may include a hosel portion 3455 configured to receive a shaft (an example shaft 104 is illustrated in FIG. 1) with a grip (an example grip 106 is illustrated in FIG. 1) on one end and the golf club head 3400 on the opposite end of the shaft to form a golf club (an example golf club 100 is illustrated in FIG. 1), a front portion 3460, a back portion 3470 with a back wall portion 3472, a top portion 3480 with a top portion edge 3482, and a sole portion 3490 with a sole portion edge 3492. The golf club head 3400 may include a face portion 3462 coupled to a front opening 3463 of the front portion 3460 to close the front opening 3463. The face portion 3462 may include a front surface 3464 with a plurality of grooves 3465 and a back surface 3466. The golf club head 3400 may be associated with a ground plane 3510, a horizontal midplane 3520, and a top plane 3530, a loft plane 3540, a loft angle 3545 ($\alpha$), and a vertical plane 3550. The body portion 3410 may be a hollow body portion with the front opening 3463 and a back opening 3473 in the back wall portion 3472. Accordingly, the body portion 3410 may include a through hole defining an interior cavity 3420 having the front opening 3463 and the back opening 3473. As described herein, the face portion 3462 may be attached to the front portion 3460 to close the front opening 3463. The body portion 3410 may include a back cover portion 3672 that may be attached to the back wall portion 3472 to cover and close the back opening 3473, which along with the face portion 3462 closing the front opening 3463 enclose the interior cavity 3420. The above-described parts and features of the golf club head 3400 may be similar in many respects to the golf club head 2000. The apparatus, methods, and articles of manufacture described herein are not limited in this regard.

The back wall portion 3472 including the back cover portion 3672 may be similar in many respects to the back wall portion 2072 and the back cover portion 2272, respectively, of the golf club head 2000. Accordingly, the back wall portion 3472 may include an upper back wall portion 3612, a lower back wall portion 3614, and a ledge portion 3616 with a first ledge portion 3626, a second ledge portion 3636, and a third ledge portion 3646, which may be similar in many respects to the same parts of the golf club head 2000. As illustrated in FIGS. 34-50, the back wall portion 3472 may include rim portions 3474, a toe-side cutout portion 4120, a center cutout portion 4130, and a heel-side cutout portion 4140. In one example, as illustrated in FIGS. 34-50, the back wall portion 3472 may include a slot 3479 on an inner surface of the back wall portion 3472 that may extend from an upper perimeter of the back opening 3473 toward the top portion edge 3482. The apparatus, methods, and articles of manufacture described herein are not limited in this regard.

The body portion 3410 may include one or more ports, which may be exterior ports and/or interior ports. The inner walls of the interior cavity 2020 may include one or more ports. In one example, as illustrated in FIGS. 34-50, the back cover portion 3672 may be similar in many respects to the back cover portion 2272 of the golf club head 2000. Accordingly, the back cover portion 3672 may include a first port region 3729 that may include the first set of ports 3720 (e.g., illustrated as port 3721 and port 3722), a second port region 3739 that may include the second set of ports 3730 (e.g., illustrated as port 3731), and a third port region 3749 that may include the third set of ports 3740 (e.g., illustrated as port 3741 and port 3742). The port regions 3729, 3739, and 3749 may have similar configurations as the port regions 2329, 2339, and 2349, respectively, of the golf club head 2000 as described herein. A portion of the back cover portion 3672 at or proximate to a perimeter of the back cover portion 3672 may define a back cover perimeter portion 3674. In one example, as illustrated in FIGS. 34-50, the back cover portion 3672 may include a back cover tab portion 3679 at an upper perimeter portion of the back cover portion 3672. The back cover tab portion 3679 extends above the perimeter of the back cover portion 3672 and is configured to engage the slot 3479 on the inner surface of the back wall portion 2072 as described herein. The back cover portion 3672 may also include a tab offset 3680 that may be perpendicular or transverse to the back cover tab portion 3679 to define an L-shaped flange portion with the back cover tab portion 3679. The apparatus, methods, and articles of manufacture described herein are not limited in this regard.

Figure 49:
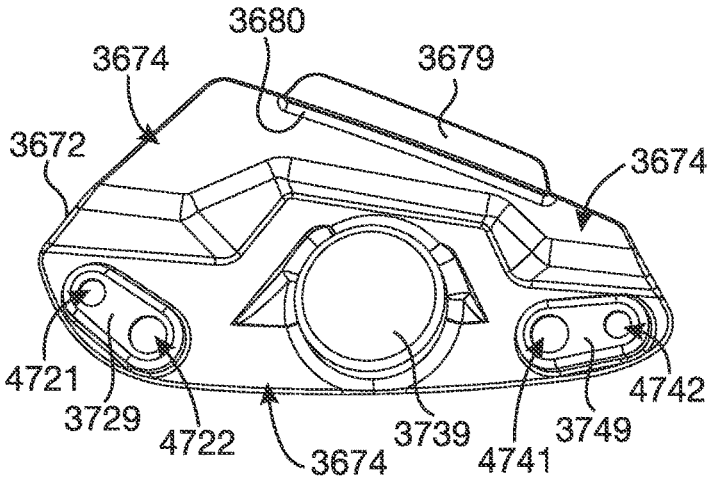
Figure 50:
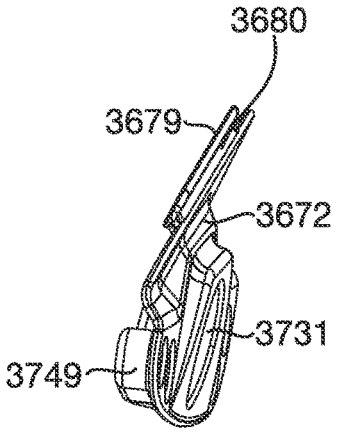
Figure 51:
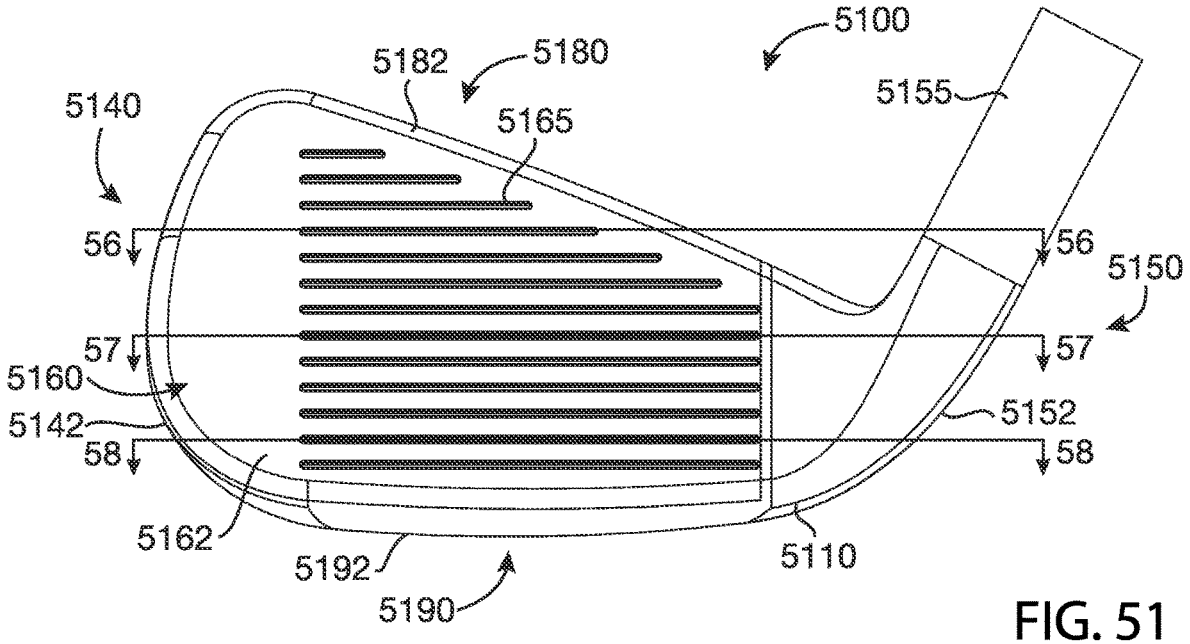
FIGS. 51, 52, 53, 54, 55, 56, 57, 58, 59, 60, 61, 62, 63, and 64 depict a front view, a back view, a cross-sectional view taken at line 53-53 of FIG. 52, a cross-sectional view taken at line 54-54 of FIG. 52, a cross-sectional view taken at line 55-55 of FIG. 52, a cross-sectional view taken at line 56-56 of FIG. 51, a cross-sectional view taken at line 57-57 of FIG. 51, a cross-sectional view taken at line 58-58 of FIG. 51, a back view without a back cover portion, a toe-side view of the back cover portion, a view of an outer side of the back cover portion, a front view without a face portion, a heel-side view of the back cover portion, and a view of an inner side of a back cover portion, respectively, of a golf club head according to any embodiment of the apparatus, methods, and articles of manufacture described herein.

In one example, one or more of the ports of the first set of ports 2320 and/or the third set of ports 3740 may be connected to interior cavity 3420 through which one or more filler materials may be injected into the interior cavity 3420. In one example, as illustrated in FIGS. 34-50, ports 3721, 3722, 3741, and 3742 may be include openings 4721, 4722, 4741, and 4742, respectively, at the bottoms thereof that may be connected to the interior cavity 3420 when the back cover portion 3672 is coupled to the body portion 3410 as described herein. Each of the openings 4721, 4722, 4741, and 4742 may have a smaller diameter than the inner diameter of the corresponding port 3721, 3722, 3741, and 3742 to define port shoulders 4821, 4822, 4841, and 4842, respectively. In one example, as illustrated in FIGS. 34-50, the diameter of the ports 3721 and 3742 may be smaller than the diameter of adjacent ports 3722 and 3741, respectively, such that as described herein the ports 3721 and 3742 are configured to receive mass portions with different configurations than the mass portions received by the ports 3722 and 3741. Accordingly, as illustrated in the example of FIG. 49, the first port region 3729 may increase in size in a direction from the toe portion 3440 to the heel portion 3450, and the third port region 3749 may increase in size in a direction from the heel portion 3450 to the toe portion 3440. The apparatus, methods, and articles of manufacture described herein are not limited in this regard.

The body portion 3410 may include one or more mass portions (e.g., weight portion(s)), which may be integral mass portion(s) or separate mass portion(s) that may be coupled to the body portion 3410. In the illustrated example as illustrated in FIGS. 34-50, the body portion 3410 may include a first set of mass portions 3820 (e.g., illustrated as mass portions 3821 and 3822), a second set of mass portions 3830 (e.g., illustrated as mass portion 3831), and a third set of mass portions 3840 (e.g., illustrated as mass portions 3841 and 3842). The mass portions 3821 and 3842 may be similar in many respects to the mass portions 2521, 2522, 2541, and 2542 of the golf club head 2000. The mass portion 3831 may be similar in many respects to the mass portion 2531 of the golf club head 2000. Accordingly, as illustrated in the example of FIGS. 34-50, the second set of mass portions 3830 may include a single mass portion 3831, which may have a greater mass than any of the mass portions of the first set of mass portions 3820 and any of the mass portions of the third set of mass portions 3840. The apparatus, methods, and articles of manufacture described herein are not limited in this regard.

Figure 42:
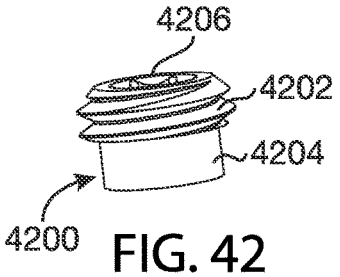
Figure 43:
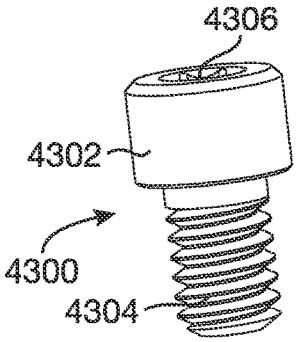
Figure 44:
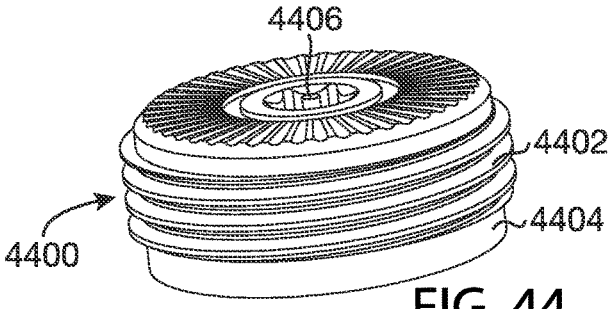
Figure 45:
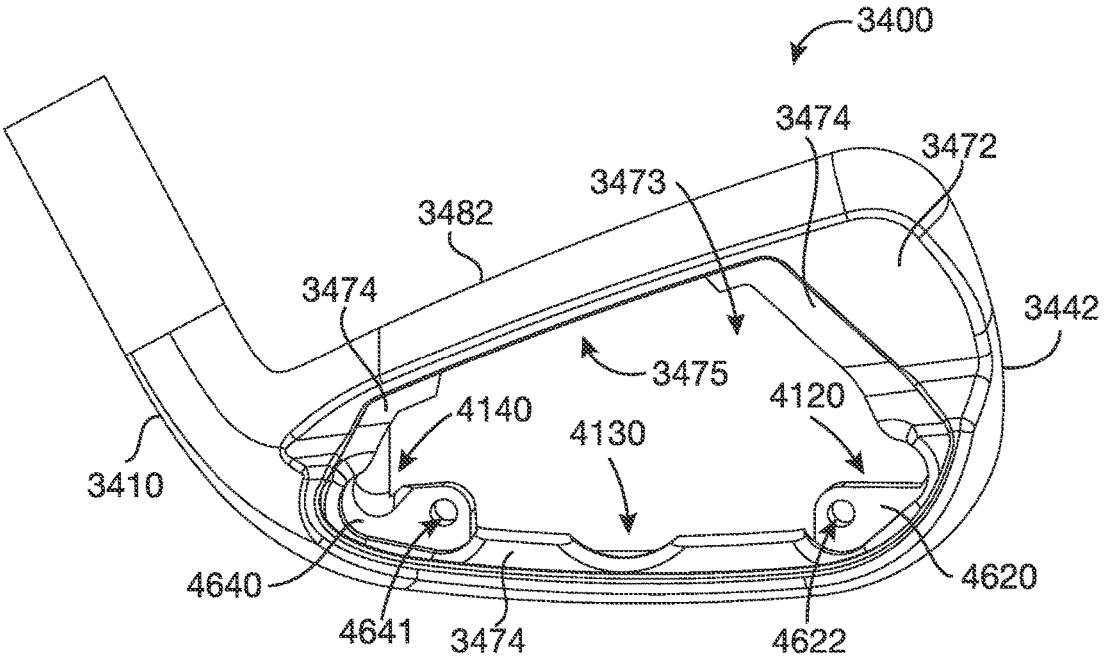
Figure 46:
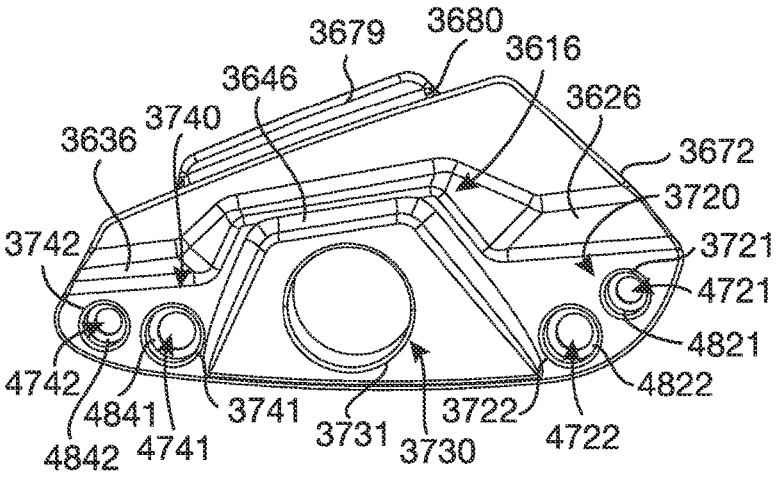
Figure 47:
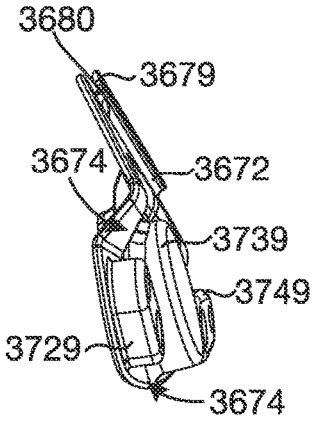
Figure 48:
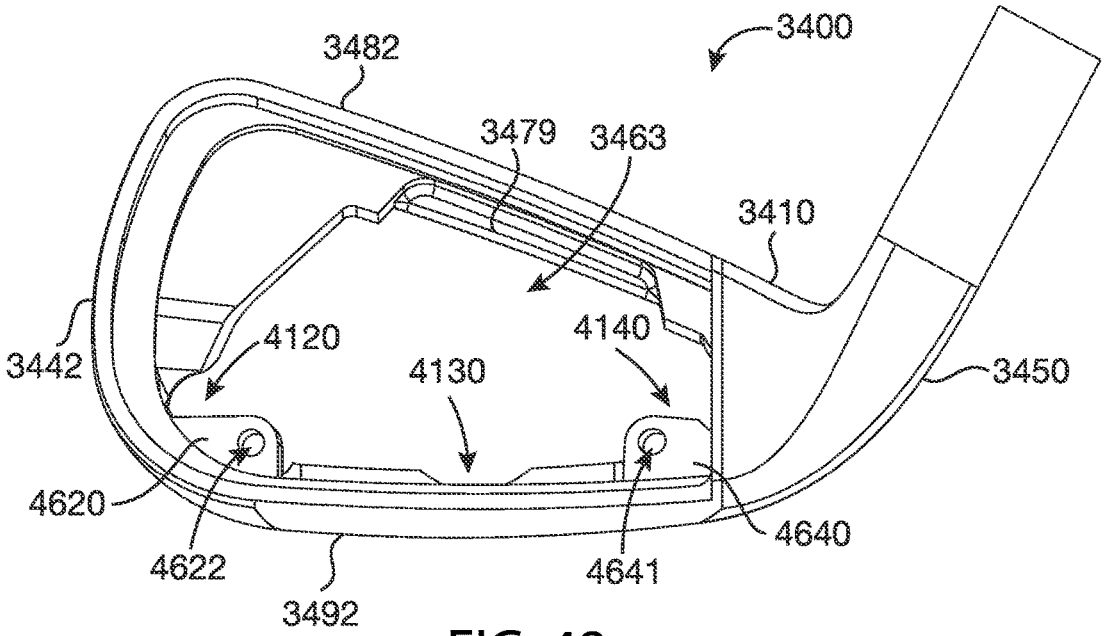

In one example, as illustrated in FIGS. 42-44, the mass portions of the first set of mass portions 3820, the second set of mass portions 3830, and the third set of mass portions 3840 may be associated with three types of mass portions. In one example, as illustrated in FIG. 42, a first type of mass portion may be a first plug-type mass portion 4200, which may include a head portion 4202 that may be threaded and a shaft portion 4204. The head portion 4202 may include a tool receiving top portion 4206 for operating the first plug-type mass portion 4200. The first plug-type mass portion 4200 may be utilized to close a correspondingly configured port on the body portion 3410 and/or may provide strategic weight placement on the body portion for golf club head mass, CG (center of gravity) location, and MOI (moment of inertia) optimization. As illustrated in FIG. 43, a second type of mass portion may be a fastener-type mass portion 4300, which may include a head portion 4402 and a shaft portion 4404 that may be threaded. The head portion 4302 may include a tool receiving top portion 4306 for operating the fastener-type mass portion 4300. The fastener-type mass portion 4300 may be utilized to close a correspondingly configured port on the body portion 3410, may provide strategic weight placement on the body portion for golf club head mass, CG location, and MOI optimization, and/or may provide a fastener function as described herein. As illustrated in FIG. 44, a third type of mass portion may be a second plug-type mass portion 4400, which may include a head portion 4402 that may be threaded and a shaft portion 4404. The head portion 4402 may include a tool receiving top portion 4406 for operating the second plug-type mass portion 4400. The second plug-type mass portion 4400 may be utilized to close a correspondingly configured port on the body portion 3410 and/or provide strategic weight placement on the body portion for golf club head mass, CG location, and MOI optimization. In one example, as illustrated in FIG. 44, the second plug-type mass portion 4400 may have a substantially greater diameter than length so as to resemble a disc-shaped mass portion. The second plug-type mass portion 4400 may have a greater diameter than the fastener-type mass portion 4300 and the first plug-type mass portion 4200. As described herein, in one example, the diameter of the ports 3721 and 3742 may be smaller than the diameter of the ports 3722 and 3741 and configured to receive the first plug-type mass portions 4200. Accordingly, as illustrated in FIGS. 34-50, the ports 3721 and 3742 may be configured to receive the first plug-type mass portions 4200, the ports 3722 and 3741 may be configured to receive the fastener-type mass portions 4300, and the port 3731 may be configured to receive the second plug-type mass portion 4400. In another example, the diameter of the ports 3721, 3722, 3741, and 3742 may be similar and configured to receive any of the mass portions 4200 or 4300. Accordingly, the mass portions 4200 and 4300 may have the same outer diameters. The mass of each of the mass portions of the first set of mass portions 3820, the second set of mass portions 3830, and the third set of mass portions 3840, and the total mass of first set of mass portions 3820, the second set of mass portions 3830, and the third set of mass portions 3840 relative to each other may be similar in many respects to the individual masses, total masses and relative masses of the first set of mass portions 2520, the second set of mass portions 2530, and the third set of mass portions 2540, respectively, of the golf club head 2000. The apparatus, methods, and articles of manufacture described herein are not limited in this regard.

As illustrated in FIGS. 34-50, each of the ports 3721 and 3742 may be configured to receive one of the first plug-type mass portions 4200. In one example, the inner walls of the ports 3721 and 3742 may be threaded to receive the threaded head portion 4202 of the first plug-type mass portion 4200. The diameter of the openings 4721 and 4742 may be smaller than an outer diameter of the shaft portion 4204 of the first plug-type mass portion 4200. Accordingly, the first plug-type mass portion 4200 may be screwed into the port 3721 or the port 3742 until the bottom of the shaft portion 4204 abuts the shoulder 4821 or 4842, respectively, to prevent further insertion of the first plug-type mass portion 4200 into the port 3721 or the port 3742. Each of the ports 3722 and 3741 may be configured to receive one of the fastener-type mass portions 4300. In one example, the inner walls of the ports 3722 and 3741 may not be threaded to receive the head portion 4302 of the fastener-type mass portion 4300. The diameter of the openings 4722 and 4741 may be smaller than the diameter of the head portion 4302 but larger than the diameter of the shaft portion 4304 of the fastener-type mass portion 4300. Accordingly, the shaft portion 4304 may be inserted through the openings 4722 or 4741 with further insertion being prevented by engagement of the head portion 4302 with the shoulders 4822 or 4841, respectively. The port 3731 may be configured to receive the second plug-type mass portion 4400. In one example, the inner walls of the port 3731 may be threaded to receive the threaded head portion 3984 of the second plug-type mass portion 4400. Accordingly, the second plug-type mass portion 4400 may be screwed into the port 3731 until the bottom of the shaft portion 4404 abuts the bottom of the port 3731. The apparatus, methods, and articles of manufacture described herein are not limited in this regard.

In one example, as illustrated in FIGS. 34-50, the body portion 3410 may include a first flange portion 4620 and a second flange portion 4640, which may extend from a location proximate to the sole portion edge 3492 into the interior cavity 3420. The first flange portion 4620 may be located at or proximate to the toe-side cutout portion 4120. The first flange portion 4620 may include a threaded bore 4622, which may axially align with the opening 4722 of the port 3722 when the back cover portion 3672 is seated or placed on the rim portions 3474 as described herein. The second flange portion 4640 may be located at or proximate to the heel-side cutout portion 4140. The second flange portion 4640 may include a threaded bore 4641, which may axially align with the opening 4741 of the port 3741 when the back cover portion 3672 is seated or placed on the rim portions 3474 as described herein. Each of the threaded bores 4622 and 4641 is configured to receive the shaft portion 4304 of a fastener-type mass portion 4300. The apparatus, methods, and articles of manufacture described herein are not limited in this regard.

In one example, to attach the back cover portion 3672 to the body portion 3410, the back cover tab portion 3679 may be inserted into the interior cavity 3420 from the back opening 3473 and aligned in position with the slot 3479. Accordingly, the back cover tab portion 3679 may be positioned between the slot 3479 and the front portion 3460. In one example, the slot 3479 may simply define a portion of the inner surface of the back wall portion 3472 that receives or contacts the back cover tab portion 3679. In another example, as illustrated in FIGS. 34-50, the slot 3479 may be defined by a recessed portion of the inner surface of the back wall portion 3472 that is configured to receive the back cover tab portion 3679. The rim portions 3474 may include an upper cutout portion 3475 that may provide visual alignment of the back cover tab portion 3679 relative to the slot 3479 when attaching the back cover portion 3672 to the body portion 3410, positioning of the back cover tab portion 3679 in the slot 3479, and/or accommodating the tab offset 3680 so that the back cover portion 3672 is properly positioned over the back opening 3473 and seated on the rim portions 3474 as described herein. After the back cover tab portion 3679 is aligned relative to the slot 3479, the back cover portion 3672 may be placed on the body portion 3410 such that the back cover perimeter portion 3674 engages with the rim portions 3474. As the back cover portion 3672 is moved toward the back wall portion 3472, the back cover tab portion 3679 may fully engage the slot 3479 and the back cover perimeter portion 3674 may engage the rim portions 3474 to close the back opening 3473. As illustrated in FIGS. 34-50, the first port region 3729 and the third portion region 3749 may extend into the toe-side cutout portion 4120 and the heel-side cutout portion 4140 and engage or be positioned proximate to the first flange portion 4620 and the second flange portion 4640, respectively. The opening 4722 of the port 3722 and the opening 4741 of the port 3741 may then be axially aligned with the threaded bore 4622 and the threaded bore 4641, respectively. The shaft portions 4304 of fastener-type mass portions 4300 may then be inserted through the openings 4722 and 4741 and threaded into the threaded bores 4622 and 4641 to secure the back cover portion 3672 to the body portion 3410. Accordingly, an upper portion of the back cover portion 3672 may be secured to the body portion 3410 by the back cover tab portion 3679 positioned in the slot 3479 and/or engaging the slot 3479, and a lower portion of the back cover portion 3672 may be secured to the body portion 3410 by the two fastener-type mass portions 4300 securing the back cover portion 3672 to the first flange portion 4620 and the second flange portion 4640. In another example, the attachment of the back cover portion 3672 to the body portion 3410 with the back cover tab portion 3679 and the fastener-type mass portions 4300 may be further reinforced with an adhesive or a bonding agent applied between the back cover perimeter portion 3674 and the rim portions 3474. The apparatus, methods, and articles of manufacture described herein are not limited in this regard.

In one example, the interior cavity 3420 may be partially or entirely filled with one or more filler materials (i.e., a cavity filling material), which may include one or more similar or different types of materials. In one example, as illustrated in FIGS. 34-50, the interior cavity 3420 may be filled with a filler material 3422. The interior cavity 3420 may be filled from any one or more of the ports of the first set of ports 3720 or the third set of ports 3740. In one example, as illustrated in FIGS. 34-50, the interior cavity 3420 may be filled with a filler material 3422 from any one or a combination of the openings 4721, 4722, 4741, or 4742 of the port 3721, 3722, 3741, or 3742, respectively. Any one or a combination of the openings 4721, 4722, 4741, or 4742 that are not used for injection of the filler material 3422 may be used to exhaust air from inside the interior cavity 3420 that is displaced by the filler material 3422. The openings 4721, 4722, 4741, and 4742 may then be closed by mass portions 3821, 3822, 3841, and 3842 being inserted into the ports 3721, 3722, 3741, and 3742, respectively, to close the ports, as described herein. In another example, the filler material 3422 may be a preformed or a premanufactured filler material that may be placed in the interior cavity 3420 prior to securing the back cover portion 3672 to the body portion 3410. In another example, the interior cavity 3420 may be filled with two or more filler materials having similar or different physical properties as described herein or in any of the incorporated by reference publications. The filler material(s) in the interior cavity 3420 may be any type of filler material(s) described herein. The apparatus, methods, and articles of manufacture described herein are not limited in this regard.

In the example of FIGS. 51-64, a golf club head 5100 may include a body portion 5110 having a toe portion 5140 with a toe portion edge 5142, a heel portion 5150 with a heel portion edge 5152 that may include a hosel portion 5155 configured to receive a shaft (an example shaft 104 is illustrated in FIG. 1) with a grip (an example grip 106 is illustrated in FIG. 1) on one end and the golf club head 5100 on the opposite end of the shaft to form a golf club (an example golf club 100 is illustrated in FIG. 1), a front portion 5160, a back portion 5170 with a back wall portion 5172, a top portion 5180 with a top portion edge 5182, and a sole portion 5190 with a sole portion edge 5192. The golf club head 5100 may include a face portion 5162 coupled to a front opening 5163 of the front portion 5160 to close the front opening 5163, and further include a front surface 5164 with a plurality of grooves 5165 and a back surface 5166. The golf club head 5100 may be associated with a ground plane 5210, a horizontal midplane 5220, and a top plane 5230, a loft plane 5240, a loft angle 5245 ($\alpha$), and a vertical plane 5250. The body portion 5110 may be a hollow body portion with the front opening 5163 and a back opening 5173 in the back wall portion 5172. Accordingly, the body portion 5110 may include a through hole defining an interior cavity 5120 having the front opening 5163 and the back opening 5173. As described herein, the face portion 5162 may be attached to the front portion 5160 to close the front opening 5163. The body portion 5110 may include a back cover portion 5372 that may be attached to the back wall portion 5172 to cover and close the back opening 5173, which along with the face portion 5162 closing the front opening 5163 enclose the interior cavity 5120. The golf club head 5100 may be similar in many respects to the golf club heads 2000 and 3400, to any of the golf club heads described herein, and/or described in any of the incorporated by reference publications. The above-described parts and features of the golf club head 5100 may be similar in many respects to the golf club heads 2000 and 3400. The apparatus, methods, and articles of manufacture described herein are not limited in this regard.

The back wall portion 5172 may include the back cover portion 5372 that may be similar in many respects to the back wall portion 3472 and the back cover portion 3672 of the golf club head 3400. Accordingly, the back wall portion 5172 may include an upper back wall portion 5312, a lower back wall portion 5314, and a ledge portion 5316 with a first ledge portion 5326, a second ledge portion 5336, and a third ledge portion 5346, which may be similar in many respects to the same parts of the golf club head 3400. As illustrated in FIGS. 51-64, the back wall portion 5172 may include rim portions 5174, a toe-side cutout portion 5820, a center cutout portion 5830, and a heel-side cutout portion 5840, and a slot 5179 on an inner surface of the back wall portion 5172, which may be similar in many respects to the same parts of the golf club head 3400. In one example, as illustrated in FIGS. 51-64, the back cover portion 5372 may be similar in many respects to the back cover portion 3672 of the golf club head 3400. Accordingly, the back cover portion 5372 may include a first port region 5429 that may include the first set of ports 5420 (e.g., illustrated as port 5421 and port 5422), a second port region 5439 that may include the second set of ports 5430 (e.g., illustrated as port 5431), and a third port region 5449 that may include the third set of ports 5440 (e.g., illustrated as port 5441 and port 5442), a back cover perimeter portion 5374, a back cover tab portion 5379, and a tab offset 5380, all of which may be similar in many respects to the corresponding parts of the back cover portion 3672 of the golf club head 3400. The apparatus, methods, and articles of manufacture described herein are not limited in this regard.

In one example, one or more of the ports of the first set of ports 5420, the second set of ports 5430 and/or the third set of ports 5440 may be connected to interior cavity 5120 through which one or more filler materials may be injected into the interior cavity 5120. In one example, as illustrated in FIGS. 51-64, the ports 5421, 5422, 5441, and 5442 may have similar inner diameters and include openings 6121, 6122, 6141, and 6142 with smaller opening diameters at the bottom portions thereof to define port shoulders 6221, 6222, 6241, and 6242, respectively. The port 5431 may be a through bore (i.e., connected to the interior cavity 5120) having a constant or substantially constant (considering manufacturing tolerances) inner diameter. Accordingly, in the illustrated example of FIGS. 51-64, all of the ports 5421, 5422, 5431, 5441, and 5442 may be connected to the interior cavity 5120 and may be used to inject one or more filler materials into the interior cavity 5120, such as the filler material 5122, and/or used as exhaust ports as described herein. The apparatus, methods, and articles of manufacture described herein are not limited in this regard.

The body portion 5110 may include one or more mass portions (e.g., weight portion(s)), which may be integral mass portion(s) or separate mass portion(s) that may be coupled to the body portion 5110. In the illustrated example of FIGS. 51-64, the body portion 5110 may include a first set of mass portions 5520 (e.g., illustrated as mass portions 5521 and 5522), a second set of mass portions 5530 (e.g., illustrated as mass portion 5531), and a third set of mass portions 5540 (e.g., illustrated as mass portions 5541 and 5542). The mass portions 5521, 5522, 5541, and 5542 may be the fastener-type mass portions 4300. Accordingly, the inner walls of the ports 5421, 5422, 5441, and 5442 may not be threaded to receive the head portions 4302 of the fastener-type mass portions 4300. The diameter of the openings 6121, 6122, 6141, and 6142 may be smaller than the diameter of the head portions 4302 but larger than the diameter of the shaft portions 4304 of the fastener-type mass portions 4300.

Accordingly, the shaft portions 4304 may be inserted through the openings 6121, 6122, 6141, and 6142 with further insertion being prevented by engagement of the head portion 4302 with the port shoulders 6221, 6222, 6241, and 6242, respectively. The mass portion 5531 may be a second plug-type mass portion 4400. Accordingly, the port 5431 may be configured to receive the head portion 4402 of the second plug-type mass portion 4400. The apparatus, methods, and articles of manufacture described herein are not limited in this regard.

In one example, as illustrated in FIGS. 51-64, the body portion 5110 may include a first flange portion 6020, a second flange portion 6040, and a third flange portion 6060, which may extend from a location proximate to the sole portion edge 5192 into the interior cavity 5120. The first flange portion 6020 may be located at or proximate to the toe-side cutout portion 5820. The first flange portion 6020 may include a first flange portion first bore 6021 and a first flange portion second bore 6022, both of which may be threaded through bores that may be axially align with the openings 6121 and 6122 of the ports 5421 and 5422, respectively, when the back cover portion 5372 is seated or placed on the rim portions 5174 as described herein. The second flange portion 6040 may be located at or proximate to the heel-side cutout portion 5840. The second flange portion 6040 may include a second flange portion first bore 6041, and a second flange portion second bore 6042, both of which may be threaded through bores that may axially align with the openings 6141 and 6142 of the ports 5441 and 5442, respectively, when the back cover portion 5372 is seated or placed on the rim portions 5174 as described herein. Each of the bores 6021, 6022, 6041, and 6042 may be configured to receive the shaft portion 4304 of a fastener-type mass portion 4300. The third flange portion 6060 may be located at or proximate to the center cutout portion 5830 and include a third flange portion bore 6061, which may be a threaded blind bore and may axially align with the port 5431 when the back cover portion 5372 is seated or placed on the rim portions 5174 as described herein. The third flange portion bore 6061 may be configured to receive the head portion 4402 of the second plug-type mass portion 4400. The apparatus, methods, and articles of manufacture described herein are not limited in this regard.

In one example, to attach the back cover portion 5372 to the body portion 5110, the back cover tab portion 5379 may be inserted into the interior cavity 5120 from the back opening 5173 and aligned in position with the slot 5179. Accordingly, the back cover tab portion 5379 may be positioned between the slot 5179 and the front portion 5160. In one example, the slot 5179 may simply define a portion of the inner surface of the back wall portion 5172 that receives or contacts the back cover tab portion 5379. In another example, as illustrated in FIGS. 51-64, the slot 5179 may be defined by a recessed portion of the inner surface of the back wall portion 5172 that is configured to receive the back cover tab portion 5379. The rim portions 5174 may include an upper cutout portion 5175 that may provide visual alignment of the back cover tab portion 5379 relative to the slot 5179 when attaching the back cover portion 5372 to the body portion 5110, positioning of the back cover tab portion 5379 in the slot 5179, and/or accommodating the tab offset 5380 so that the back cover portion 5372 is properly positioned over the back opening 5173. After the back cover tab portion 5379 is aligned relative to the slot 5179, the back cover portion 5372 may be placed on the body portion 5110 such that the back cover perimeter portion 5374 engages with the rim portions 5174. As the back cover portion 5372 is moved toward the back wall portion 5172, the back cover tab portion 5379 may fully engage the slot 5179 and the back cover perimeter portion 5374 may engage or couple with the rim portions 5174 to close the back opening 5173. As illustrated in FIGS. 51-64, the first port region 5429 and the third port region 5449 may extend into the toe-side cutout portion 5820 and the heel-side cutout portion 5840 and engage or be positioned proximate to the first flange portion 6020 and the second flange portion 6040, respectively. The openings 6121 and 6122 of the ports 5421 and 5422, the opening 6131 of the port 5431, and the openings 6141 and 6142 of the ports 5441 and 5442 may axially align with the bores 6021, 6022, 6061, 6041 and 6042, respectively. The shaft portions 4304 of fastener-type mass portions 4300 may then be inserted through the openings 6121, 6122, 6141, and 6142 and screwed into the bores 6021, 6022, 6041, and 6042 to secure the back cover portion 5372 to the body portion 5110. The head portion 4402 of a second plug-type mass portion 4400 may be screwed into the bore 6061 to secure the second plug-type mass portion 4400 in the port 5431 and to the body portion 5110. The second plug-type mass portion 4400 may be screwed into the bore 6061 until the shaft portion 4404 engages the bottom of the bore 6062. Accordingly, an upper portion of the back cover portion 5372 may be secured to the body portion 5110 by the back cover tab portion 5379 positioned in the slot 5179 and/or engaging the slot 5179, and a lower portion of the back cover portion 5372 may be secured to the body portion 5110 by the four fastener-type mass portions 4300 securing the back cover portion 5372 to the first flange portion 6020 and the second flange portion 6040. In another example, the attachment of the back cover portion 5372 to the body portion 5110 with the back cover tab portion 5379 and the fastener-type mass portions 4300 may be further reinforced with an adhesive or a bonding agent applied between the back cover perimeter portion 5374 and the rim portions 5174. The apparatus, methods, and articles of manufacture described herein are not limited in this regard.

In one example, the interior cavity 5120 may be partially or entirely filled with one or more filler materials (i.e., a cavity filling material), which may include one or more similar or different types of materials. In one example, as illustrated in FIGS. 51-64, the interior cavity 5120 may be filled with a filler material 5122. The interior cavity 5120 may be filled from any one or a combination of the ports of the first set of ports 5420, the second set of ports 5430, and the third set of ports 5440. In one example, as illustrated in FIGS. 51-64, the interior cavity 5120 may be filled with a filler material 5122 from any one or a combination of the openings 6121, 6122, 6131, 6141, or 6142 of the ports 5421, 5422, 5431, 5441, or 5442, respectively. Any one or a combination of the openings 6121, 6122, 6131, 6141, or 6142 that are not used for injection of the filler material 5122 may be used to exhaust air from inside the interior cavity 5120 that is displaced by the filler material 5122. The openings 6121, 6122, 6131, 6141, and 6142 may then be closed by mass portions 5521, 5522, 5531, 5541, and 5542 being inserted into the ports 5421, 5422, 5431, 5441, and 5442, respectively, to close the ports, as described herein. In another example, the filler material 5122 may be a preformed or a premanufactured filler material that may be placed in the interior cavity 5120 prior to securing the back cover portion 5372 to the body portion 5110. In another example, the interior cavity 5120 may be filled with two or more filler materials having similar or different physical properties as described herein or in any of the incorporated by reference publications. The filler material(s) in the interior cavity 5120 may be any type of filler material(s) described herein. The apparatus, methods, and articles of manufacture described herein are not limited in this regard.

Figure 64:
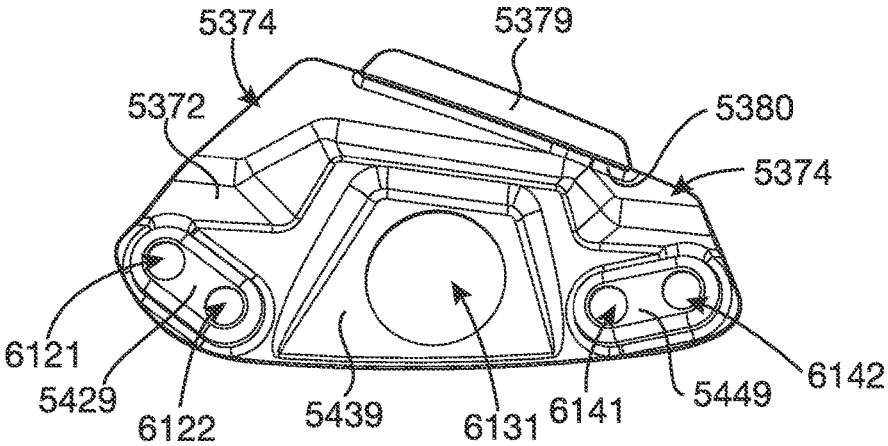

In one example, any one or more mass portions described herein may be constructed from a material having a density that is less than the density of the material of the golf club head. For example, for a golf club head constructed from steel, any one or more mass portions described herein may be constructed from a polymer material, aluminum, aluminum alloy, copper, magnesium or other materials that have a lower density than the density of steel. In another example, any one or more mass portions described herein may be constructed from a material having a density that is greater than the density of the material of the golf club head. For example, as illustrated in FIGS. 1-64, the golf club heads described herein may be at least partially constructed from steel, and the mass portions as described herein may be constructed from a tungsten or a tungsten alloy. Accordingly, mass portion with certain physical properties and configurations may be used for any of the golf club heads described herein to provide a pleasing sound and feel, and strategic weight placement on the body portion for golf club head mass, CG (center of gravity) location, and MOI (moment of inertia) optimization. The apparatus, methods, and articles of manufacture described herein are not limited in this regard.

Figure 65:
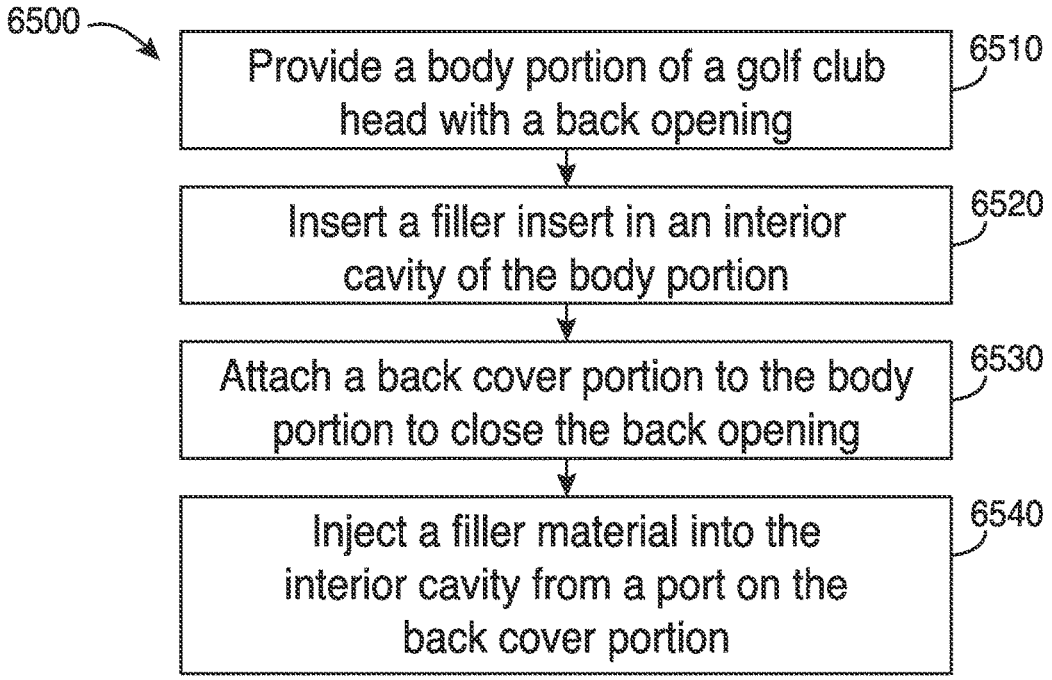
FIG. 65 depicts a manner in which an example golf club head described herein may be manufactured.

In one example, as illustrated in FIG. 65, a process 6500 for manufacturing the golf club head 2000 may include providing a body portion 2010 having a back opening 2073 (block 6510). As described herein, in one example, the second filler material 2024 may be in the form of a premanufactured insert. Accordingly, the second filler material 2024 may be inserted or placed in the interior cavity 2020 and/or attached with one or more adhesives or bonding agents to the inner walls of the body portion 2010 defining the interior cavity 2020 (block 6520). The back cover portion 2272 may then be attached to the body portion 2010 to close the back opening 2073 (block 6530) by one or more adhesives or bonding agents (i.e., back cover portion 2272 coupled to the body portion 2010 with one or more adhesives or bonding agents), welding, and/or soldering as described herein. After the back cover portion 2272 is attached to the body portion 2010, any one of the openings 2361 and 2382 of the ports 2321 and 2342, respectively, may be used to inject the first filler material 2022 into the interior cavity 2020 (block 6540), whereas the other port may be used to exhaust air from inside the interior cavity 2020 that is displaced by the first filler material 2022 as described herein. Subsequently, mass portions may be inserted into the ports of the back cover portion 2272 to close the ports as described herein. In another example, both the first filler material 2022 and the second filler material 2024 may be premanufactured inserts that are inserted into the interior cavity 2020 before the back cover portion 2272 is attached to the body portion 2010. In another example, both the first filler material 2022 and the second filler material 2024 may be injected into the interior cavity 2020 after the back cover portion 2272 is attached to the body portion 2010. In yet another example, the golf club head 2000 may include only a single filler material similar to the golf club heads 3400 and 5100. The apparatus, methods, and articles of manufacture described herein are not limited in this regard.

Figure 66:
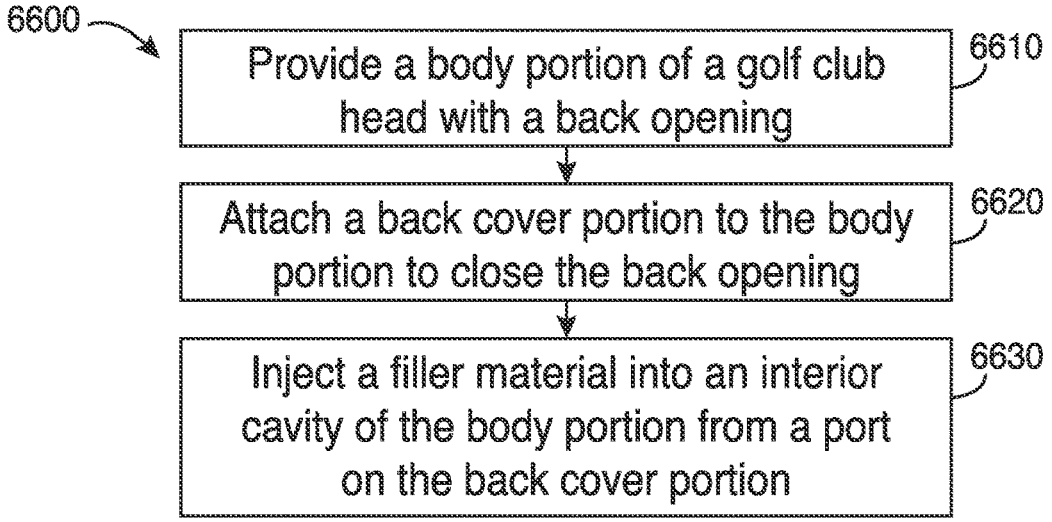
FIG. 66 depicts a manner in which an example golf club head described herein may be manufactured.

In one example, as illustrated in FIG. 66, a process 6600 for manufacturing the golf club head 3400 may include providing a body portion 3410 (block 6610) having a back opening 3473 as described herein. The back cover portion 3672 may be attached to the body portion 3410 (block 6620) to close the back opening 3473 by one or more fastener-type mass portions as described herein. According to the illustrated example of FIGS. 34-50, the back cover portion 3672 may be attached to the body portion 3410 by engagement of the back cover tab portion 3679 with the slot 3479 of the body portion 3410 and by two fastener-type mass portions 4300 attaching the back cover portion 3672 to the first flange portion 4620 and the second flange portion 4640 as described herein. After the back cover portion 3672 is attached to the body portion 3410, any one of the openings 4721 and 4742 of the ports 3721 and 3742, respectively, may be used to inject the filler material 3422 into the interior cavity 3420 (block 6630), whereas the other port of the back cover portion 3672 may be used to exhaust the air from inside the interior cavity 3420 that is displaced by the filler material 3422 as described herein. Subsequently, mass portions may be inserted into the ports 3721 and 3742 to close the ports as described herein. In another example, the filler material 3422 and may be a premanufactured insert that may be attached to the body portion 3410 or placed in the interior cavity 3420 before the back cover portion 3672 is attached to the body portion 3410. In yet another example, more than one filler material may be placed in the interior cavity 3420 similar to the filler materials and associated processes of the golf club head 2000 as described herein. The apparatus, methods, and articles of manufacture described herein are not limited in this regard.

A process for manufacturing the golf club head 5100 may be similar in many respects to the process 6600. According to the illustrated example of FIGS. 51-64, the back cover portion 5372 may be attached to the body portion 5110 by engagement of the back cover tab portion 5379 with the slot 5179 of the body portion 5110 and by four fastener-type mass portions 4300 attaching the back cover portion 5372 to the first flange portion 6020 and the second flange portion 6040 as described herein. According to the illustrated example of FIGS. 51-64, a fastener-type mass portion may be screwed into one of the bores 6022 and 6024 of the first flange portion 6020 and a fastener-type mass portion may be screwed into one of the bores 6042 and 6044 of the second flange portion 6040 to attach the back cover portion 5372 to the body portion 5110 as described herein. After the back cover portion 3672 is attached to the body portion 3410 (block 6620) by at least one of the fastener-type mass portions 4300, any one of the openings 5421, 5422, 5441 or 5442, respectively, that are open may be used to inject the filler material 5122 into the interior cavity 5120 (block 6630), whereas the other ports may be used to exhaust air from inside the interior cavity 5120 that is displaced by the filler material 5122 as described herein. In one example, the back cover portion 5372 may be attached to the body portion 5110 by a fastener-type mass portion 4300 being inserted into any one of the ports 5421 or 5422 and screwed into any one of the bores 6022 or 6024, respectively, and another fastener-type mass portion 4300 being inserted into any one of the ports 5441 or 5442 and screwed into any one of the bores 6042 or 6044, respectively. Any one of the ports 5421, 5422, 5441, and 5442 that are open (i.e., without a fastener-type mass portion therein) may be used to fill the interior cavity 5120 with the filler material 5122. Subsequently, fastener-type mass portions 4300 may be inserted into the open ports and screwed into the corresponding bores of the first flange portion 6020 and the second flange portion 6040 to close the open ports and complete attachment of the back cover portion 5372 to the body portion 5110. In another example, the filler material 5122 and may be premanufactured insert that may be attached to the body portion 5110 or placed in the interior cavity 5120 before the back cover portion 5372 is attached to the body portion 5110. In yet another example, more than one filler material may be placed in the interior cavity 5120 similar to the filler materials and associated processes of the golf club head 2000 as described herein. Any of the steps in the processes 6500 and 6600 may be interchangeable and may be used to manufacture the golf club heads 2000, 3400, and/or 5100 as described herein. Accordingly, the golf club heads 2000, 3400, and 5100 may be manufactured by the process 6500 or the process 6600. The apparatus, methods, and articles of manufacture described herein are not limited in this regard.

Any of the golf club heads described herein may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although a particular type of club head may be depicted and described, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The body portion and/or the face portion of any of the golf club heads described herein may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. The body portion and/or the face portion may be constructed with materials that are similar to any of the body portions and/or face portions described herein or in any of the incorporated by reference publications. The apparatus, methods, and articles of manufacture described herein are not limited in this regard.

In one example, the area of the front surface of the face portion of any of the golf club heads described herein may be greater than or equal to 330 $mm^2$ and less than or equal to 5000 $mm^2$. In another example, the area of the front surface of the face portion of any of the golf club heads described herein may be greater than or equal to 1000 $mm^2$ and less than or equal to 5300 $mm^2$. In yet another example, the area of the front surface of the face portion of any of the golf club heads described herein may be greater than or equal to 1500 $mm^2$ and less than or equal to 4800 $mm^2$. While the above examples may describe particular areas, the area of the front surface may greater than or less than those numbers. The apparatus, methods, and articles of manufacture described herein are not limited in this regard.

In one example, a filler material as described herein may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties (e.g., one or more adhesive or epoxy materials). A material may also absorb shock, isolate vibration, and/or dampen noise when a golf club head as described herein strikes a golf ball. Further, a filler material may be an epoxy material that may be flexible or slightly flexible when cured. In another example, a filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, a filler material may include 3M™ Scotch-Weld™ DP100 Plus Clear adhesive. In another example, a filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In yet another example, a filler material may be LOCTITE® materials manufactured by Henkel Corporation, Rocky Hill, Connecticut. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, any one or more of the filler materials described herein may be formed from one or more metals or metal alloys, such as aluminum, copper, zinc, and/or titanium. A filler material not specifically described in detail herein may include one or more similar or different types of materials described herein and in any of the incorporated by reference publications. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference publications. The apparatus, methods, and articles of manufacture described herein are not limited in this regard.

The apparatus, methods, and articles of manufacture described herein may include one or more club identifiers (e.g., a serial number, a matrix barcode, a trademark, a club number, a loft angle, a character, etc.). For example, any of the golf club heads described herein may include a visual indicator such as a club number to identify the type of golf club. In particular, the club number may correspond to the loft angle of the golf club head (e.g., 3, 4, 5, 6, 7, 8, or 9). In one example, a 7-iron type golf club head may be marked with "7". In another example, a golf club head may be marked with the loft angle. For example, a 1-degree wedge type golf club head may be marked "1". In yet another example, a 10.5-degree driver type golf club head may be marked "10.5." Any marking(s) associated with a club identifier may be visually differentiated (e.g., different color, texture, pattern, etc.) from the rest of a golf club head. To distinguish from other golf club heads, a golf club head as described herein may include a trademark (e.g., a word, a name, a symbol, a design, or any combination thereof) to identify a brand name or a model of the golf club head (e.g., distinguish from other manufacturer or seller). The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various location on the golf club head (e.g., the heel portion, the hosel portion, the face portion, the top portion, the sole portion, etc.) using various methods (e.g., painted, laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy). The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "a," "an," and/or "the" used in the context of describing various embodiments the present disclosure are to be construed to cover both the singular and the plural, unless otherwise indicated herein or clearly contradicted by context. The term "coupled", and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein. The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion being hollow to define an interior cavity, the body portion made from a first material with a first density, the body portion comprising a toe portion with a toe portion edge, a heel portion with a heel portion edge, a front portion, a back portion with a back wall portion including a back opening portion, a top portion with a top portion edge, and a sole portion with a sole portion edge;

a back cover portion made from second material with a second density different from the first density, the back cover portion coupled to the body portion to close the back opening portion;

a filler material at least partially filling the interior cavity;

a first mass portion having a first diameter and a first length, the first mass portion coupled to the back cover portion, the first mass portion made from a third material with a third density greater than the first density; and a second mass portion having a second diameter and a second length, the second mass portion coupled to a center portion of the back cover portion, the second mass portion made from the third material, wherein the second diameter is greater than the first diameter.

2. A golf club head as defined in claim 1, wherein the first length is greater than the second length.

3. A golf club head as defined in claim 1, wherein the second diameter is at least twice as long as the first diameter.

4. A golf club head as defined in claim 1, wherein the first mass portion includes a threaded portion screwed into a correspondingly threaded bore on the body portion to attach the back cover portion to the body portion.

5. A golf club head as defined in claim 1, wherein the first diameter and the second diameter are visible when viewing the back wall portion of the body portion.

6. A golf club head as defined in claim 1, wherein the second density is less than the first density.

7. A golf club head as defined in claim 1, wherein the back cover portion comprises a composite-type material.

8. An iron-type golf club head comprising:

a body portion comprising an interior cavity, a toe portion with a toe portion edge, a heel portion with a heel portion edge, a front portion, a back portion with a back opening portion, a top portion with a top portion edge, and a sole portion with a sole portion edge;

a first port connected to the interior cavity;

a back cover portion removably attached to the body portion to close the back opening portion, the back cover portion including a second port located at or proximate to a center portion of the back cover portion;

a first mass portion having a first total mass, the first mass portion configured to close the first port;

a second mass portion having a second total mass, the second mass portion configured to close the second port; and a filler material injected into the interior cavity from the first port, wherein the second total mass is at least twice as much as the first total mass.

9. An iron-type golf club head as defined in claim 8, wherein at least one of the first mass portion or the second mass portion comprises a material having a density greater than a density of a material of the body portion.

10. An iron-type golf club head as defined in claim 8, wherein the filler material comprises a material having a density lower than a density of a material of the body portion.

11. An iron-type golf club head as defined in claim 8 further comprising a third port on the back cover portion and a third mass portion configured to close the third port, wherein the first port is located on the back cover portion between the second port and the toe portion edge, and wherein the third port is located between the second port and the heel portion edge.

12. An iron-type golf club head as defined in claim 8, wherein the second mass portion comprises a second mass portion dimension that is visible to an individual viewing the golf club head, wherein the first mass portion comprises a first mass portion dimension that is visible when viewing the golf club head, and wherein the second mass portion dimension is at least twice as large as the first mass portion dimension.

13. An iron-type golf club head as defined in claim 8, wherein the back cover portion comprises a material having a density lower than a density of a material of the body portion.

14. An iron-type golf club head as defined in claim 8, wherein the back cover portion comprises a carbon composite-type material.

15. A golf club head comprising:

a first mass portion;

a second mass portion;

a third mass portion;

a body portion including an interior cavity, a toe portion with a toe portion edge, a heel portion with a heel portion edge, a front portion, a back portion with a back wall portion, a top portion with a top portion edge, and a sole portion with a sole portion edge, the back wall portion comprising:

a first port configured to receive the first mass portion, a distance from the first port to the toe portion edge being less than a distance from the first port to the heel portion edge;

a second port located at a center portion of the back wall portion and configured to receive the second mass portion; and a third port configured to receive the third mass portion, a distance from the third port to the toe portion edge being greater than a distance from the third port to the heel portion edge;

a filler material at least partially filling the interior cavity, wherein at least 50% of the back wall portion comprises a material having a density lower than a material of the body portion, and wherein a total mass of the second mass portion is greater than a total mass of the first mass portion and the third mass portion.

16. A golf club head as defined in claim 15, wherein at least one of the first mass portion, the second mass portion, or the third mass portion comprises a tungsten-based material.

17. A golf club head as defined in claim 15, wherein the filler material comprises a polymer material injected into the interior cavity from at least one of the first port, the second port, or the third port.

18. A golf club head as defined in claim 15, wherein a dimension of the second port is greater than twice as much as a corresponding dimension of the first port or a corresponding dimension of the third port.

19. A golf club head as defined in claim 15, wherein the at least 50% of the back wall portion that comprises a material having a density lower than a material of the body portion is removable and fastened to the body portion with at least one of the first mass portion or the third mass portion.

20. A golf club head as defined in claim 15, wherein the at least 50% of the back wall portion that comprises a material having a density lower than a material of the body portion comprises a carbon composite-type material.

* * * * *